US006218065B1

(12) United States Patent
Tanikawa et al.

(10) Patent No.: US 6,218,065 B1
(45) Date of Patent: Apr. 17, 2001

(54) TONER HAVING NEGATIVE TRIBOELECTRIC CHARGEABILITY AND DEVELOPING METHOD

(75) Inventors: Hirohide Tanikawa; Takeshi Ohtake, both of Shizuoka-ken; Makoto Unno, Tokyo; Makoto Kanbayashi, Shizuoka-ken, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/204,267

(22) Filed: Dec. 3, 1998

(30) Foreign Application Priority Data

Dec. 5, 1997 (JP) ..... 9-335599

(51) Int. Cl.[7] ..... G03G 9/097
(52) U.S. Cl. ..... 430/110; 430/120
(58) Field of Search ..... 430/110, 120

(56) References Cited

U.S. PATENT DOCUMENTS

| | | | | |
|---|---|---|---|---|
| 4,857,432 | | 8/1989 | Tanikawa et al. | 430/106 |
| 4,886,730 | | 12/1989 | Ota et al. | 430/137 |
| 5,200,288 | * | 4/1993 | Ando et al. | 430/110 |
| 5,302,481 | | 4/1994 | Ong | 430/106 |
| 5,332,636 | | 7/1994 | Ong | 430/106.6 |
| 5,439,770 | | 8/1995 | Taya et al. | 430/106 |
| 5,483,327 | | 1/1996 | Taya et al. | 355/245 |
| 5,529,872 | * | 6/1996 | Grychtol et al. | 430/106 |
| 5,700,617 | | 12/1997 | Takiguchi et al. | 430/110 |
| 5,747,209 | | 5/1998 | Takiguchi et al. | 430/106.6 |
| 5,876,896 | * | 3/1999 | Suda et al. | 430/115 |
| 5,879,848 | * | 3/1999 | Kurose et al. | 430/110 |
| 5,902,709 | * | 5/1999 | Nakayama et al. | 430/109 |

FOREIGN PATENT DOCUMENTS

| | | |
|---|---|---|
| 3825829 | 2/1989 | (DE) . |
| 0490370 | 6/1992 | (EP) . |
| 53-127726 | 11/1978 | (JP) . |
| 104940 | 6/1982 | (JP) . |
| 111541 | 7/1982 | (JP) . |
| 124357 | 8/1982 | (JP) . |
| 61-069073 | 4/1986 | (JP) . |
| 61-073963 | 4/1986 | (JP) . |
| 61-267058 | 11/1986 | (JP) . |
| 62-105156 | 5/1987 | (JP) . |
| 62-145255 | 6/1987 | (JP) . |
| 62-163061 | 7/1987 | (JP) . |
| 63-208865 | 8/1988 | (JP) . |
| 3-276166 | 12/1991 | (JP) . |
| 4-84141 | 3/1992 | (JP) . |
| 8-160688 | 6/1996 | (JP) . |

OTHER PUBLICATIONS

Database WPI, Section Ch, Wk 931, Derwent, AN93–089545 (XP002096469) 1993.

Database WPI, Section Ch, Wk 8336, Derwent AN83–755975 (XP002096483) 1993.

Database WPI, Section Ch, Wk 7742, Derwent AN77–75153Y (XP002096484) 1977.

* cited by examiner

*Primary Examiner*—John Goodrow
(74) *Attorney, Agent, or Firm*—Fitzpatrick, Cella, Harper & Scinto

(57) ABSTRACT

A toner having a negative triboelectric chargeability and suitable for developing positively or negatively charged images is composed of at least a binder resin, a colorant and an organic metal compound. The organic metal compound is an organic zirconium compound comprising a coordination or/and a bonding of zirconium and an aromatic compound as a ligand or/and an acid source selected from the group consisting of aromatic diols, aromatic hydroxycarboxylic acids, aromatic monocarboxylic acids, and aromatic polycarboxylic acids.

54 Claims, 3 Drawing Sheets

TONER HAVING NEGATIVE TRIBOELECTRIC CHARGEABILITY AND DEVELOPING METHOD

FIELD OF THE INVENTION AND RELATED ART

The present invention relates to a toner for developing electrostatic images in image forming methods, such as electrophotography and electrostatic recording, or an image forming method of the toner jet recording scheme, and a developing method using the toner.

It is necessary for such a toner to be provided with a positive or negative charge depending on the polarity of an electrostatic image to be developed and the developing mode (normal development mode or reversal development mode).

A toner can be charged by utilizing a triboelectric chargeability of a resin as a toner component, but the toner chargeability in this case is unstable so that the resultant image density cannot be raised quickly at the start of image formation and the resultant images are liable to be foggy. For this reason, it has been frequently practiced to add a charge control agent to the toner to provide the toner with a desired triboelectric chargeability.

The charge control agents known in the art nowadays include: negatively chargeable charge control agents inclusive of metal complex salts of monoazo dyes; metal complex salts of hydroxycarboxylic acids, dicarboxylic acids and aromatic diols; and resins containing an acidic component. On the other hand, known positively chargeable charge control agents include: nigrosine dyes, azine dyes, triphenylmethane dyes and pigments, quaternary ammonium salts, and polymers having a quaternary ammonium salt as a side chain.

However, most of such known charge control agents applicable to color toners have still left functionally unsatisfactory points, such as difficulty in formation of uniform highlight images and a large fluctuation in image density during continuous image formation.

Other points to be further improved may include: a difficulty in obtaining a good balance between image density and fog prevention, a difficulty in obtaining a sufficient image density in a high humidity environment, a poor dispersibility in a resin, and adverse effects on storage stability, fixability and anti-offset property of the resultant toner.

As known charge control agents, metal complexes or metal salts of aromatic carboxylic acids have been proposed in Japanese Laid-Open Patent Application (JP-A) 53-127726, JP-A 57-111541, JP-A 57-124357, JP-A 57-104940, JP-A 61-69073, JP-A 61-73963, JP-A 61-267058, JP-A 62-105156, JP-A 62-145255, JP-A 62-163061, JP-A 63-208865, JP-A 3-276166, JP-A 4-84141, and JP-A 8-160668. Charge control agents proposed in these references are generally excellent in performance of imparting triboelectric chargeability, but few of them are satisfactory in providing a stable developing performance regardless of environmental condition change, continued use and condition of use even when used in a simple developing device structure. Few of them provide a stable developing performance in a long term of continuous image formation when used in a high-speed image forming machine. Further, many of them are affected by other toner materials, thus posing a constraint on the selection of such other toner materials.

SUMMARY OF THE INVENTION

A generic object of the present invention is to provide a toner having a negative triboelectric chargeability and having solved the above-mentioned problems.

A more specific object of the present invention is to provide a toner having a negative triboelectric chargeability and a developing method using the toner capable of stably providing high image qualities even when used in a low humidity environment or in a high humidity environment and not causing image defects with lapse of time.

Another object of the present invention is provide a toner having a negative triboelectric chargeability which is less liable to result in deteriorated toner even when used in a cartridge-type developing device of either a replenishment-type or a use-up type and exhibits excellent developing performance, and a developing method using such a toner.

Still another object of the present invention is to provide a toner having a negative triboelectric chargeability and a developing method for developing electrostatic images capable of continually providing developed images faithful to electrostatic images even in a long term of continuous image formation.

According to the present invention, there is provided a toner having a negative triboelectric chargeability, comprising at least a binder resin, a colorant and an organic metal compound, wherein the organic metal compound is an organic zirconium compound comprising a coordination or/and a bonding of zirconium and an aromatic compound as a ligand or/and an acid source selected from the group consisting of aromatic diols, aromatic hydroxycarboxylic acids, aromatic monocarboxylic acids, and aromatic polycarboxylic acids.

According to another aspect of the present invention, there is provided a method for developing an electrostatic image, comprising the steps of:

forming a layer of a mono-component developer comprising the above-mentioned toner having a negative triboelectric charge in a regulated thickness on a developer-carrying member by a developer thickness-regulation means, and developing an electrostatic image on an electrostatic image-bearing member disposed opposite to the developer-carrying member with the mono-component developer carried on the developer-carrying member.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
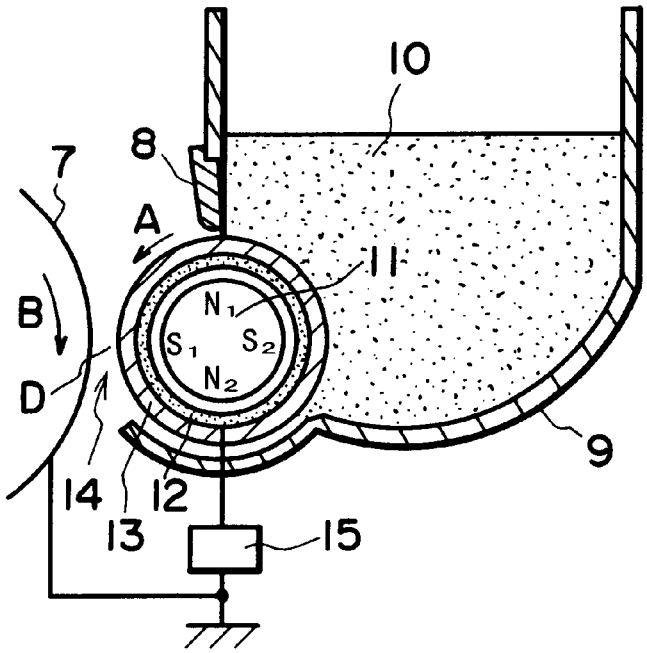
FIGS. 1 and 2 are respectively a sectional illustration of a developer replenishment-type developing device equipped with a developer-carrying member and a magnetic blade (FIG. 1) or an elastic blade (FIG. 2), respectively, as a regulating member and applicable to an embodiment of the developing method according to the invention.

We have found it possible to provide a toner having a quick chargeability, having a high chargeability even in a high humidity environment and also free from excessive charging even in a low humidity environment by using an organic zirconium compound obtained by reaction of a zirconium compound with an aromatic diol, an aromatic monocarboxylic acid, an aromatic polycarboxylic acid or/and an aromatic hydroxycarboxylic acid. The organic zirconium compound used in the present invention is excellent in transparency and is desirably used in a color toner for providing clear color images. The organic zirconium compound can contain below 20 wt. % of hafnium element based on the zirconium element.

The organic zirconium compounds usable in the present invention may be classified into the following three categories:

(i) zirconium complexes each comprising metal element of zirconium and a ligand of an aromatic diol, an aromatic hydroxycarboxylic acid or an aromatic polycarboxylic acid, (ii) zirconium complex salts each comprising a metal element of zirconium and a ligand of an aromatic diol, an aromatic hydroxycarboxylic acid or an aromatic polycarboxylic acid, and (iii) salts of zirconium with aromatic carboxylic acids inclusive of aromatic monocarboxylic acids, aromatic hydroxycarboxylic acids and aromatic polycarboxylic acids.

It is preferred to use a zirconium complex or zirconium complex salt including 1–4 units of aromatic diol, aromatic hydroxycarboxylic acid or aromatic polycarboxylic acid so as to form a chelate. It is also possible to use a zirconium complex or complex salt including 1–6 units of coordinating carboxy anions of aromatic diol, aromatic hydroxycarboxylic acid or aromatic polycarboxylic acid. In the case of an organic zirconium salt, it is preferred to use a salt having 1–4 units, more preferably 1–3 units, of aromatic carboxyl acid, aromatic hydroxycarboxylic acid or aromatic polycarboxylic acid. It is also possible to use a mixture of complexes or complex salts having different number of chelates or/and different species of ligands. The zirconium salt can also be a mixture of two or more species of organic zirconium salts including those of different numbers of acids per molecule. The organic zirconium compound can also be a mixture of an organic zirconium complex compound and an organic zirconium salt.

It has been found that the organic zirconium compound provides an excellent developing performance to a monocomponent developer, inclusive of a magnetic toner containing magnetic powder, which is required to exhibit a quick chargeability and a high chargeability through relatively few triboelectrification opportunities, because of excellent performances as a negative charge control agent of the organic zirconium compound. It is also optimum to provide a non-magnetic toner used in a non-magnetic monocomponent developing method.

It is preferred that the organic zirconium compound is used in combination with a resin having an acid value in order to further improve the triboelectric chargeability while utilizing the polarity of water molecules retained in the toner particles. The dispersibility of the organic zirconium compound in the toner can be improved by using two or more species of waxes having different melting points or compositions, thereby providing a toner showing improved uniform chargeability and continuous image formation performances.

The toner according to the present invention containing the organic zirconium compound not only exhibits a sufficient chargeability in a low or high humidity environment but also suppresses a lowering in image density during a long term of continuous image formation. The organic zirconium compound is particularly effective for use in a magnetic toner containing a magnetic iron oxide comprising various different species of elements. Iron oxide containing different elements or oxides or hydroxides of such different elements, or iron oxide forming a mixture crystal with such different elements, may be effective for adsorbing water molecules, thus effectively improving and stabilizing the charging based on utilization of the polarity of water molecules. This effect is enhanced when a binder resin having an acid value is used in combination therewith.

The organic zirconium compound used in the present invention includes a zirconium ion capable of easily assuming an octa-coordinated configuration to be coordinated or bonded with oxygen of carboxyl and/or hydroxyl group. Accordingly, if a binder resin having an acid value, such as a styrene resin having a functional carboxyl group or a polyester resin, is used together therewith, the organic zirconium compound can exhibit a good affinity with and a good dispersibility in the binder resin, so that the liberation thereof from the toner particles can be well suppressed to provide a uniform and continuously stable chargeability. The organic zirconium compound exhibits little adverse effect to the toner transparency, thus being preferable for constituting a color toner.

Further, as the binder resin can be provided with an increased crosslinking via the carboxyl or hydroxyl group of the binder resin coordinated with the zirconium, the binder resin can be provided with an increased rubber elasticity, which favors an increased releasability and effective prevention of soiling of the fixing member. Thus, it is preferred that the binder resin is crosslinked to such a degree that it contains a THF-insoluble content. As a result, it becomes possible to exert a shearing force during melt-kneading, thus improving the dispersion of a magnetic material, a pigment, or a dye to provide a toner exhibiting a high coloring power and/or a clear hue.

As mentioned above, the organic zirconium compound used in the present invention is excellent in triboelectric chargeability-imparting performance, so that it functions as a charge control agent suitable for a magnetic toner requiring a high chargeability. Further, the organic zirconium compound not only shows a good dispersibility thereof in a binder resin but also functions to promote the dispersion of a magnetic material in the binder resin if a resin having an acid value is used as the binder resin, thus providing a magnetic toner with improved uniform chargeability and continuous image formation performances.

Further, it has been found that the organic zirconium compound used in the present invention exerts some influence on the surface tension of the toner binder resin and provides a toner with an excellent releasability when used in combination with a plurality of waxes. As a result, it becomes possible to provide a toner exhibiting excellent anti-offset characteristic and suppressed soiling of the fixing member. This effect is promoted when used in combination with a binder resin having an acid value.

Another characteristic of the organic zirconium compound used in the present invention is that it provides a toner less liable to cause a lowering in developing performance after standing. For example, when the toner is used in a high-humidity environment, then left standing for some pause period and then re-used for image formation, the resultant images cause little lowering in image density.

Further, the toner according to the present invention containing the organic zirconium compound is less liable to cause insufficiently charged toner particles leading to scattering toner particles. For example, a magnetic toner is liable to cause a noticeable scattering in a low-humidity environment wherein the agglomerating force is lowered, thus causing various difficulties. More specifically, in case of an image forming system using the corona charging scheme, the scattered toner is attached to the charging wire to cause discharge abnormality which results in an abnormally charged electrostatic image leading to a streak-like image defect in the case of primary charging and also a streak-like transfer failure in the case of transfer charging. However, the toner according to the present invention can reduce such difficulties. In case of an image forming system using a contact charging scheme, the scattered toner is liable to soil the contact transfer unit and the soiling toner is liable to be transferred to a transfer paper, thus causing so-called back soiling. The toner according to the present invention is also less liable to cause such difficulty.

In the case of a non-magnetic toner, the toner particle scattering phenomenon is more noticeably caused in a high-humidity environment since the toner is constrained only by an electrostatic force, this scattering phenomenon is also reduced by the toner according to the present invention. Further, in a low-humidity environment, a non-magnetic toner is liable to cause a density irregularity in a halftone image due to insufficiently charged particles. This difficulty can also be reduced by the toner according to the present invention.

Now, the organic zirconium compounds inclusive of zirconium complex, complex salts and salt with aromatic diol, aromatic hydroxycarboxylic acid and aromatic polycarboxylic acid will be described more specifically.

Preferred examples of the zirconium complex or complex salts may include those represented by formulae (1) and (2) below:

(1)

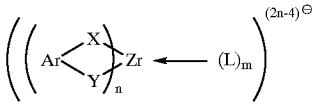

(2n - 4)Cl or (n - 2)C2$^{2\oplus}$ wherein Ar denotes an aromatic residual group capable of having a substituent of alkyl, aryl, aralkyl, cycloalkyl, alkenyl, alkoxy, aryloxy, hydroxyl, alkoxycarbonyl, aryloxycarbonyl, acyl, acyloxy, carboxyl, halogen, nitro, cyano, amino, amide, or carbamoyl; X and Y independently denotes O or —CO—O—; L denotes a neutral ligand of water, alcohol, ammonia, alkylamine or pyridine; C1 denotes a monovalent cation, such as hydrogen ion, monovalent metal ion, ammonium ion or alkylammonium ion; C2 denotes a divalent cation, such as a metal ion; n is 2, 3 or 4; m is 0, 2 or 4; a number (n) of ligands (such as aromatic carboxylic acids and diols) can be identical to or different from each other, and a number (m>0) of neutral ligands can be identical to or different from each other in each complex or complex salt of a formula. Further, each complex or complex salt of a formula can also be a mixture of complex compounds having mutually different n or/and m, or a mixture of complex salts having mutually different counter ions C1 or/and C2. In order to improve the dispersibility in binder resin and charge control ability of a complex or complex salt, it is preferred that the aromatic residue group (Ar) comprises benzene ring, naphthalene ring, anthracene ring or phenanthrene ring; the optional substituent is alkyl, carboxyl or hydroxyl; L is water; and C1 is hydrogen sodium, potassium, ammonium or alkyl ammonium.

(2)

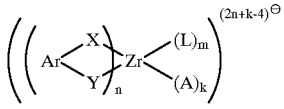

(2n + k-4)Cl$^{\oplus}$ or (n + K/2–2)C2$^{2\oplus}$ wherein Ar denotes an aromatic residue group capable of having a substituent of alkyl, aryl, aralkyl, cycloalkyl, alkenyl, alkoxy, aryloxy, hydroxyl, alkoxycarbonyl, aryloxycarbonyl, acyl, acyloxy, carboxyl, halogen, nitro, cyano, amino, amide, or carbamoyl; X and Y independently denotes O or —CO—O—; L denotes a neutral ligand of water, alcohol, ammonia, alkylamine or pyridine; A denotes an anion of halogen, hydroxyl, carboxylate, carbonate, nitrate, sulfate, cyano or thiocyano, a plurality of A can be identical or different when k≧2; C1 denotes a monovalent cation, such as hydrogen ion, monovalent metal ion, ammonium ion or alkylammonium ion; C2 denotes a divalent cation, such as a metal ion; n is 1, 2, 3 or 4; m is 0, 1, 2, 3 or 4; a k is 1, 2, 3, 4, 5 or 6; a number (when n≧2) of ligands (such as aromatic carboxylic acids and diols) can be identical to or different from each other, and a number (when m≧2) of neutral ligands can be identical to or different from each other in each complex or complex salt of a formula. Further, each complex or complex salt of a formula can also be a mixture of complex compounds having mutually different n or/and m, or a mixture of complex salts having mutually different counter ions C1 or/and C2. In order to improve the dispersibility in binder resin and charge control ability of a complex or complex salt, it is preferred that the aromatic residue group (Ar) comprises benzene ring, naphthalene ring, anthracene ring or phenanthrene ring; the optional substituent is alkyl, carboxyl or hydroxyl; L is water; C1 is hydrogen, sodium, potassium, ammonium or alkylammonium; and A is hydroxyl or carboxylate ion.

Further, preferred sub-classes of zirconium complexes or complex salts may be represented by the following formulae (3)–(8).

(3)

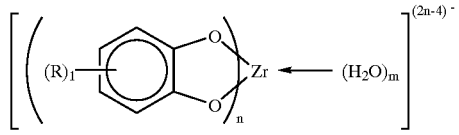

(2n-4)Cl$^{+}$ (4)

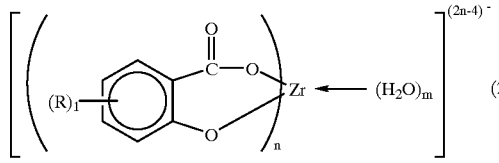

(2n-4)Cl$^{+}$

-continued (5)

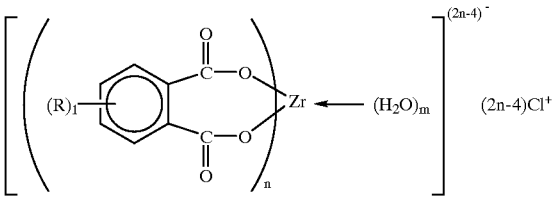

In the above formulae (3), (4) and (5), R denotes a substituent of hydrogen, alkyl, aryl, aralkyl, cycloalkyl, alkenyl, alkoxy, aryloxy, hydroxyl, acyloxy, alkoxycarbonyl, aryloxycarbonyl, acyl, carboxyl, halogen, nitro, amino or carbamoyl, a plurality (when 1≧2) of R can be mutually linked to form an alicyclic, aromatic or heterocyclic ring capable of having 1–8 similar R substituent(s); a plurality of R can be identical or different; C1 denotes a monovalent cation such as hydrogen, alkaline metal, ammonium or alkylammonium; 1 is an integer of 1–8; n is 2, 3 or 4; m is 0, 2 or 4; a number (n) of ligands can be identical or different in each complex or complex salt of a formula. Further, each complex or complex salt of a formula can be a mixture of complex compounds having mutually different n or/and m, or a mixture of complex salts having mutually different counter ions C1. In order to improve the dispersibility in binder resin and charge control ability of the complex or complex salt, it is preferred that the substituent R is alkyl, alkenyl, carboxyl or hydroxyl; C1 is hydrogen, sodium, potassium, ammonium or alkylammonium. It is particularly preferred to use a complex compound of the formula (4) or a neutral complex of the formula (3), (4) or (5) (wherein n=2) with no counter ion, so as to exhibit excellent environmental stability, dispersibility in the binder resin, and continuous image forming performances.

(6)

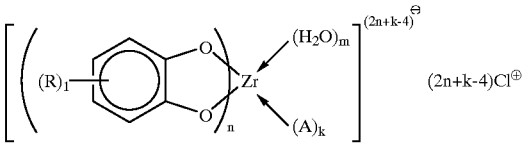

(7)

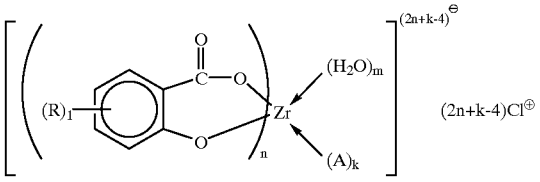

(8)

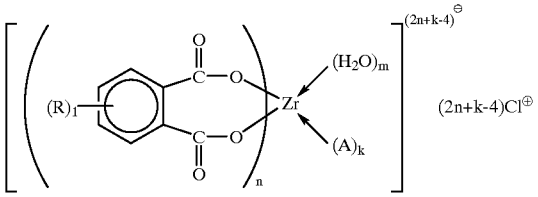

In the above formulae (6), (7) and (8), R denotes a substituent of hydrogen, alkyl, aryl, aralkyl, cycloalkyl, alkenyl, alkoxy, aryloxy, hydroxyl, acyloxy, alkoxycarbonyl, aryloxycarbonyl, acyl, carboxyl, halogen, nitro, amino or carbamoyl, a plurality (when 1≧2) of R can be mutually linked to form an alicyclic, aromatic or heterocyclic ring capable of having 1–8 similar R substituent(s); a plurality of R can be identical or different; A denotes an anion of halogen, hydroxyl, carboxylate, carbonate, nitrate, sulfate, cyano or thiocyano, a plurality of A can be identical or different; C1 denotes a monovalent cation such as hydrogen, alkaline metal, ammonium or alkylammonium; 1 is an integer of 1–8; n is 1, 2, 3 or 4; m is 0, 2 or 4; k is 1, 2, 3, 4, 5 or 6; a number (when n≧2) of ligands can be identical or different in each complex or complex salt of a formula. Further, each complex or complex salt of a formula can be a mixture of complex compounds having mutually different n or/and m, or a mixture of complex salts having mutually different counter ions C1 or/and anions A. In order to improve the dispersibility in binder resin and charge control ability of the complex or complex salt, it is preferred that the substituent R is alkyl, alkenyl, carboxyl or hydroxyl; C1 is hydrogen, sodium, potassium, ammonium or alkylammonium and A is hydroxyl or carboxylate ion. It is particularly preferred to use a complex compound of the formula (7) or a neutral complex of the formula (6), (7) or (8) (wherein n=2) with no counter ion, so as to exhibit excellent environmental stability, dispersibility in the binder resin, and continuous image forming performances.

The zirconium complex or complex salt used in the present invention includes hexa-coordinated and octa-coordinated complex compound, and some octa-coordinated compound may assume a form of plural-nuclei complex compound wherein ligands form a crosslinkage to provide a rational formula giving a coordination number of 6. Further, it is also possible to form a plural-nuclei compound formed by successive linkage with ligands, such as hydroxyl groups.

Some typical example structures of such complex compounds are indicated by the following formulae (9)–(29), wherein some complex compounds having no ligand L are included.

(9)

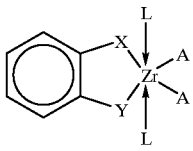

(10)

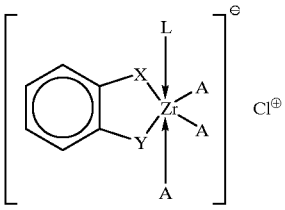

(11)

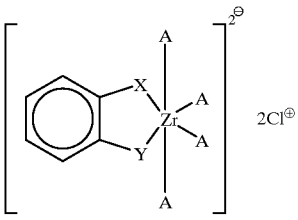

-continued
(12)
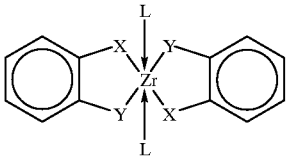
(13)
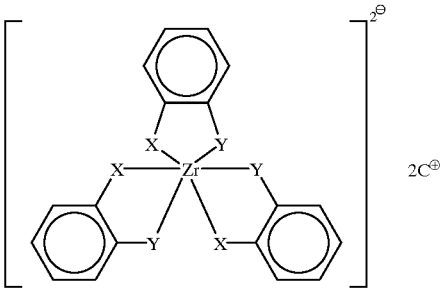
(14)
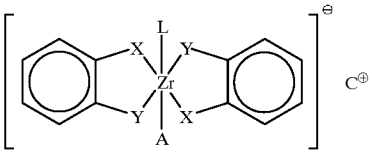
(15)
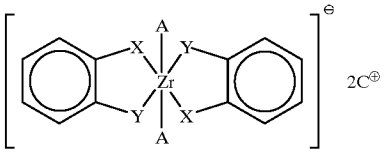
(16)
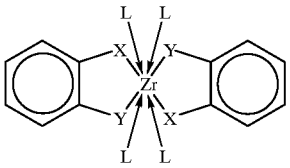
(17)
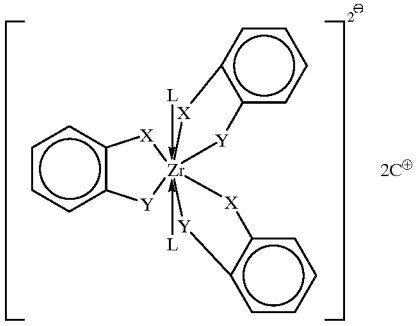
-continued
(18)
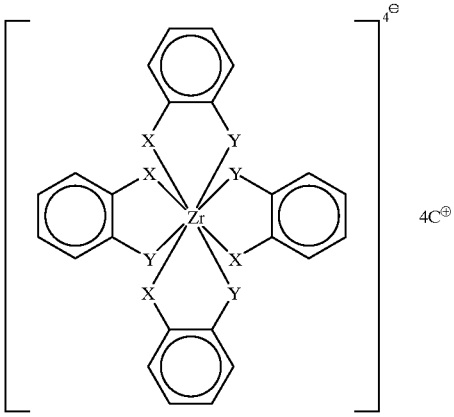
(19)
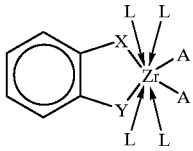
(20)
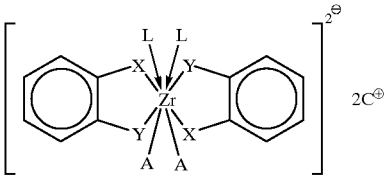
(21)
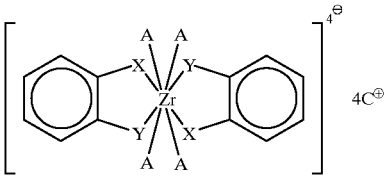
(22)
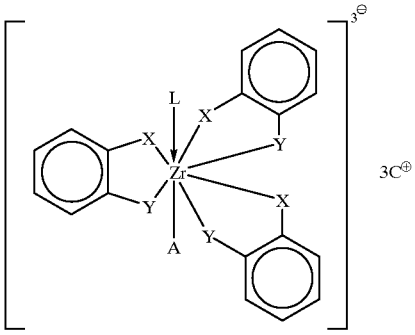

-continued (23)

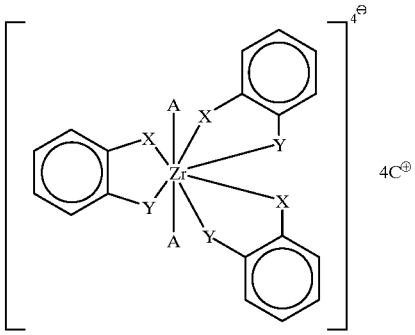

(24)

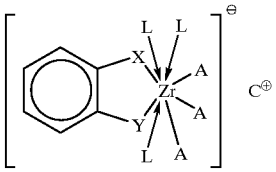

(25)

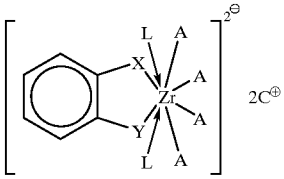

(26)

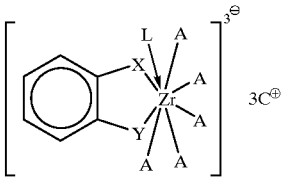

(27)

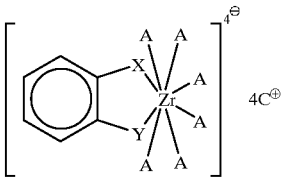

(28)

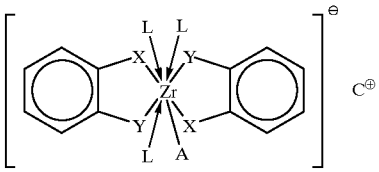

(29)

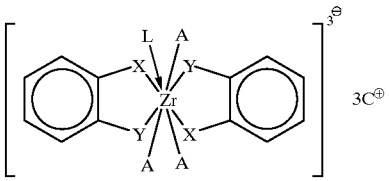

The organic zirconium compound used in the present invention can also assume a form of complex compound wherein a plurality of substituents, e.g., X and Y of hydroxyl and/or carboxyl, attached to an aromatic ring are bonded to different zirconium atoms as represented by a partial structural formula (30) below:

(30)

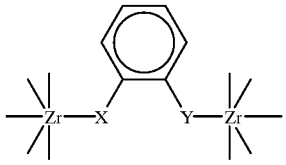

Such complex compounds may more generally be represented by the following formula (31):

(31)

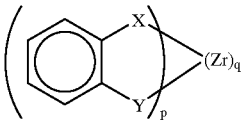

wherein p is an integer of at least 1 and q is an integer of at least 2. From the formula (31), anionic ligands, neutral ligands and counter-cations are omitted from showing.

Preferred classes of aromatic carboxylic acid zirconium salts as a category of the organic zirconium compound used in the present invention may include those represented by the following formulae (32) and (33):

$$(Ar—COO^-)_n Zr^{4\oplus}(4-n)A_1\ominus \text{ or } (2-n/2)A_2 2\ominus \quad (32)$$

$$(Ar—COO^-)_n Zr^{4\oplus}(0)(2-n)A_1\ominus \quad (33)$$

In the above formulae (32) and (33), Ar denotes an aromatic residue group capable of having a substituent of alkyl, aryl, aralkyl, cycloalkyl, alkenyl, alkoxy; aryloxy, hydroxyl, acyloxy, alkoxycarbonyl, aryloxycarbonyl, acyl, carboxyl, halogen, nitro, cyano, amino, amido or carbamoyl; $A_1$ denotes a monovalent anion such as halogen, hydroxyl, nitrate or carboxylate; $A_2$ denotes a divalent anion, such as sulfate, hydrogenphosphate or carbonate; and n is 1, 2, 3 or 4. In case of $n \geqq 2$ for each metal salt, a plurality (n) of acid ions, i.e., aromatic carboxylates and aromatic hydroxycarboxylates may be identical or different. Further, each metal salt of a formula can be a mixture of different salts having different numbers of n. In order to improve the dispersibility in binder resin and chargeability of the zirconium salt, it is preferred that the aromatic residue group (Ar) comprises benzene ring, naphthalene ring, anthracene ring, or phenanthrene ring; the optional substituent is alkyl, carboxyl, hydroxyl or acyloxy.

Further, preferred sub-classes of the zirconium salt may be represented by the following formulae (34) and (35):

(34)

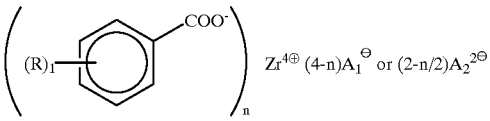

-continued (35)

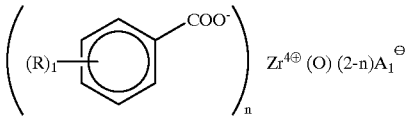

In the above formulae (34)) and (35), R denotes a substituent of hydrogen, alkyl, aryl, aralkyl, cycloalkyl, alkenyl, alkoxy; aryloxy, hydroxyl, acyloxy, alkoxycarbonyl, aryloxycarbonyl, acyl, carboxyl, halogen, nitro, amino or carbamoyl; 1 is an integer of 1 to 8; $A_1$ denotes a monovalent anion such as halogen, hydroxyl, nitrate or carboxylate; $A_2$ denotes a divalent anion, such as sulfate, hydrogenphosphate or carbonate; and n is 1, 2, 3 or 4. In case of n≧2 for each metal salt, a plurality (n) of acid ions, i.e., aromatic carboxylates and aromatic hydroxycarboxylates may be identical or different. Further, each metal salt of a formula can be a mixture of different salts having different numbers of n. In order to improve the dispersibility in binder resin and chargeability of the zirconium salt, it is preferred that the aromatic residue group (Ar) comprises benzene ring, naphthalene ring, anthracene ring, or phenanthrene ring; the optional substituent is alkyl, carboxyl, hydroxyl or acyloxy.

Further, preferred sub-classes of the zirconium salt may be represented by the following formulae (36) and (37):

(36)

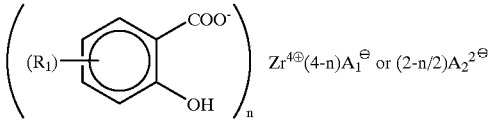

(37)

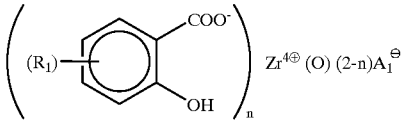

In the above formulae (36) and (37), R denotes a substituent of hydrogen, alkyl, aryl, aralkyl, cycloalkyl, alkenyl, alkoxy; aryloxy, hydroxyl, acyloxy, alkoxycarbonyl, aryloxycarbonyl, acyl, carboxyl, halogen, nitro, amino, or carbamoyl; 1 is an integer of 1 to 7; $A_1$ denotes a monovalent anion such as halogen, hydroxyl, nitrate or carboxylate; $A_2$ denotes a divalent anion, such as sulfate, hydrogenphosphate or carbonate; and n is 1, 2, 3 or 4. In case of n≧2 for each metal salt, a plurality (n) of acid ions, i.e., aromatic carboxylates and aromatic hydroxycarboxylates may be identical or different. Further, each metal salt of a formula can be a mixture of different salts having different numbers of n. In order to improve the dispersibility in binder resin and chargeability of the zirconium salt, it is preferred that the aromatic residue group (Ar) comprises benzene ring, naphthalene ring, anthracene ring, or phenanthrene ring; the optional substituent is alkyl, carboxyl, hydroxyl or acyloxy.

The organic zirconium compound used in the present invention may be synthesized by dissolving a zirconium compound, such as zirconium chloride oxide, zirconium sulfate or an organic acid salt of zirconium in a solvent, such as water, alcohol or aqueous alcohol solution, and adding thereto (1) an aromatic carboxylic acid, an aromatic diol or an alkaline metal salt of these or (2) an aromatic carboxylic acid or an aromatic diol and an alkaline agent. The product organic zirconium compound may be purified by recrystallization from, e.g., an aqueous alcohol solution and washing with alcohol. Further, in the case of producing a complex salt, the above-prepared product may be treated with a mineral acid, an alkaline agent, an amine agent, etc., to prepare complex salts having various counter-ions. Thus, it is also possible to obtain an organic zirconium compound usable in the present invention which is a mixture of complex salts having a plurality of counter-ions selected from, e.g., hydrogen ion, alkaline metal ions and ammonium ion.

Hereinbelow, specific examples of the organic zirconium compound used in the present invention are enumerated with their rational formulae. Such organic zirconium compounds can include 2–4 water molecules as ligands but such water molecules are omitted from showing from the following examples. Further, such organic zirconium compound may include plural species of counter-ions but only a major counter-ion (largest in amount) is indicated in the following examples. In the following formulae, tBu— denotes a tertiary butyl group ($CH_3$—$C(CH_3)_2$—), Bu— denotes a normal-butyl group (n—$C_4H_9$—), MeO—denotes a methoxide group ($CH_3O$—), Me— denotes a methyl group ($CH_3$—), and iPr— denotes an iso-propyl group ($(CH_3)_2CH$—).

(38)

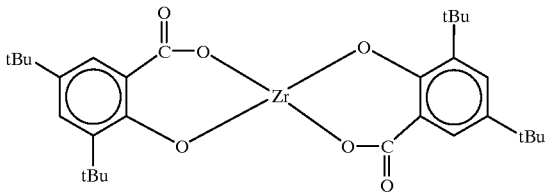

(39)

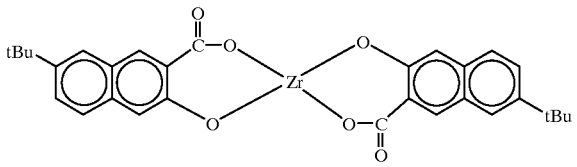

(40)

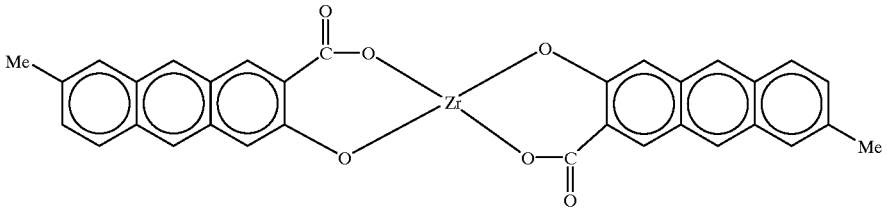

-continued
(41)
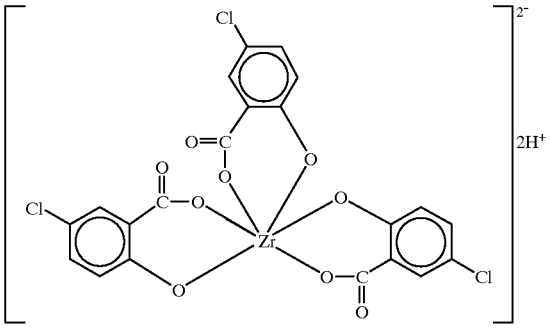
(42)
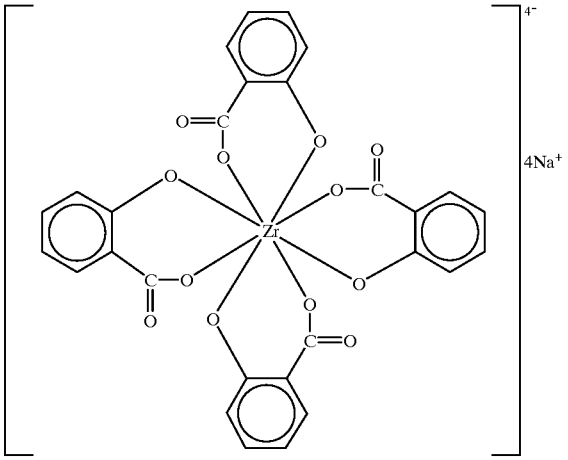
(43)
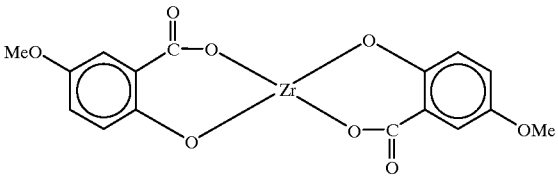
(44)
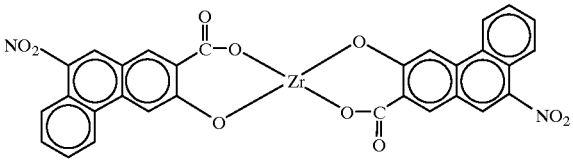
(45)
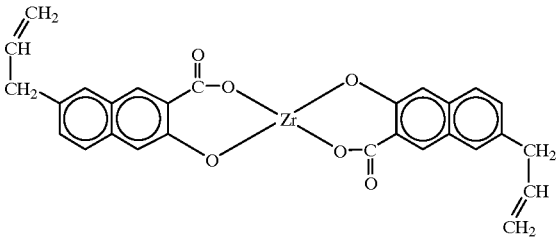
(46)
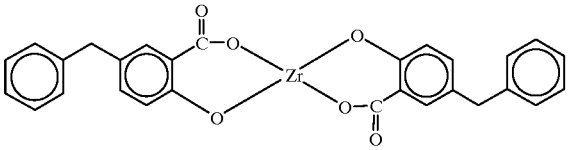
(47)
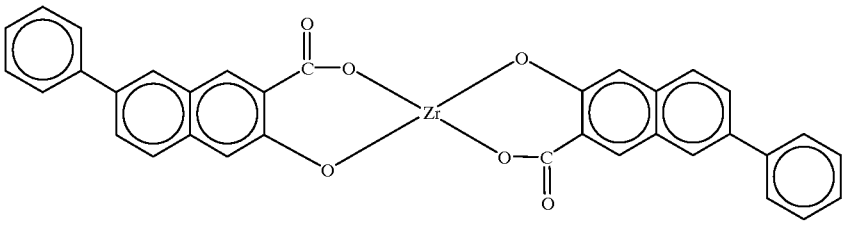
(48)
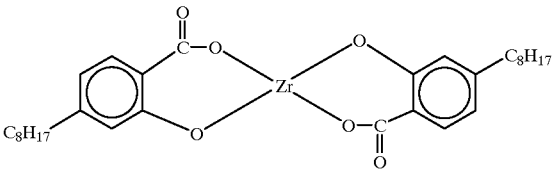
(49)
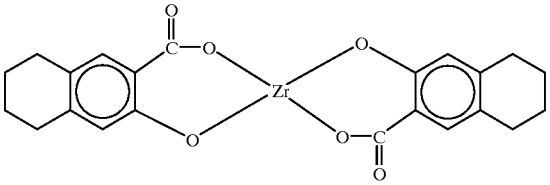

-continued
(50)
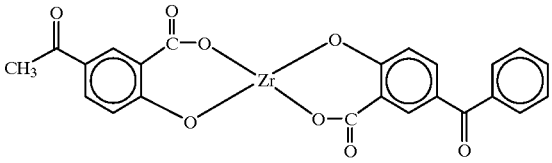
(51)
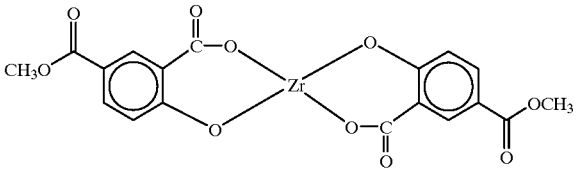
(52)
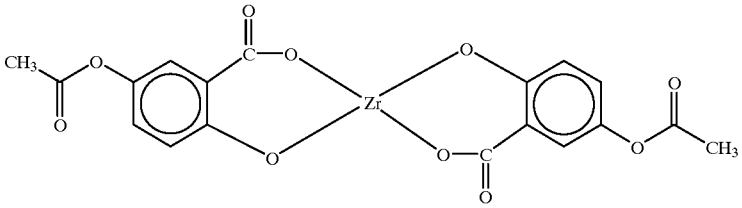
(53)
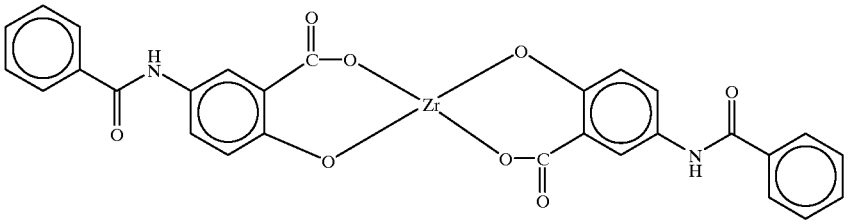
(54)
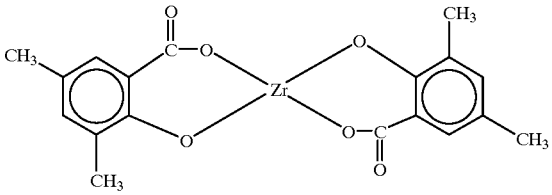
(55)
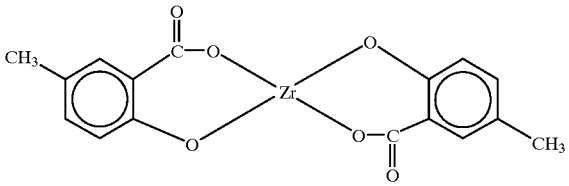
(56)
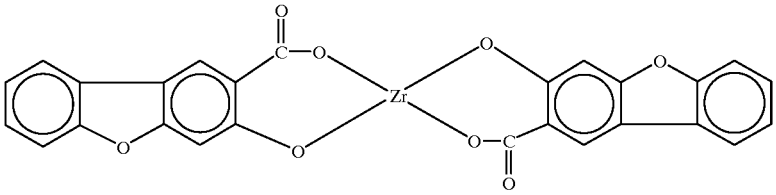
(57)
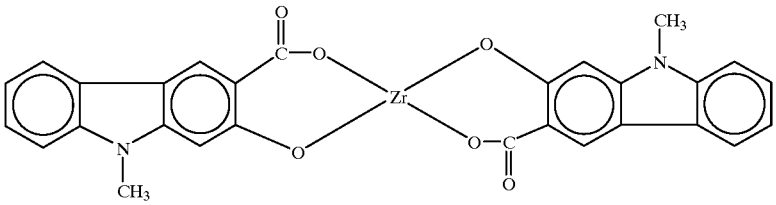
(58)
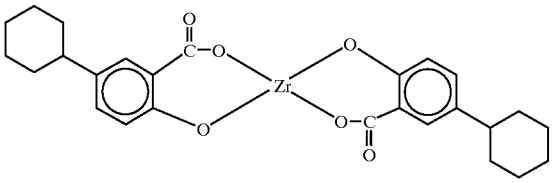
(59)
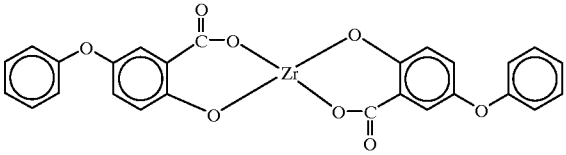

-continued
(60)
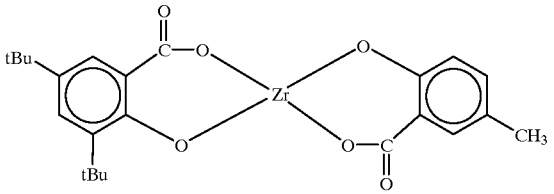
(61)
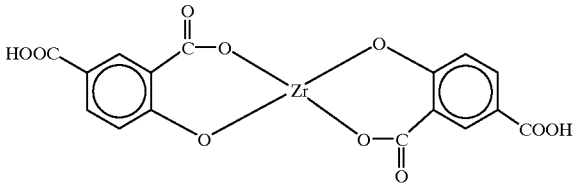
(62)
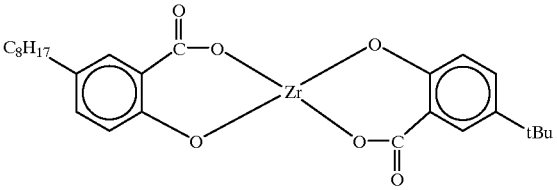
(63)
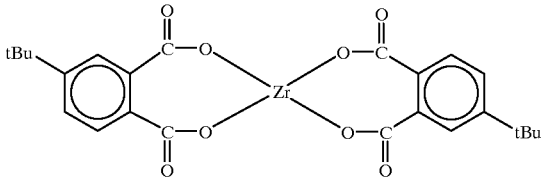
(64)
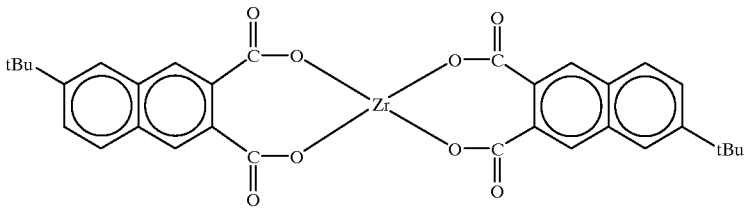
(65)
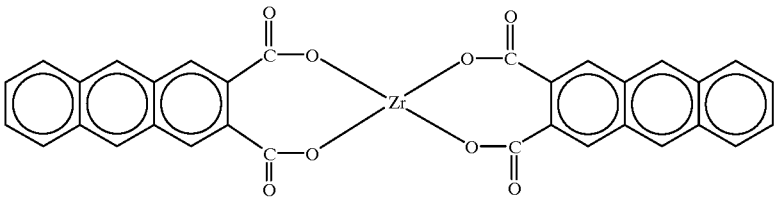
(66)
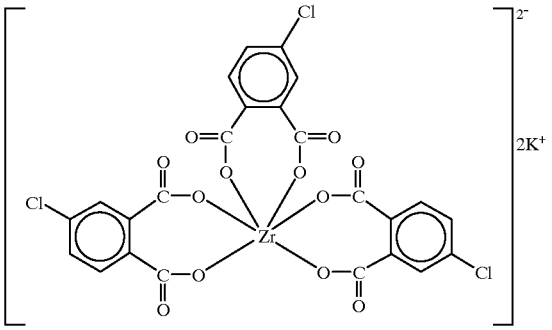
(67)
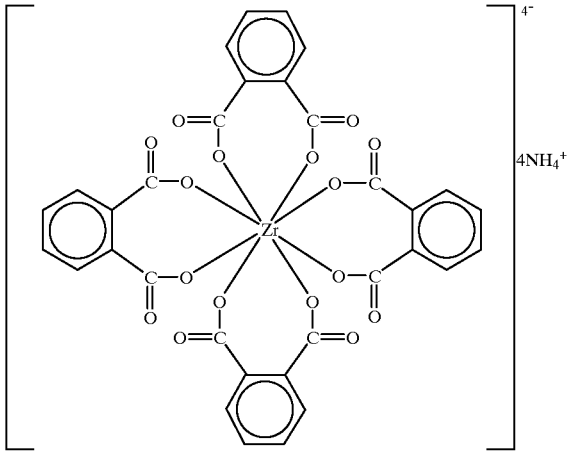
(68)
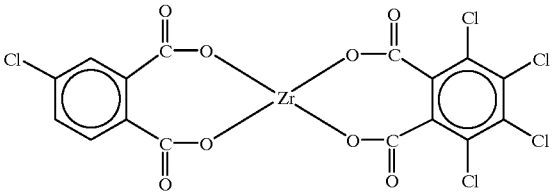

-continued
(69)
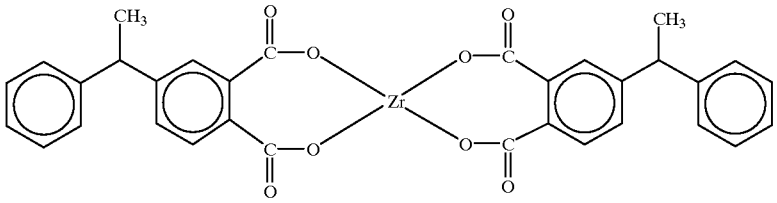
(70)
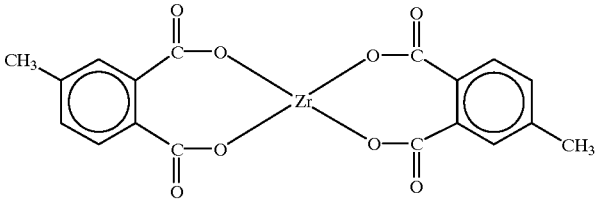
(71)
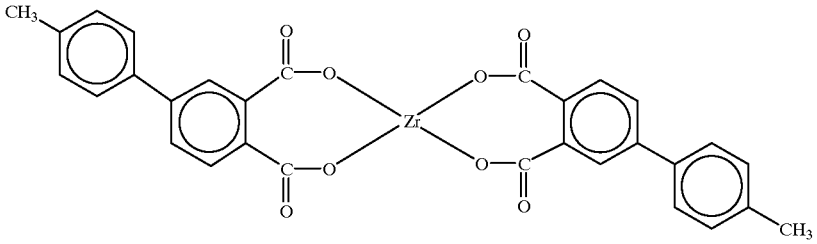
(72)
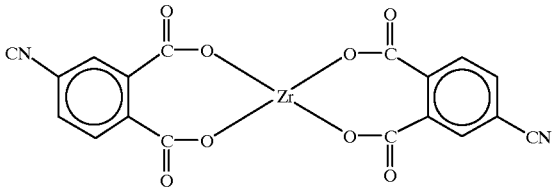
(73)
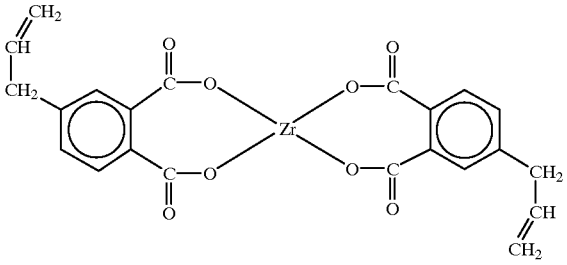
(74)
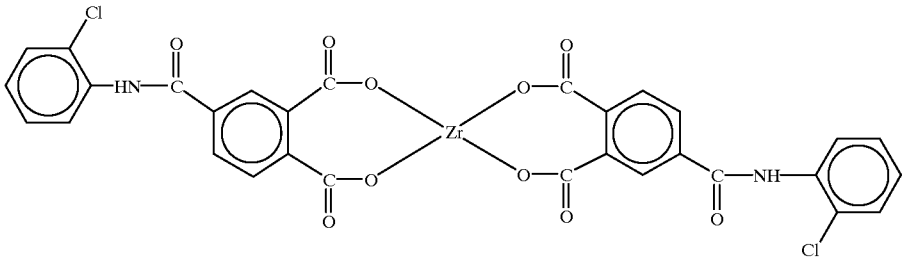
(75)
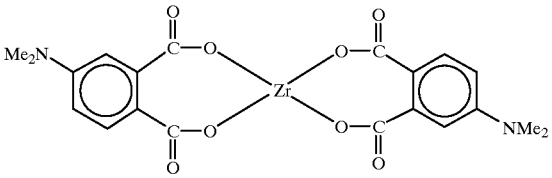
(76)
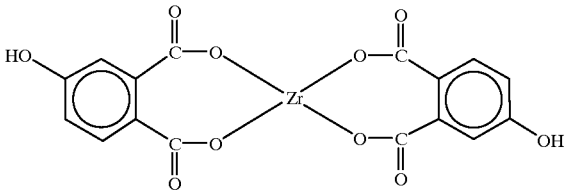

-continued
(77)
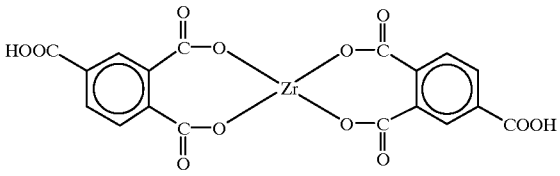
(78)
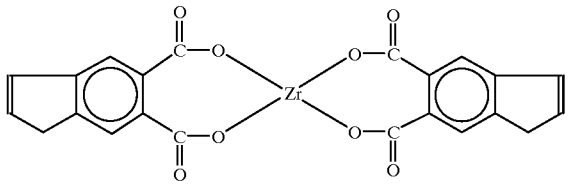
(79)
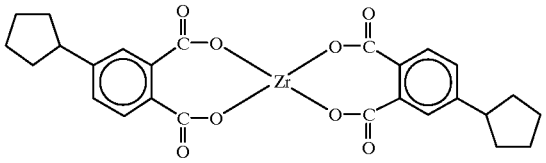
(80)
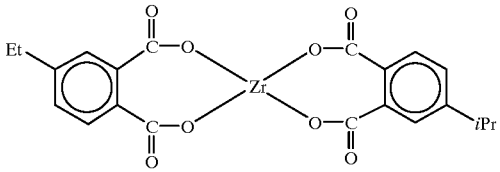
(81)
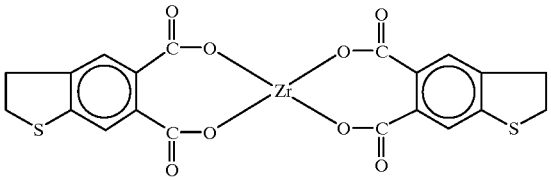
(82)
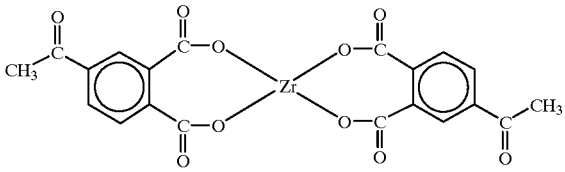
(83)
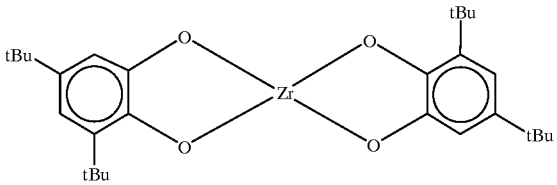
(84)
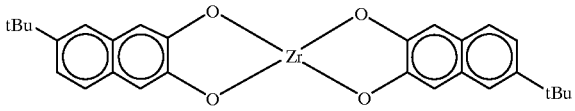
(85)
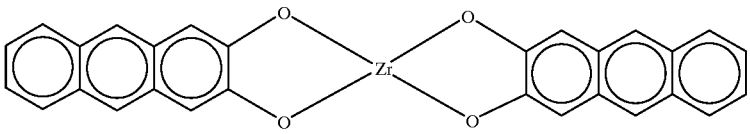
(86)
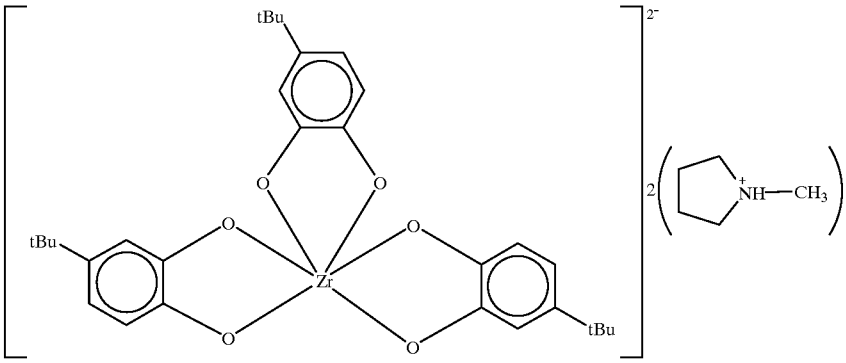

-continued
(87)
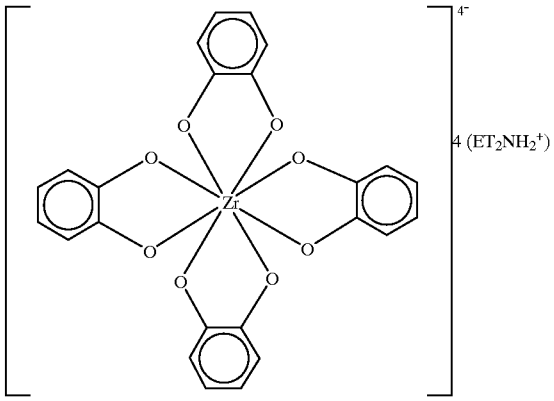
(88)
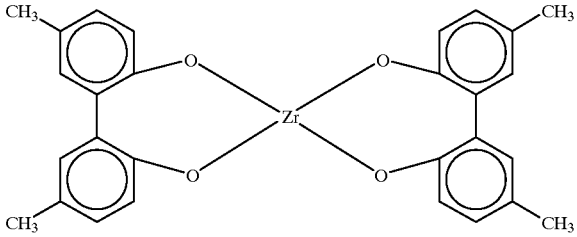
(89)
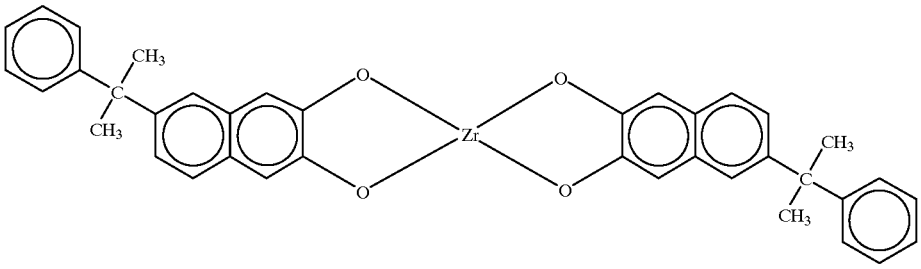
(90)
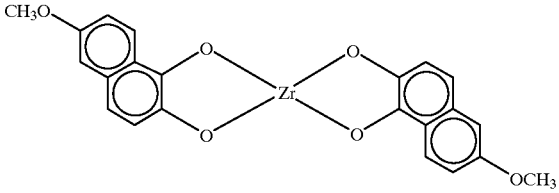
(91)
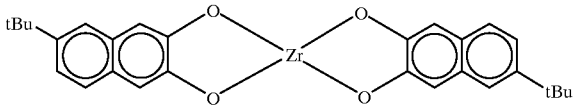
(92)
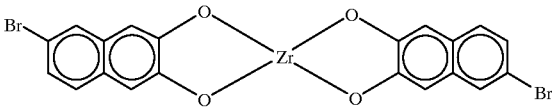
(93)
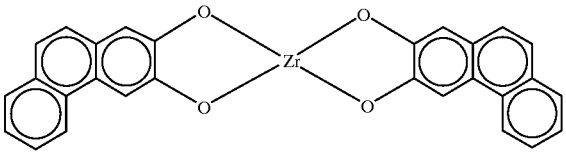
(94)
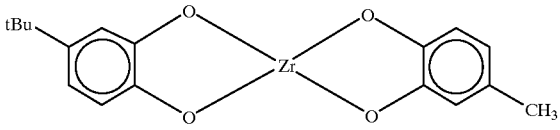
(95)
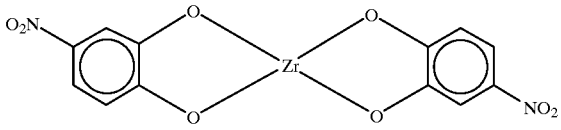
(96)
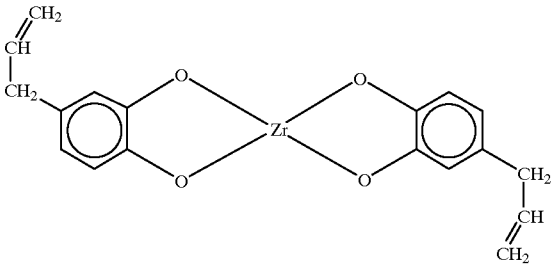
(97)
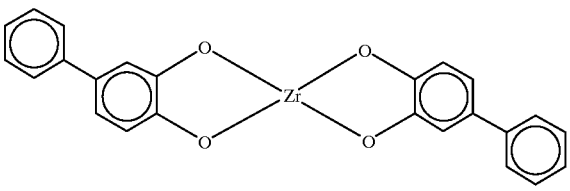

-continued
(98)
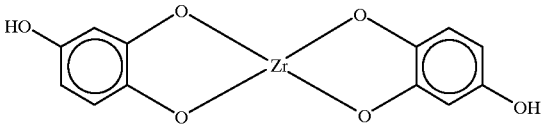
(99)
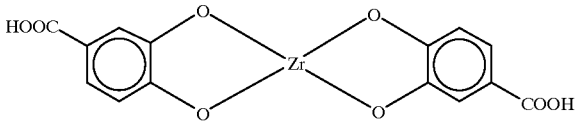
(100)
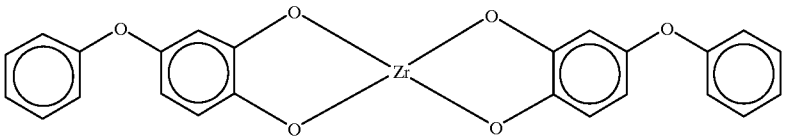
(101)
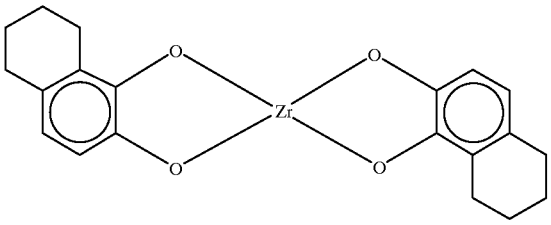
(102)
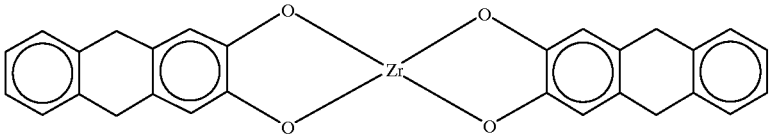
(103)
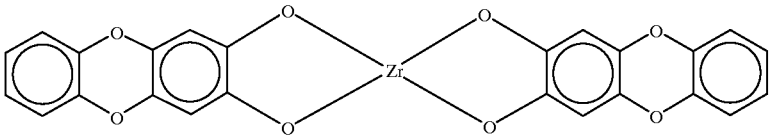
(104)
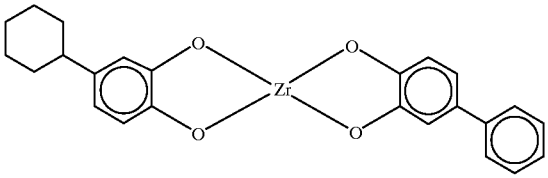
(105)
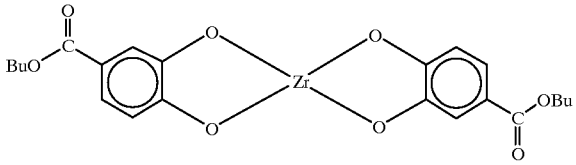
(106)
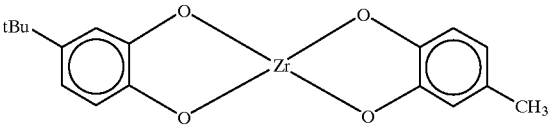
(107)
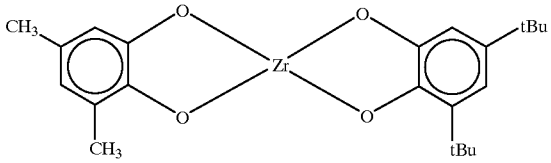
(108)
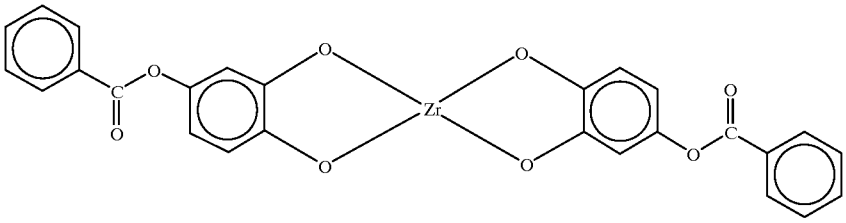

-continued
(109)
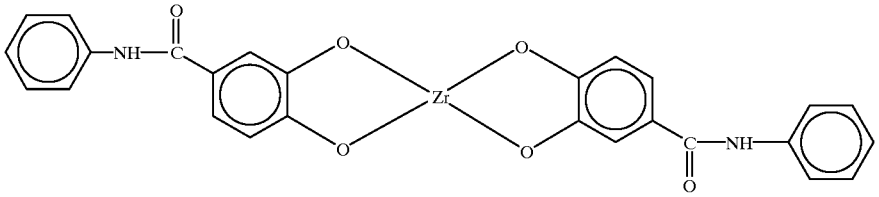
(110)
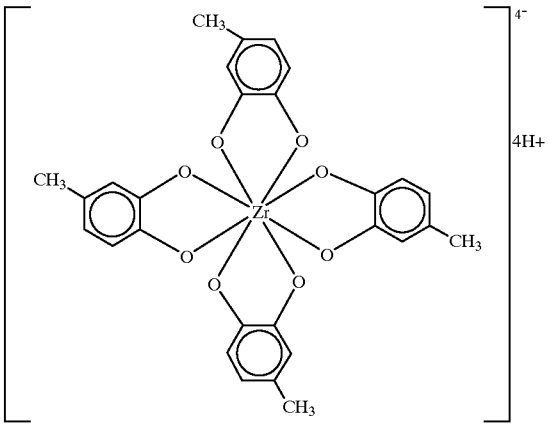
(111)
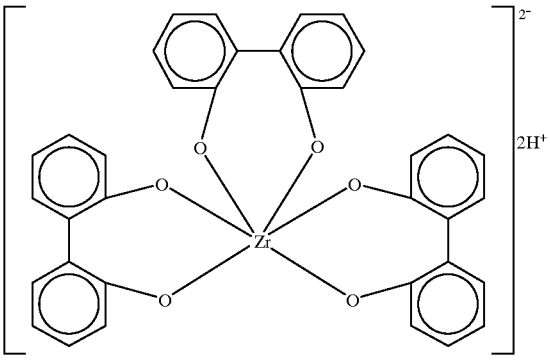
(112)
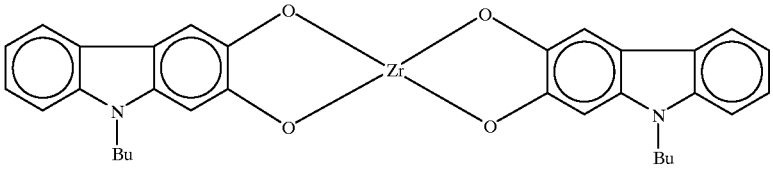
(113)
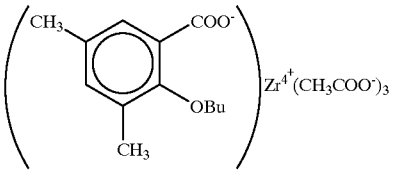
(114)
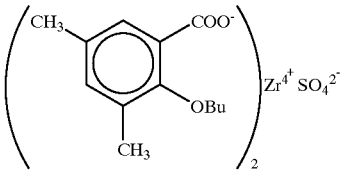
(115)
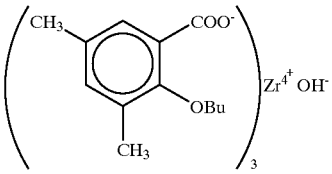
(116)
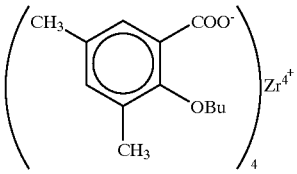
(117)
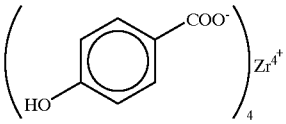
(118)
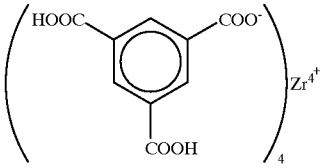
(119)
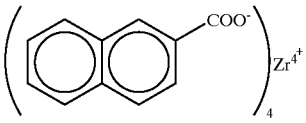
(120)
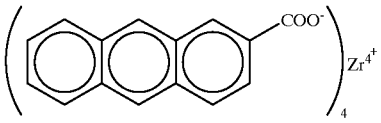

-continued
(121)
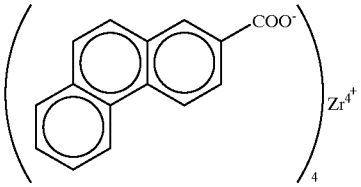
(122)
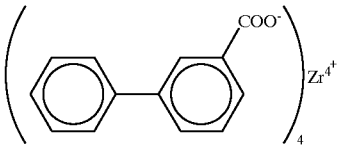
(123)
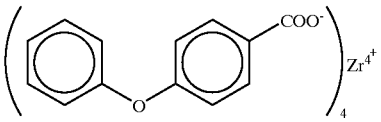
(124)
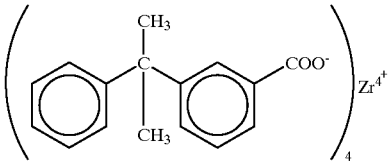
(125)
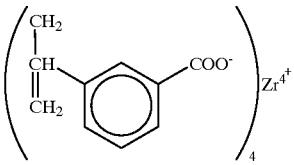
(126)
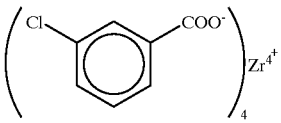
(127)
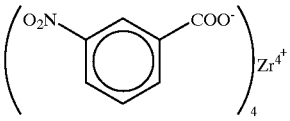
(128)
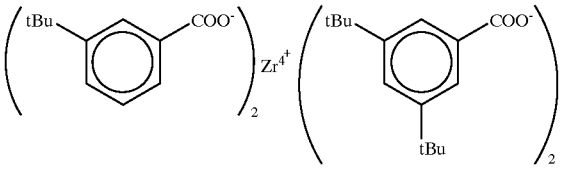
(129)
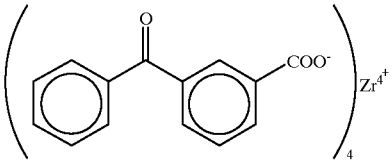
(130)
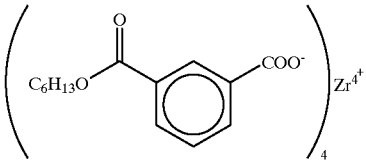
(131)
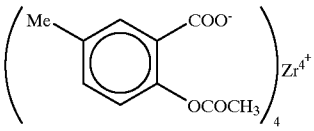
(132)
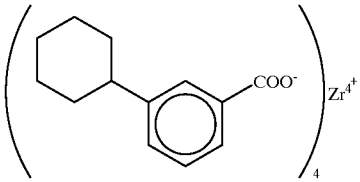
(133)
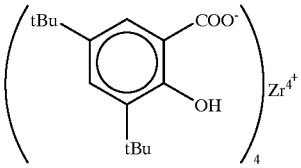
(134)
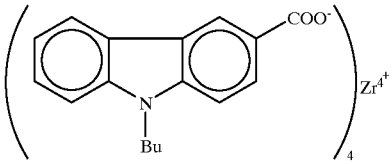
(135)
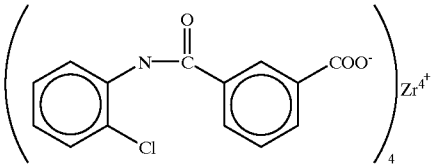
(136)
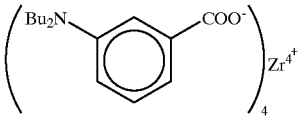

-continued
(137)
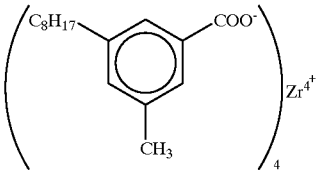
(138)
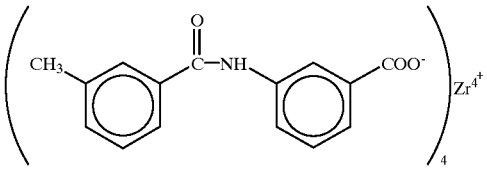
(139)
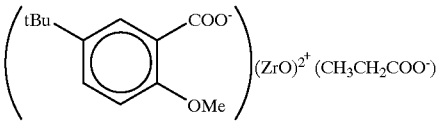
(140)
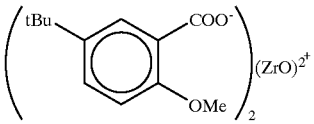
(141)
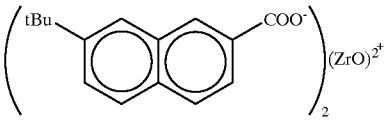
(142)
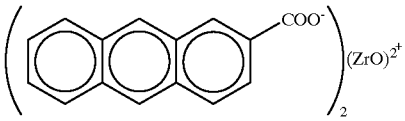
(143)
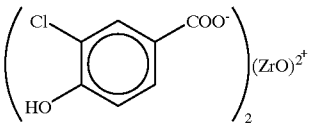
(144)
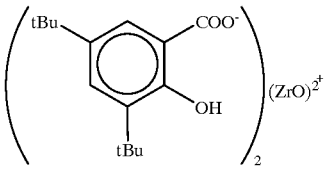
(145)
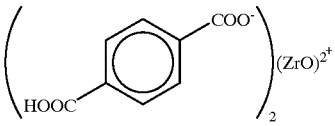
(146)
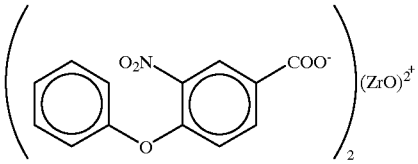
(147)
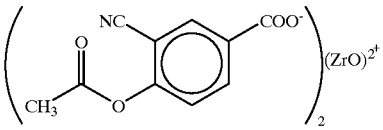
(148)
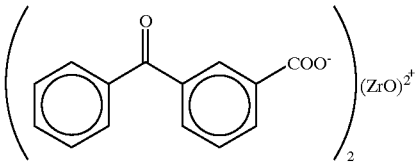
(149)
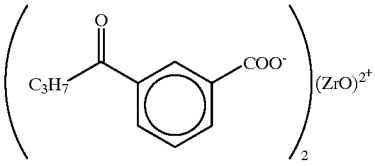
(150)
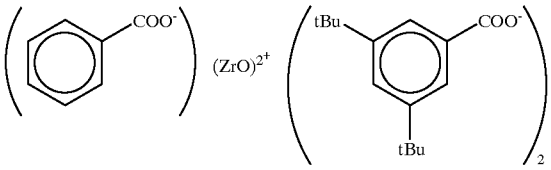
(151)
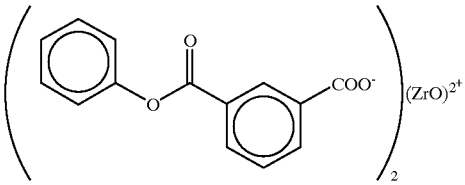
(152)
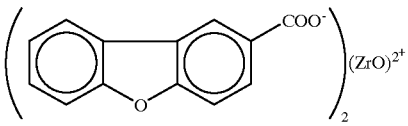

-continued
(153)
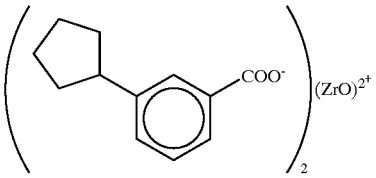
(154)
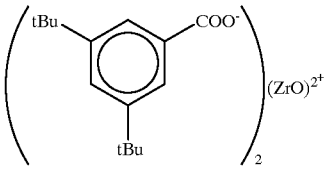
(155)
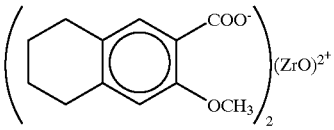
(156)
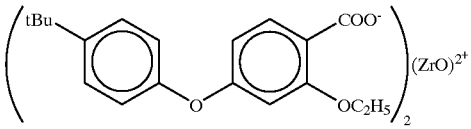
(157)
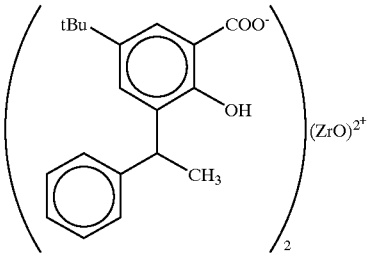
(158)
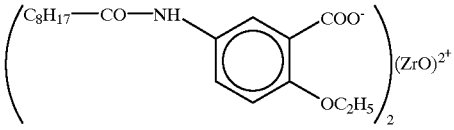
(159)
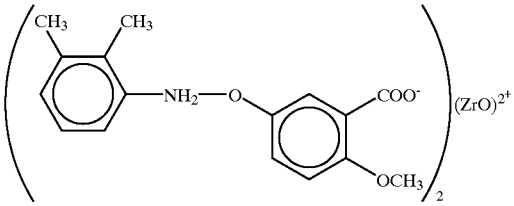
(160)
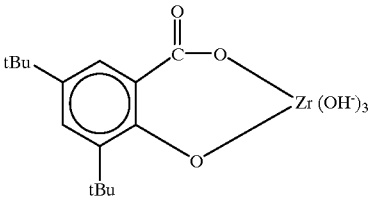
(161)
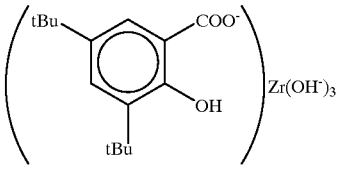
(162)
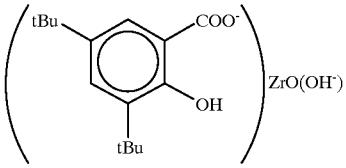
(163)
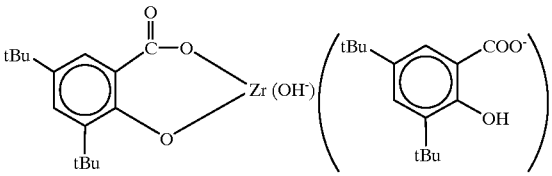
(164)
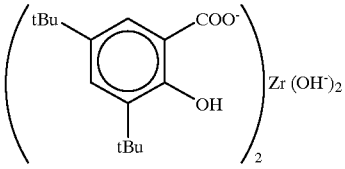
(166)
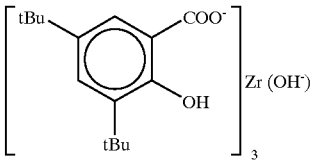
(167)
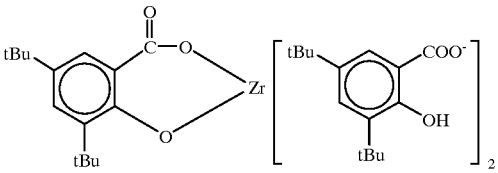

-continued (168)

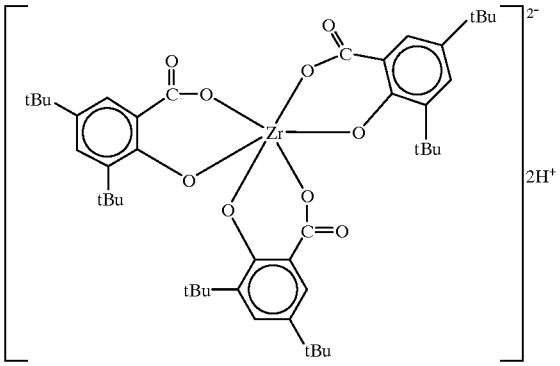

(169)

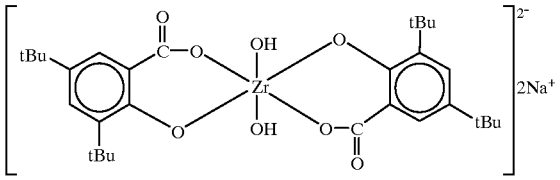

(170)

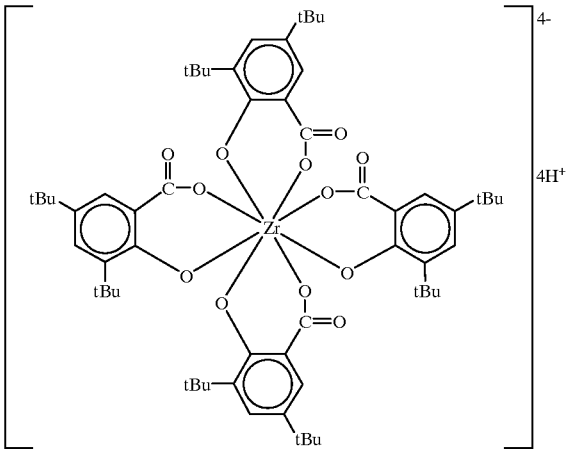

(171)

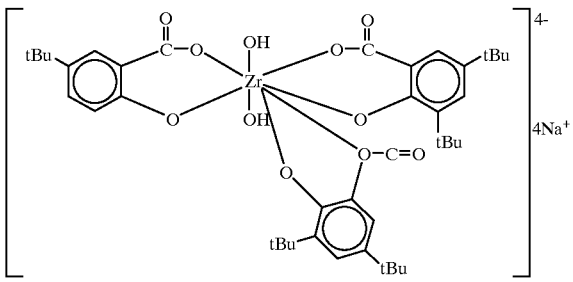

The organic zirconium compound used in the present invention may be incorporated in the toner by adding the organic zirconium compound internally into toner particles (i.e., as a component of toner particles) or externally to toner particles (i.e., as a powder blend with the toner particles). In the case of internal addition, the organic zirconium compound may preferably be added in 0.1–10 wt. parts, more preferably 0.5–5 wt. parts, per 100 wt. parts of the binder resin. In the case of external addition, the organic zirconium compound may preferably be added in 0.01–5 wt. pats per 100 wt. parts of the binder resin and it is particularly preferred that the organic zirconium compound is mechanochemically attached to the surface of toner particles.

The organic zirconium compound can also be used in combination with a conventional charge control agent as described in the part of the related art herein, such as another organic metal complex, metal salt or chelate compound. Specific examples of such a known charge control agent may include: mono-azo metal complexes, acetylacetone metal complexes, hydroxycarboxy acid metal complexes, polycarboxylic acid metal complexes, and polyol metal complexes. Other examples may include: carboxylic acid derivatives, such as carboxylic acid metal salts, carboxylic acid anhydrides.

Examples of the binder resin for constituting the toner according to the present invention may include: styrene resin, styrene copolymer resin, polyester resin, polyol resin, polyvinyl chloride resin, phenolic resin, natural resin-modified phenolic resin, natural resin-modified maleic acid resin, acrylic resin, methacrylic resin, polyvinyl acetate, silicone resin, polyurethane resin, polyamide resin, furan resins, epoxy resin, xylene resin, polyvinyl butyral, terpene resin, coumarone-indene resin, and petroleum resin.

Examples of comonomers for providing styrene copolymers together with styrene monomer may include: vinyl monomers, inclusive of styrene derivatives, such as vinyltoluene; acrylic acid; acrylate esters, such as methyl acrylate, ethyl acrylate, butyl acrylate, dodecyl acrylate, octyl acrylate, 2-ethylhexyl acrylate, and phenyl acrylate; methacrylic acid; methacrylate esters, such as methyl methacrylate, ethyl methacrylate, butyl methacrylate, and octyl methacrylate; dicarboxylic acids having a double bond and derivatives thereof, such as maleic acid, butyl maleate, methyl maleate and dimethyl maleate; acrylonitrile, methacrylonitrile, butadiene, and acrylamide; vinyl chloride; vinyl esters, such as vinyl acetate, and vinyl benzoate; ethylenic olefins, such as ethylene, propylene and butylene; vinyl ketones, such as vinyl methyl ketone and vinyl hexyl ketone; and vinyl ethers, such as vinyl methyl ether, vinyl ethyl ether, and vinyl isobutyl ether. These vinyl monomers may be used alone or in mixture of two or more species in combination with the styrene monomer.

A binder resin principally comprising a styrene-acryl copolymer (i.e., a copolymer of styrene with an acrylic monomer, such as (meth)acrylate or (meth)acrylic acid) may preferably be one including a THF (tetrahydrofuran)-soluble content providing a molecular weight distribution by GPC (gel permeation chromatography) showing at least one peak in a molecular weight region of $3\times10^3$–$5\times10^4$ and at least one peak in a molecular weight region of at least $10^5$ and containing 50–90 wt. % of a component having a molecular weight of at most $10^5$. It is further preferred to have a main peak in a molecular weight region of $5\times10^3$–$3\times10^4$, most preferably $5\times10^3$–$2\times10^4$. It is also preferred to have a sub-peak in a molecular weight region of $10^5$–$10^8$, more preferably $10^5$–$10^7$.

A binder resin principally comprising a polyester resin may preferably have such a molecular weight distribution that a GPC curve of its THF-soluble content shows at least one peak in a molecular weight region of $3\times10^3$–$5\times10^4$ and contains 60–100 wt. % of a component having a molecular weight of at most $10^5$. It is further preferred to have at least one peak within a molecular weight region of $5\times10^3$–$2\times10^4$.

By using a binder resin having a preferred molecular weight distribution represented by specific peaks are described above, it becomes possible to provide a toner with a good balance among fixability, anti-offset characteristic and storage stability.

The toner according to the present invention containing the above-mentioned organic zirconium compound exhibits a chargeability with little change over a wide range of environments including a high-humidity to low-humidity environment, thus exhibiting stable developing performance. Further, in the case of using a binder resin having an acid value, the organic zirconium compound can be well dispersed therein and is therefore less liable to be fall off the toner particles, thus exhibiting a stable performance in continuous image formation.

Furthermore, when a binder resin having a functional group of carboxyl or/and hydroxyl, the binder resin can be crosslinked via a coordination linkage of the carboxyl or/and hydroxyl to the zirconium atom, thereby exhibiting rubber elasticity. As a result, the resultant toner can be provided with excellent releasability, anti-offset characteristic, prevention of soiling from the fixing member and prevention of plugging with a transfer material (jamming) due to separation failure at the fixing unit. Further, the toner particles are reinforced and provided with a stability of developing performance in continuous image formation. Moreover, through prevention of the toner breakage at the cleaning section, the cleaning performance can be stabilized. Further, the flowability can be improved and the change thereof can be reduced, thus contributing to improvements in stability of developing and cleaning performances. Further, the fixed image can be suppressed in gloss and density change. As the fixed image is toughened, it becomes possible to improve the fixing stability and reduce the soiling of the respective members even in the case of both-side copying, superposed copying or using a document feeder, thus reducing the soiling of resultant images.

In the present invention, it is preferred that the crosslinkage leading to the above-mentioned effects is caused to an extent providing a recognizable THF-insoluble content. More specifically, it is preferred that the toner is caused to have a THF-insoluble content of 1–70 wt. %, more preferably 5–60 wt. %, based on the binder resin. In excess of 70 wt. %, the fixability is liable to be lowered.

The crosslinking structure of zirconium with carboxyl or/and hydroxyl group is rich in flexibility in spite of toughness because of a larger size of zirconium atom and readiness of forming a bond or linkage with oxygen atom compared with crosslinkages formed with other metal atoms, such as aluminum, chromium, iron or zinc. As a result, the fixability of the resultant toner is less liable to be lowered regardless of improvement in releasability and toughness. Thus, the addition effect of the organic zirconium compound becomes larger at comparable levels of crosslinkage or THF-insoluble content. In other words, the crosslinkage with zirconium is effective even at a small content and exerts less adverse effects at a large content compared with other metals.

It has become clear that the toner according to the present invention can exhibit excellent triboelectric chargeability in a triboelectrification process relying on the friction with a developer-carrying member. More specifically, a toner containing the organic zirconium compound and a binder resin having an acid value in combination has been found to acquire a large triboelectric charge even at a low degree of contact with the developer-carrying member surface.

The binder resin used in the present invention may preferably have an acid value of 1–100 mgKOH/g, more preferably 1–70 mgKOH/g, further preferably 1–50 mgKOH/g, particularly preferably 2–40 mgKOH/g. In case where the acid value is below 1 mgKOH/g, the synergistic effect in combination with the organic zirconium compound leading to improvements in developing stability and stability in continuous image formation is liable to be insufficient and the crosslinkage effect is less exhibited. On the other hand, in excess of 100 mgKOH/g, the binder resin is liable to be excessively hygroscopic, to result in a toner giving a low image density and increased fog.

Some properties and/or parameters described herein for characterizing the inventions are based on measurement methods described belows.

<Acid Value>

The acid value of a binder resin in a toner composition is measured basically according to JIS K-0070 in the following manner.

As a preparatory step, from a toner sample, the other components are removed to recover a binder resin (polymer component) as a sample to be used for measurement. Alternatively, the acid value and content of components other the polymer components (binder resin and crosslinked binder resin) are determined in advance. (For example, in the case where a toner sample is directly subjected to measurement, the contributions of the other components, such as a colorant or a magnetic material are determined based on their acid values and contents and subtracted from the measured value of the sample toner to calculate an acid value of the binder resin.) The measurement is performed as follows.

1) Ca. 0.1–0.2 g of a sample is accurately weighed to record its weight at W (g).
2) The sample is placed in a 300 ml-beaker and 150 cc of a toluene/ethanol (4/1) mixture solution is added thereto to dissolve the sample.
3) The solution in the beaker is titrated with a 0.1 mol/liter-KOH alcohol solution by using a potentiometric titrator (e.g., automatically titrated by using a potentiometric titrator and an electrically driven burette (e.g., "AT-400" (equipped with Win workstation) and "ABP-410", respectively, available from Kyoto Denshi K.K.).
4) The amount of the KOH solution used for the titration is denoted by S (ml). A blank test is performed in parallel to determine the amount of the KOH solution for the blank titration at B (ml).
5) The acid value of the sample is calculated by the following formula:

$$\text{Acid value}=(S-B)\times f\times 5.61/W,$$

wherein f denotes a factor of the KOH solution.

<Molecular Weight Distribution>

The molecular weight distribution of a binder resin as a toner material or a binder resin in a toner composition is measured according to GPC (gel permeation chromatography) using THF (tetrahydrofuran) as a solvent in the following manner.

In the GPC apparatus, a column is stabilized in a heat chamber at 40° C., tetrahydrofuran (THF) solvent is caused to flow through the column at that temperature at a rate of 1 ml/min., and about 100 $\mu$l of a GPC sample solution is injected. The identification of sample molecular weight and its molecular weight distribution is performed based on a calibration curve obtained by using several monodisperse polystyrene samples and having a logarithmic scale of molecular weight versus count number. The standard polystyrene samples for preparation of a calibration curve may be those having molecular weights in the range of about $10^2$ to $10^7$ available from, e.g., Toso K.K. or Showa Denko K.K. It is appropriate to use at least 10 standard polystyrene samples. The detector may be an RI (refractive index) detector. For accurate measurement, it is appropriate to constitute the column as a combination of several commercially available polystyrene gel columns. A preferred example thereof may be a combination of Shodex KF-801, 802, 803, 804, 805, 806, 807 and 800P; or a combination of TSK gel G1000H ($H_{XL}$), G2000H ($H_{XL}$), G3000H ($H_{XL}$), G4000H ($H_{XL}$), G5000H ($H_{XL}$), G6000H ($H_{XL}$), G7000H ($H_{XL}$) and TSK guardcolumn available from Toso K.K.

The GPC sample may be prepared as follows.

A resinous sample is placed in THF and left standing for several hours (e.g., 5–6 hours). Then, the mixture is sufficiently shaken until a lump of the resinous sample disappears and then further left standing for more than 12 hours (e.g., 24 hours) at room temperature. In this instance, a total time of from the mixing of the sample with THF to the completion of the standing in THF is taken for at least 24 hours (e.g., 24–30 hours). Thereafter, the mixture is caused to pass through a sample treating filter having a pore size of 0.2–0.5 $\mu$m (e.g., "Maishoridisk H-25-5", available from Toso K.K.) to recover the filtrate as a GPC sample. The sample concentration is adjusted to provide a resin concentration within the range of 0.5–5 mg/ml.

<THF-insoluble Content>

The THF-insoluble content of a binder resin as a toner material or a binder resin in a toner composition is measured in the following manner.

Ca. 0.5–1.0 g of a sample is weighed (at $W_1$ g), placed in a cylindrical filter (e.g., "No. 86R", available from Toyo Roshi K.K.) and then subjected to extraction with 200 ml of solvent THF in a Soxhlet's extractor for 10 hours. The solvent is evaporated from the extract solution to leave a THF-soluble resin content, which is dried under vacuum at 100° C. for several hours and then weighed (at $W_2$ g). The weight of components, such as a magnetic material or a pigment, other than the resinous component is determined (at $W_3$ g). THF-insoluble content ($THF_{ins.}$) is calculated as follows:

$$THF_{ins.}(\text{wt. }\%)=[W_1-(W_2-W_3)]/(W_1-W_3)\times 100.$$

Alternately, THF-insoluble content ($THF_{ins.}$) may also be determined based on the extraction residue (weighted at $W_4$ g) as follows:

$$THF_{ins.}=(W_4-W_3)/(W_1-W_3)\times 100.$$

For adjusting the acid value of the binder resin, it is appropriate to use a carboxyl group-containing monomer, examples of which may include: acrylic acid and α- or β-alkyl derivatives, such as acrylic acid, methacrylic acid, α-ethylacrylic acid, crotonic acid, cinnamic acid, vinylacetic acid, isocrotonic acid and angelic acid; and unsaturated dicarboxylic acids, such as fumaric acid, maleic acid, alkenylsuccinic acid, itaconic acid, mesaconic acid, dimethylmaleic acid, and dimethylfumaric acid, citraconic acid, and mono-ester derivatives and anhydrides thereof. Desired polymers may be synthesized by polymerizing these monomers alone or in mixture for copolymerization with other monomers. Among these, it is particularly preferred to use mono-ester derivatives of unsaturated dicarboxylic acids for controlling the acid value.

Preferred examples thereof may include: monoesters of α,β-unsaturated dicarboxylic acids, such as monomethyl maleate, monoethyl maleate, monobutyl maleate, monooctyl maleate, monoallyl maleate, monophenyl maleate, monomethyl fumarate, monoethyl fumarate, monobutyl fumarate and monophenyl fumarate; and monoesters of alkenyldicarboxylic acids, such as monobutyl n-butenylsuccinate, monomethyl n-octenylsuccinate, monoethyl n-butenylmalonate, monomethyl n-dodecenylglutarate, and monobutyl n-butenyladipate.

The above-mentioned carboxyl group-containing monomer may preferably constitute 0.1–20 wt. %, particularly 0.2–15 wt. %, of the total monomers providing the binder resin.

A reason why a monomer in the form of a dicarboxylic acid monoester is preferred is that an ester having a lower solubility in aqueous suspension medium and having a high solubility in an organic solvent or other monomers, in preferred.

In the present invention, the carboxylic acid group and carboxylic acid ester site can be subjected to saponification by an alkaline treatment. It is also preferred to convert the carboxylic acid group and the carboxylic acid ester site into a polar functional group by reaction with an alkaline cationic component.

The alkaline treatment may be performed by adding an alkali into the solvent medium after the preparation of the binder resin. Examples of the alkali may include: hydroxides of alkaline metals or alkalline earth metals, such as Na, K, Ca, Li, Mg and Ba; hydroxides of transition metals, such as Zn, Ag, Pb and Ni; and ammonium hydroxide, alkylammonium hydroxides, such as pyriminium hydroxide. Particularly preferred examples may include NaOH and KOH.

In the present invention, the above-mentioned saponification need not be effected with respect to all the carboxylic acid group and carboxylic ester site of the copolymer, but a part of the carboxylic groups can be saponified into a polar functional group.

The alkali for the saponification may be used in an amount of 0.02–5 equivalents to the acid value of the binder resin. Below 0.02 equivalent, the saponification is liable to be insufficient to provide insufficient polar functional groups, thus being liable to cause insufficient crosslinking thereafter. On the other hand, in excess of 5 equivalents, the functional group, such as the carboxylic ester site, can receive adverse effects, such as hydrolysis and salt formation.

If the alkalline treatment in an amount of 0.02–5 equivalents to the acid value is effected, the remaining cation concentration may be within the range of 5–1000 ppm.

The binder resin and the toner composition containing the binder resin may preferably have a glass transition temperature (Tg) of 45–75° C., more preferably 50–70° C., in view of the storage stability of the toner. If Tg is below 45° C., the toner is liable to be deteriorated in a high-temperature environment and liable to cause offset at the time of fixation. If Tg is above 75° C., the fixability is liable to be lowered.

The binder resin used in the present invention may be produced by solution polymerization, emulsion polymerization or suspension polymerization.

In the emulsion polymerization process, a monomer almost insoluble in water is dispersed as minute particles in an aqueous phase with the aid of an emulsifier and is polymerized by using a water-soluble polymerization initiator. According to this method, the control of the reaction temperature is easy, and the termination reaction velocity is small because the polymerization phase (an oil phase of the vinyl monomer possibly containing a polymer therein) constitute a separate phase from the aqueous phase. As a result, the polymerization velocity becomes large and a polymer having a high polymerization degree can be prepared easily. Further, the polymerization process is relatively simple, the polymerization product is obtained in fine particles, and additives such as a colorant, a charge control agent and others can be blended easily for toner production. Therefore, this method can be advantageously used for production of a toner binder resin.

In the emulsion polymerization, however, the emulsifier added is liable to be incorporated as an impurity in the polymer produced, and it is necessary to effect a post-treatment such as salt-precipitation in order to recover the product polymer at a high purity. The suspension polymerization is more convenient in this respect.

The suspension polymerization may preferably be performed by using at most 100 wt. parts, preferably 10–90 wt. parts, of a monomer (mixture) per 100 wt. parts of water or an aqueous medium. The dispersing agent may include polyvinyl alcohol, partially saponified form of polyvinyl alcohol, and calcium phosphate, and may preferably be used in an amount of 0.05–1 wt. part per 100 wt. parts of the aqueous medium. The polymerization temperature may suitably be in the range of 50–95° C. and selected depending on the polymerization initiator used and the objective polymer.

The binder resin used in the present invention may suitably be produced in the presence of a combination of a polyfunctional polymerization initiator and a monofunctional polymerization initiator, as enumerated hereinbelow.

Specific examples of the polyfunctional polymerization initiator may include: polyfunctional polymerization initiators having at least two functional groups having a polymerization-initiating function, such as peroxide groups, per molecule, inclusive of 1,1-di-t-butylperoxy-3,3,5-trimethylcyclohexane, 1,3-bis-(t-butylperoxyisopropyl) benzene, 2,5-dimethyl-2,5-(t-butylperoxy)hexane, 2,5-dimethyl-2,5-di-(t-butylperoxy)hexine-3, tris(t-butylperoxy)triazine, 1,1-di-t-butylperoxycyclohexane, 2,2-di-t-butylperoxybutane, 4,4-di-t-butylperoxyvaleric acid n-butyl ester, di-t-butylperoxyhexahydroterephthalate, di-t-butylperoxyazelate, di-t-butylperoxytrimethyladipate, 2,2-bis-(4,4-di-t-butylperoxycyclohexyl)propane, 2,2-t-butylperoxyoctane and various polymer oxides; and polyfunctional polymerization initiators having both a polymerization-initiating functional group, such as peroxide group, and a polymerizable unsaturation group in one molecule, such as diallylperoxydicarbonate, t-butylperoxymaleic acid, t-butylperoxyallylcarbonate, and t-butylperoxyisopropylfumarate.

Among these, particularly preferred examples may include: 1,1-di-t-butylperoxy-3,3,5-trimethylcyclohexane, 1,1-di-t-butylperoxycyclohexane, di-t-butylperoxyhexahydroterephthalate, di-t-butylperoxyazelate, 2,2-bis(4,4-di-t-butylperoxycyclohexyl) propane, and t-butylperoxyallylcarbonate.

These polyfunctional polymerization initiators may be used in combination with a monofunctional polymerization initiator, preferably one having a 10 hour-halflife temperature (a temperature providing a halflife of 10 hours by decomposition thereof) which is lower than that of the polyfunctional polymerization initiator, so as to provide a toner binder resin satisfying various requirements in combination.

Examples of the monofunctional polymerization initiator may include: organic peroxides, such as benzoyl peroxide, 1,1-di(t-butylperoxy)-3,3,5-trimethylcyclohexane, n-butyl-4,4-di(t-butylperoxy)valerate, dicumyl peroxide, α,α-bis(t-butylperoxydissopropyl)benzene, t-butylperoxycumene and di-t-butyl peroxide; and azo and diazo compounds, such as azobisisobutyronitrile, and diazoaminoazobenzene.

The monofunctional polymerization initiator can be added to the monomer simultaneously with the above-mentioned polyfunctional polymerization initiator but may preferably be added after lapse of a polymerization time which exceeds the halflife of the polyfunctional polymerization initiator, in order to appropriately retain the initiator efficiency of the polyfunctional polymerization initiator.

The above-mentioned polymerization initiators may preferably be used in an amount of 0.05–2 wt. parts per 100 wt. parts of the monomer.

It is also preferred that the binder resin used in the present invention may be crosslinked by using a crosslinking monomer as enumerated hereinbelow.

The crosslinking monomer may principally be a monomer having two or more polymerizable double bonds. Specific examples thereof may include: aromatic divinyl compounds, such as divinylbenzene and divinylnaphthalene; diacrylate compounds connected with an alkyl chain, such as ethylene glycol diacrylate, 1,3-butylene glycol diacrylate, 1,4-butanediol diacrylate, 1,5-pentanediol diacrylate, 1,6-hexanediol diacrylate, and neopentyl glycol diacrylate, and compounds obtained by substituting methacrylate groups for the acrylate groups in the above compounds; diacrylate compounds connected with an alkyl chain including an ether bond, such as diethylene glycol diacrylate, triethylene glycol diacrylate, tetraethylene glycol diacrylate, polyethylene glycol #400 diacrylate, polyethylene glycol #600 diacrylate, dipropylene glycol diacrylate and compounds obtained by substituting methacrylate groups for the acrylate groups in the above compounds; diacrylate compounds connected with a chain including an aromatic group and an ether bond, such as polyoxyethylene(2)-2,2-bis(4-hydroxyphenyl) propanediacrylate, polyoxyethylene(4)-2,2-bis(4-hydroxyphenyl)propanediacrylate, and compounds obtained by substituting methacrylate groups for the acrylate groups in the above compounds; and polyester-type diacrylate compounds, such as one known by a trade name of MANDA (available from Nihon Kayaku K.K.). Polyfunctional crosslinking agents, such as pentaerythritol triacrylate, trimethylolethane triacrylate, trimethylolpropane triacrylate, tetramethylpropane triacrylate, tetramethylolmethane tetracrylate, oligoester acrylate, and compounds obtained by substituting methacrylate groups for the acrylate groups in the above compounds; triallyl cyanurate and triallyl trimellitate.

These crosslinking agents may preferably be used in a proportion of 0.0001–1 wt. part, particularly 0.001–0.5 wt. parts, per 100 wt. parts of the other vinyl monomer components.

Among the above-mentioned crosslinking monomers, aromatic divinyl compounds (particularly, divinylbenzene) and diacrylate compounds connected with a chain including an aromatic group and an ether bond may suitably be used in a toner resin in view of fixing characteristic and anti-offset characteristic.

As other polymerization methods, there are known bulk polymerization and solution polymerization. According to the bulk polymerization, however, a variety of polymers including a low-molecular weight polymer can be produced by adopting a high polymerization temperature providing an accelerated reaction speed, the reaction control is liable to be difficult. In contrast thereto, according to the solution polymerization process, such a low-molecular weight polymer can be produced under moderate conditions by utilizing the radical chain transfer function of the solvent and by adjusting the polymerization initiator amount or reaction temperature, so that the solution polymerization process is preferred for formation of a low-molecular weight component to be contained in the binder resin. It is also effective to perform the solution polymerization under an elevated pressure, so as to suppress the amount of the polymerization initiator to the minimum and suppress the adverse effect of the residual polymerization initiator.

Examples of the monomer constituting the binder resin used in the toner according to the present invention may include: styrene; styrene derivatives, such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, and p-n-dodecylstyrene; ethylenically unsaturated monoolefins, such as ethylene, propylene, butylene, and isobutylene; unsaturated polyenes, such as butadiene; halogenated vinyls, such as vinyl chloride, vinylidene chloride, vinyl bromide, and vinyl fluoride; vinyl esters, such as vinyl acetate, vinyl propionate, and vinyl benzoate; methacrylates, such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylates, such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate, vinyl ethers, such as vinyl methyl ether, vinyl ethyl ether, and vinyl isobutyl ether; vinyl ketones, such as vinyl methyl ketone, vinyl hexyl ketone, and methyl isopropenyl ketone; N-vinyl compounds, such as N-vinylpyrrole, N-vinylcarbazole, N-vinylindole, and N-vinyl pyrrolidone; vinylnaphthalenes; acrylic acid derivatives or methacrylic acid derivatives, such as acrylonitrile, methacrylonitrile, and acrylamide; the esters of the above-mentioned $\alpha,\beta$-unsaturated acids and the diesters of the above-mentioned dibasic acids. These vinyl monomers may be used singly or in combination of two or more species.

Among these, a combination of monomers providing styrene-based copolymers and styrene-acrylate-based copolymers may be particularly preferred.

It is preferred that the binder resin contains at least 65 wt. % of styrene polymer or styrene copolymer so as to exhibit good mixability with the organic zirconium compound.

The binder resin used in the present invention may be in the form of a mixture of a high-molecular weight polymer component and a low-molecular weight polymer component obtained through various processes, inclusive of: a solution blend process wherein a high-molecular weight polymer and a low-molecular weight polymer produced separately are blended in solution, followed by removal of the solvent; a dry blend process wherein the high- and low-molecular weight polymers are melt-kneaded by means of, e.g., an extruder; and a two-step polymerization process wherein a low-molecular weight polymer prepared, e.g., by solution polymerization is dissolved in a monomer constituting a high-molecular weight polymer, and the resultant solution is subjected to suspension polymerization, followed by washing with water and drying to obtain a binder resin. However, the dry blend process leaves a problem regarding the uniform dispersion and mutual solubilities, and the two-step polymerization process makes it difficult to increase the low-molecular weight component in excess of the high-molecular weight component while it is advantageous in providing a uniform dispersion. Further, the two-step polymerization process providing a difficulty that, in the presence of a low-molecular weight polymer component, it is difficult to form an adequately high-molecular weight component and an unnecessary low-molecular weight component is by-produced. Accordingly, the solution blend process is most suitable in the present invention. Further, it is preferred to use a low-molecular weight polymer component having a prescribed acid value through solution polymerization because of easier setting of the acid value than in the aqueous system polymerization.

It is also preferred to use a polyester resin as the binder resin. A preferred composition of such a polyester resin is described below.

Examples of a dihydric alcohol component may include: diols, such as ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, bisphenols and derivatives represented by the following formula (A):

(A)

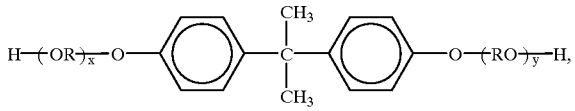

wherein R denotes an ethylene or propylene group, x and y are independently 0 or a positive integer with the proviso that the average of x+y is in the range of 0–10; diols represented by the following formula (B):

(B)

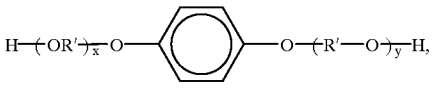

wherein R' denotes $—CH_2CH_2—$,

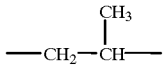

or

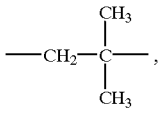

x' and y' are independently 0 or a positive integer with the proviso that the average of x'+y' is in the range of 0–10.

Examples of a dibasic acid may include benzenedicarboxylic acids, such as phthalic acid, terephthalic acid and isophthalic acid, and their anhydrides and lower alkyl esters; alkyldicarboxylic acids, such as succinic acid, adipic acid, sebacic acid and azelaic acid, and their anhydrides and lower alkyl esters; alkyl or alkenyl-substituted succinic acids, and their anhydrides and lower alkyl esters; and unsaturated dicarboxylic acids, such as fumaric acid, maleic acid, citraconic acid and itaconic acid, and their anhydrides, and derivatives of these.

It is preferred to use a polyhydric alcohol or/and a polybasic acid each having three or more functional groups also functioning as a crosslinking component in combination with the above mentioned alcohol and acid.

Examples of such polyhydric alcohols may include: sorbitol, 1,2,3,6-hexanetetrol, 1,4-sorbitane, pentaerythritol, dipentaerythritol, tripentaerithritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxybenzene.

Examples of polybasic carboxylic acids may include: trimellitic acid, pyromellitic acid, 1,2,4-benzentricarboxylic acid, 1,2,5-benzentricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,2,5-hexanetricarboxylic acid, 1,3-dicarboxyl-2-methyl-2-methylenecarboxypropane, tetra(methylenecarboxyl) methane, 1,2,7,8-octanetetracarboxylic acid, empole trimer acid, and their anhydrides and lower alkyl esters; and also tetracarboxylic acids represented by the formula of:

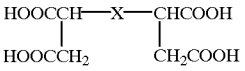

(wherein X is an alkylene or alkenylene group having 1–30 carbon atoms and capable of having one or more side chains of one or more carbon atoms) and anhydride and lower alkyl esters thereof.

The polyester may desirably comprise 40–60 mol. %, preferably 45–55 mol. % of alcohol component and 60–40 mol. %, preferably 55–45 mol. % of acid component. The polyfunctional component may be used in a proportion of 1–60 mol. % of the total components.

Such a polyester may be produced through a known polycondensation process.

When the toner according to the present invention is formed as a magnetic toner, the toner contains a powdery magnetic material, examples of which may include: iron oxide, such as magnetite, hematite and ferrite; metals, such as iron, cobalt and nickel, and alloys of these metals with another element, such as aluminum, copper, lead, magnesium, tin, zinc, antimony, beryllium, bismuch, cadmium, calcium, manganese, selenium, titanium, tungsten and vanadium, and mixtures of these. Magnetic particles may preferably contain a non-iron element.

The magnetic material used in the present invention may comprise an iron oxide, such as magnetite, maghemite, ferrite or a mixture of these containing a different (i.e., non-iron) element.

It is particularly preferred to use a magnetic iron oxide containing at least one element selected from lithium, boron, magnesium, aluminum, silicon, phosphorus, sulfur, germanium, titanium, zirconium, tin, lead, zinc, calcium, barium, scandium, vanadium, chromium, manganese, cobalt, copper, nickel, gallium, indium, silver, palladium, gold, platinum, tungsten, molybdenum, niobium, osmium, strontium, yttrium, technetium, ruthenium, rhodium, and bismuth. It is particularly preferred to contain at least one of lithium, beryllium, boron, magnesium, aluminum, silicon, phosphorus, germanium, zirconium, tin, sulfur, calcium, scandium, titanium, vanadium, chromium, manganese, cobalt, nickel, copper, zinc and gallium. It is most preferred to use a magnetic iron oxide containing a different element selected from the group consisting of magnesium, aluminum, silicon, phosphorus and zirconium.

Such a different element may be introduced into the crystal lattice of the iron oxide, incorporated as an oxide thereof in the iron oxide, or present as an oxide or a hydroxide thereon on the surface of the iron oxide particles.

Such a different element may be incorporated into magnetic iron oxide particles at the time of separation of the magnetic iron oxide in the copresence of the different element under a controlled pH, or alternately may be precipitated on the surface of the magnetic iron oxide particles by controlling the pH or adding a salt of the different element and controlling the pH, respectively after forming the magnetic iron oxide particles.

The magnetic iron oxide particles containing such a different element exhibits a good affinity with and very good dispersibility in the binder resin. Further, the good dispersibility of the magnetic material also improves the dispersibility of the organic zirconium compound used in the present invention, thus allowing full exhibition of the effect of the organic zirconium compound. Thus, the magnetic material functions as a dispersion promoting medium to promote the dispersion of the organic zirconium compound. Further, the magnetic material adsorbs water to promote the chargeability-imparting effect of the organic zirconium compound exhibited in cooperation with water molecules. The effect is further promoted when used in combination with a binder resin having an acid value.

The magnetic material particles may have a uniform particle size distribution, thus providing the resultant toner with a stable chargeability, in cooperation with a good dispersibility thereof. Further, while the toner particle size has been reduced in recent years, the toner thus obtained according to the present invention may be provided with an enhanced uniformity of chargeability and reduced toner agglomeratability, thus providing an increased image density and improved fog prevention effect, even at a weight-average particle size of 2.5–10 $\mu$m. The effect is particularly remarkable for a toner having a weight-average particle size of 2.5–6 $\mu$m, and a very high-definition image can be produced. A weight-average particle size of at least 2.5 $\mu$m is preferred in order to obtain a sufficient image density. On the other hand, as the toner particle size is reduced, the liberation of the zirconium compound is more liable to occur. However, as the toner according to the present invention is excellent in changing uniformity, the toner is less liable to be affected by sleeve soiling with some isolated zirconium compound.

The above-mentioned different element may preferably be contained in 0.05–10 wt. % based on the iron element in the magnetic iron oxide. The content is more preferably be 0.1–7 wt. %, particularly preferably 0.2–5 wt. %, most preferably 0.3–4 wt. %. Below 0.05 wt. %, the addition effect of the different element is scarce, thus failing to achieve good dispersibility and uniformity of chargeability. Above 10 wt. %, the charge liberation is liable to be excessive to cause insufficient chargeability, thus resulting in a lower image density and an increased fog.

It is preferred that the different element is distributed so that it is richer in the vicinity of the surface of the magnetic iron oxide particles. For example, it is preferred that 20–100% of the different element is present at the surface portion to be dissolved up to an iron dissolution percentage of 20%. The percentage is preferably 25–100%, more preferably 30–100%. By increasing the proportion of the presence at the surface portion, the dispersibility and electrical diffusion effect of the different element can be improved.

The magnetic material, preferably magnetic iron oxide particles containing a different element as described above, may preferably have a number-average particle size of 0.05–1.0 μm, further preferably 0.1–0.5 μm. The magnetic material may preferably have a BET specific surface area of 2–40 $m^2/g$, more preferably 4–20 $m^2/g$. The magnetic material particles may have an arbitrary shape without particular restriction. As for magnetic properties, the magnetic material may desirably have a saturation magnetization of 10–200 $Am^2/g$, preferably 70–100 $Am^2/kg$, a residual magnetization of 1–100 $Am^2/kg$, preferably 2–20 $Am^2/kg$, and a coercive force of 1–30 kA/m, preferably 2–15 kA/m as measured under a magnetic field of 795.8 kA/m. The magnetic material may be added in 20–200 wt. parts per 100 wt. parts of the binder resin.

The element quantity in the magnetic iron oxide may be measured by fluorescent X-ray analysis using a fluorescent X-ray analyzer (e . . . , "SYSTEM 3080", mfd. by Rigaku Denki Kogyo K.K.) according to JIS K0119 "General Rules for Fluorescent X-ray Analysis"). Further, the element distribution may be measured by gradual fractional dissolution of the magnetic iron oxide particles with hydrochloric acid or hydrofluoric acid and measurement of the element concentration in the solution at each fractional dissolution relative to the element concentration in the complete solution, respectively according to ICP (inductively coupled plasma) emission spectroscopy.

The number-average particle size of the magnetic material may be measured by taking photographs of some particles thereof through a transmission electron microscope and measuring the particle sizes on the photographs by a digitizer, etc. The magnetic properties of the magnetic material described herein are based on values measured by using a vibrating sample-type magnetometer ("VSM-3S-15", available from Toei Kogyo K.K.) under an external magnetic filed of 795.8 kA/m. The specific surface area values are based on values measured by using a specific surface area meter ("Autosorb 1", available from Yuasa Ionics K.K.) according to the BET multi-point method.

The toner according to the present invention may preferably have a weight-average particle size of 2.5–10 μm, more preferably 2.5–6 μm, in case of either a magnetic toner or a non-magnetic toner.

The weight-average particle size and particle size distribution of a toner may be measured according to the Coulter counter method, e.g., by using Coulter Multisizer II (available from Coulter Electronics Inc.) together with an electrolytic solution comprising a ca. 1% NaCl aqueous solution which may be prepared by dissolving a reagent-grade sodium chloride or commercially available as "ISOTON-II" (from Counter Scientific Japan). For measurement, into 10 to 150 ml of the electrolytic solution, 0.1 to 5 ml of a surfactant (preferably an alkyl benzenesulfonic acid salt) is added as a dispersant, and 2–20 mg of a sample is added. The resultant dispersion of the sample in the electrolytic solution is subjected to a dispersion treatment by an ultrasonic disperser for ca. 1–3 min., and then subjected to measurement of particle size distribution by using the above-mentioned apparatus equipped with a 100 μm-aperture. The volume and number of toner particles having particle sizes of 2.00 μm or larger are measured for respective channels to calculate a volume-basis distribution and a number-basis distribution of the toner. From the volume-basis distribution, a weight-average particle size ($D_4$) of the toner is calculated by using a central value as a representative for each channel.

The channels used include 13 channels of 2.00–2.52 μm; 2.52–3.17 μm; 3.17–4.00 μm; 4.00–5.04 μm; 5.04–6.35 μm; 6.35–8.00 μm; 8.00–10.08 μm, 10.08–12.70 μm; 12.70–16.00 μm; 16.00–20.20 μm; 20.20–25.40 μm; 25.40–32.00 μm: and 32.00–40.30 μm.

Examples of the wax used in the present invention may include: aliphatic hydrocarbon waxes, such as low-molecular weight polyethylene, low-molecular weight polypropylene, polyolefin copolymers, polyolefin waxes, microcrystalline wax, paraffin wax, and sasol wax; oxidation products of aliphatic hydrocarbon waxes, such as oxidized polyethylene wax; block copolymers of the above; vegetable waxes, such as candelilla wax, carnauba wax, Japan wax, and "hohoba" wax; animal waxes, such as beeswax, lanolin, and whale wax; mineral waxes, such as ozocerite, ceresine, and petrolatum; waxes consisting principally of aliphatic acid esters, such as montanate ester wax and castor wax; and partially or totally deacidified aliphatic esters, such as deacidified carnauba wax. Further examples of the release agent may include: saturated linear aliphatic acids, such as palmitic acid, stearic acid, montanic acid, and long-chain alkylcarboxylic acid having a further long alkyl chain; unsaturated aliphatic acids, such as brassidic acid, eleostearic acid and parinaric acid; saturated alcohols, such as stearyl alcohol, eicosyl alcohol, behenyl alcohol, carnaubyl alcohol, ceryl alcohol, melissyl alcohol, and long-chain alkyl alcohols having a further long alkyl chain; polyhydric alcohols, such as sorbitol; aliphatic acid amides, such as linoleylamide, oleylamide, and laurylamide; saturated aliphatic acid bisamides, methylene-bisstearylamide, ethylene-biscaprylamide, and ethylene-biscaprylamide; unsaturated aliphatic acid amides, such as ethylene-bisolerylamide, hexamethylene-bisoleylamide, N,N'-dioleyladipoylamide, and N,N'-dioleylsebacoylamide, aromatic bisamides, such as m-xylene-bisstearoylamide, and N,N'-distearylisophthalylamide; aliphatic acid metal salts (generally called metallic soap), such as calcium stearate, calcium laurate, zinc stearate, and magnesium stearate; grafted waxes obtained by grafting aliphatic hydrocarbon waxes with vinyl monomers, such as styrene and acrylic acid; partially esterified products between aliphatic acids and polyhydric alcohols, such as behenic acid monoglyceride; and methyl ester compounds having hydroxyl group as obtained by hydrogenating vegetable fat and oil.

A further preferred class of waxes may include: polyolefins obtained through radical polymerization of olefins under high pressure; polyolefins obtained by purifying low-molecular weight by-products from high-molecular weight polyolefin polymerization; polyolefins obtained by low-pressure polymerization in the presence of a catalyst, such as Ziegler catalyst or metallocene catalyst; polyolefins polymerized under irradiation with radiation rays, electromagnetic wave or light; low-molecular weight polyolefin formed by thermal decomposition of high-molecular weight polyolefin; paraffin wax, microcrystalline wax, Fischer-Tropsche wax; synthetic hydrocarbon waxes obtained according to, e.g., the Synthol process, the Hydrocol process, and the Arge process; synthetic waxes obtained from mono-carbon compounds; hydrocarbon waxes having a functional group, such as hydroxyl group or carboxyl group; mixtures of a hydrocarbon wax and a hydrocarbon wax having a functional group; and modified waxes obtained by grafting the above waxes with a vinyl monomer, such as styrene, maleic acid ester, acrylate, methacrylate, or maleic anhydride.

It is also preferred to use a wax product having a narrower molecular weight distribution obtained by fractionating the above waxes according to press sweating, solvent method, re-crystallization, vacuum distillation, supercritical gas extraction or melt-crystallization; or a purified product obtained by removing low-molecular weight solid aliphatic acid, low-molecular weight solid alcohol, low-molecular weight solid compound and other impurities.

The wax used in the present invention may preferably have a melting point of 70–140° C., more preferably 70–120° C., in order to provide a good balance between the fixability and anti-offset characteristic of the resultant toner. Below 70° C., the toner is liable to have a lower anti-blocking property, and above 140° C., it becomes difficult to exhibit the anti-offset property.

In the toner according to the present invention, the wax may be used in an amount of 0.2–20 wt. parts, preferably 0.5–10 wt. parts, (as a total amount when two or more species are used in combination), per 100 wt. parts of the binder resin.

The melting point of a wax described herein refers to a peaktop temperature of a maximum heat-absorption peak of the wax on a chart of DSC (differential scanning calorimetry).

The DSC measurement for a wax or toner may preferably be performed by using a high-accuracy internal heat input compensation-type differential scanning calorimeter, (such as "DSC 7", available from Perkin-Elmer Corporation).

The measurement may be performed according to ASTM D3418-82. A sample is first subjected to one cycle of heating and cooling for removing a thermal histroy thereof and then heating at a temperature-raising rate of 10° C./min. to take a DSC curve.

The organic zirconium compound used in the present invention may exhibit further excellent effect when used in combination with two or more species of different waxes. The waxes exhibit a plasticizing function and a release function in the toner, which can be exhibited emphatically by the respective waxes more effectively than in the case where either one of the waxes is used alone. More specifically, the toner is plasticized by one of the waxes and correspondingly the release effect of another wax can be more effectively exhibited. These effects are promoted when a binder resin having an acid value is used in combination.

As for the functions of the waxes, e.g., in case where two waxes of similar structures are used in combination, a wax having a lower melting point principally exhibits the plasticizing function and the other wax having a higher melting point principally exhibits the release function. In this case, the function separation can be effectively accomplished if the melting point difference is 10–100° C. Less than 10° C., the function separation effect cannot be readily exhibited, and in excess of 100° C., the promotion of the functions due to mutual interaction cannot be readily exhibited.

In this case, it is preferred that at least one of the waxes has a melting point of 70–120° C., more preferably 70–100° C., so as to readily develop the function separation effect.

As for the combination of waxes, a wax relatively rich in branching structure or polar group such as a functional group or a wax modified with a modifier component rather different from the principal component preferentially exhibits the plasticizing function, and a wax having a rather linear structure, a non-polar, wax free from functional groups or an unmodified straight wax preferentially exhibits the release function. Examples of such preferred combinations may include: a combination of a homopolymer or copolymer consisting principally of ethylene and a homopolymer or copolymer principally consisting of an olefin other than ethylene; a combination of a polyolefin and a graft-modified polyolefin; a combination of alcohol wax, carboxylic acid wax or ester wax and hydrocarbon wax; a combination of Fischer-Tropsche wax or polyolefin wax and paraffin wax or microcrystalline wax; a combination of Fischer-Tropsche wax and polyolefin wax; a combination of paraffin wax and microcrystalline wax; and a combination of carnauba wax, candelilla wax, rice wax or montan wax, and hydrocarbon wax.

In any case, the wax composition may preferably have a maximum heat-absorption peak exhibiting a peaktop temperature in a region of 70–120° C., more preferably 70–110° C., so as to provide a good balance between the storage stability and fixability of the resultant toner.

The toner according to the present invention can contain a colorant comprising any suitable pigment or dye. For example, suitable examples of the pigment may include: carbon black, aniline black, Naphthol Yellow, Hansa Yellow, Rhodamine Lake, Alizarin Lake, red iron oxide, Phthalocyanine Blue, and Indanthrene Blue. Such a pigment may be used in an amount necessary to provide a required optical density of fixed image, e.g., 0.1–20 wt. parts, preferably 0.2–10 wt. parts, per 100 wt. parts of the binder resin. For similar purpose, a dye may be used. There are, for example, azo dyes, anthraquinone dyes, xanthene dyes and methin dyes, which may be added in 0.1–20 wt. parts, preferably 0.3–10 wt. parts, per 100 wt. parts of the binder resin.

In the present invention, it is preferred to externally add inorganic fine powder, e.g., fine powder of inorganic oxides, such as silica, alumina and titanium oxide; carbon black or fine powdery fluorinated carbon.

For example, silica powder, alumina powder or titanium oxide powder may preferably be in such a fine particulate form as to be attached as fine particles onto the surface of the toner particles. More specifically, such an inorganic fine powder may preferably have a number-average particle size of 5–100 nm, more preferably 5–50 nm, and a specific surface area of at least 30 $m^2/g$, particularly 60–400 $m^2/g$, as base powder, and a specific surface area of at least 20 $m^2/g$, particularly 40–300 $m^2/g$, as surface-treated powder, respectively as measured by the BET method according to nitrogen adsorption.

Such inorganic fine powder may be added in 0.03–5 wt. parts per 100 wt. parts of toner particles so as to provide an adequate surface coverage rate.

The inorganic fine powder may preferably have a hydrophobicity of at least 30%, more preferably at least 50%, in terms of methanol wettability. The hydrophobicity-imparting agent (or hydrophobizing agent) may preferably comprise a silicon-containing surface-treating agent, such as a silane compound and/or a silicone oil.

For example, it is appropriate to use a silane coupling agent, examples of which may include: alkylalkoxysilanes, such as dimethyldimethoxysilane, trimethylethoxysilane and butyltrimethoxysilane; dimethyldichlorosilane, trimethylchlorosilane, allyldimethylchlorosilane, hexamethyldisilazane, allylphenyldichlorosilane, benzyldimethylchlorosilane, vinyltriethoxysilane, γ-methacryloxypropyltrimethoxysilane, vinyltriacetoxysilane, divinylchlorosilane, and dimethylchlorosilane.

The toner according to the present invention can also be blended with a carrier to provide a two-component developer. The carrier particles may preferably have a resistivity of $10^6$–$10^{10}$ ohm.cm by controlling the surface roughness and the amount of coating resin.

The carrier particles may be coated with a resin, examples of which may include: styrene-acrylate copolymer, styrene-methacrylate copolymer, acrylate copolymers, methacrylate copolymers, silicone resin, fluorine-containing resin, polyamide resin, ionomer resin, polyphenylene sulfide resin, and mixtures of these.

The carrier core particles may comprise a magnetic material, examples of which may include: iron oxides, such as ferrite, iron-excessive ferrite, magnetite, and γ-iron oxide; metals such as iron cobalt or nickel, and alloys of these metals. Further, the magnetic material may contain an element, such as iron, cobalt, nickel, aluminum, copper, lead, magnesium, tin, zinc, antimony, beryllium, bismuth, calcium, manganese, selenium, titanium, tungsten, or vanadium.

To the toner according to the present invention, it is also possible to add various additives in order to impart various properties. Examples of such additives are as follows:

(1) Abrasive: metal oxides (strontium titanate, cerium oxide, aluminum oxide, magnesium oxide, chromium oxide, etc.), nitrides (silicon nitride, etc.), carbide (silicon carbide, etc.), metal salts (calcium sulfate, barium sulfate, calcium carbonate, etc.), etc.

(2) Lubricants: powder of fluorine-containing resin (polyvinylidene fluoride, polytetrafluoroethylene, etc.), aliphatic acid metal salts (zinc stearate, calcium stearate, etc.), etc.

(3) Charge control particles: particles of metal oxides (tin oxide, titanium oxide, zinc oxide, silicon oxide, aluminum oxide), carbon black, resin particles, etc.

These additives may be added in 0.05–10 wt. parts, preferably 0.1–5 wt. parts per 100 wt. parts of the toner particles. These additives may be added singly or in combination of two or more species.

In the case of a magnetic toner, it is preferred to use fine powder of two or more species of inorganic oxides or metal oxides in order to provide good developing performance in continuous image formation and stable developing performance after standing. In the case of a non-magnetic mono-component developer, it is preferred to use titanium oxide or alumina in order to provide improved flowability and image uniformity.

Toner particles constituting the toner according to the present invention may preferably be formed through a process wherein the above-mentioned toner component materials are sufficiently blended by a blender, such as a ball mill, well kneaded by a hot kneading machine, such as a hot roller kneader or an extruder, and the kneaded product, after cooling for solidification, is mechanically pulverized and classified, to provide toner particles. It is also possible to adopt a polymerization toner production process wherein prescribed materials are mixed with a monomer (mixture) constituting the binder resin to form an emulsion or suspension liquid, followed by polymerization; a microencapsulation for providing so-called microcapsule toner particles wherein prescribed materials are incorporated into either one or both of the core material and the shell material; and a spray drying process wherein constituent materials are dispersed in a binder resin solution, and the resultant dispersion is spray-dried into toner particles. Further, the resultant toner particles may be further blended sufficiently with additive particles, as desired by a blender, such as a Henschel mixer, to provide a toner according to the present invention.

Hereinbelow, some embodiments of the developing method according to the present invention using the toner of the present invention with reference to drawings.

Referring to FIG. 1, an electrophotographic photosensitive drum 7 (as an example of an image-bearing member for bearing an electrostatic image formed by a known process) is rotated in a direction of arrow B. On the other hand, a developing sleeve 14 (as a developer-carrying member) carrying a toner 10 (as a mono-component developer) supplied from a hopper 9 is rotated in a direction of arrow A to convey a layer of the toner 10 to a developing region D where the developing sleeve 14 and the photosensitive drum 7 oppose each other. In case where the toner 10 is a magnetic toner, a magnet 11 is disposed within the developing sleeve so as to magnetically attract and hold the magnetic toner 10 on the developing sleeve, whereby the toner is subjected to friction with the developing sleeve 11 to acquire a triboelectric charge sufficient for developing an electrostatic image on the photosensitive drum 7.

In order to regulate the layer thickness of the magnetic toner 10, a regulating magnetic blade 8 comprising a ferromagnetic metal is hung down from the hopper 9 to confront the developing sleeve 14 with a gap of ca. 200–300 μm from the surface of the developing sleeve 14. Lines of magnetic induction from a magnetic pole $N_1$ of the magnet 11 are concentrated to the blade 8, whereby a thin layer of the toner 10 is formed on the developing sleeve 14. The blade 8 can also comprise a non-magnetic blade. Further, in case where the toner 10 is a non-magnetic toner, the blade 8 may be an elastic blade comprising urethane rubber, silicone rubber, tip blade, etc.

The thin layer thickness of the toner 10 formed on the developing sleeve 14 may preferably be smaller than the minimum gap between the developing sleeve 14 and the photosensitive drum 1 at the developing region D. The developing method according to the present invention is particularly effective in such a developing apparatus for the scheme wherein an electrostatic image is developed with such a thin layer of toner, i.e., a non-contact type developing apparatus. However, the developing method according to the present invention is also applicable to a developing apparatus wherein the toner layer thickness is larger than the minimum gap between the developing sleeve 14 and the photosensitive drum 7 at the developing region, i.e., a contact-type developing apparatus.

Hereinbelow, further description of a non-contact type developing apparatus will be made.

Referring again to FIG. 1, the developing sleeve 14 is supplied with a developing bias voltage from a power supply 15 so as to cause a jumping of a toner 10 (as a mono-component developer) carried on the developing sleeve 14. In case where the developing bias voltage is a DC voltage, it is preferred that the developing sleeve 14 is supplied with a developing bias voltage which is equal to a voltage given as a difference between a potential of an image region (where the toner 10 is attached to provide a visual image region) and a potential of a background region of an electrostatic image. On the other hand, in order to increase the density or gradational characteristic of a developed image, it is also possible to apply an alternating bias voltage to the developing sleeve 14, thereby forming a vibrating field of which the voltage polarity alternates with time at the developing region. In this case, it is preferred that the developing sleeve 4 is supplied with an alternating bias voltage superposed with a DC voltage component equal to the above-mentioned difference between the image region potential and the background region potential.

Further, in the case of so-called normal development scheme wherein a toner is attached to a higher potential region of an electrostatic image having such a higher-potential region and a lower potential region, a toner charged to a polarity opposite to that of the electrostatic image is used. On the other hand, in the case of the reversal development scheme wherein a toner is attached to a lower-potential region of an electrostatic image, a toner charged to a polarity identical to that of the electrostatic image is used. Herein, a higher-potential and a lower-potential refers to potential in terms of absolute value. In any case, the toner 10 is triboelectrically charged due to friction between the toner 10 and the developing sleeve 14 to a polarity appropriate for developing an electrostatic image on the photosensitive drum 7.

Figure 2:
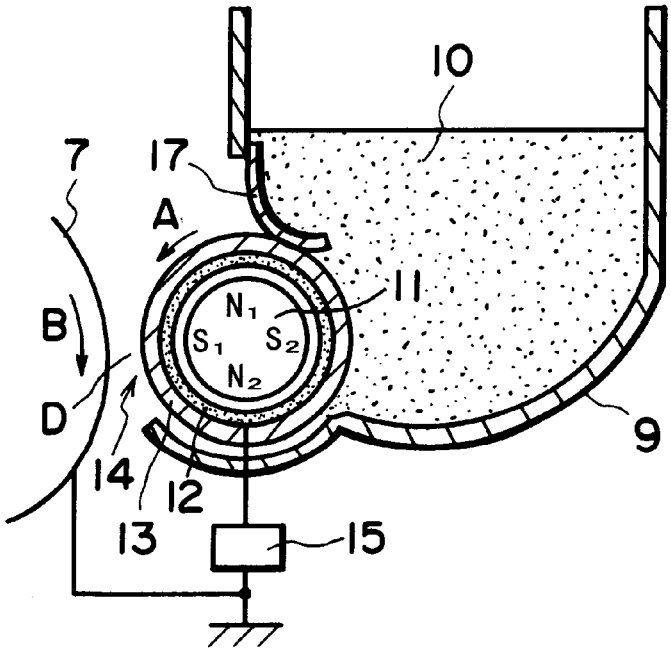

In a developing apparatus shown in FIG. 2, an elastic plate 17 comprising a material having a rubber elasticity, such as urethane rubber or silicone rubber, or a material having a metal elasticity, such as phosphor bronze or stainless steel, is used as a member for regulating the layer thickness of toner 10 on a developing sleeve 14, and the elastic plate 17 is pressed against the developing sleeve 14. In such a developing apparatus, a further thin toner layer can be formed on the developing sleeve 14. The other structure of the developing apparatus shown in FIG. 2 is basically identical to that of the apparatus shown in FIG. 1, and identical numerals in FIG. 2 represent identical members as in FIG. 1.

In the developing apparatus of FIG. 2, the toner is applied by rubbing with the elastic plate 17 onto the developing sleeve 14 to form a toner layer thereon, so that the toner can be provided with a larger triboelectric charge and thus results in a higher image density. This type of developing apparatus is used for a non-magnetic mono-component toner.

Figure 3:
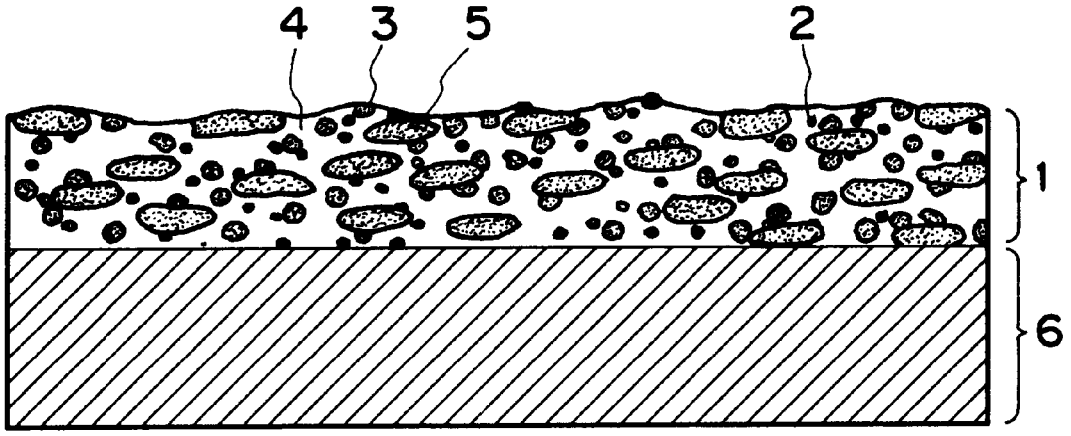
FIG. 3 is a partial sectional illustration of a developer-carrying member applicable to an embodiment of the developing method according to the invention.

The developing sleeve used as a developer-carrying member in the present invention may preferably comprise a cylindrical substrate and a resinous coating layer coating the substrate surface. An example of such a structure is illustrated in FIG. 3 which is a partial sectional view of the sleeve. Referring to FIG. 3, a cylindrical substrate 6 is coated with a resinous coating layer 1 which may comprise a binder resin 4 and optionally an electroconductive substance 2, a filler 3, a solid lubricant 5, etc., as desired. In case where the electroconductive substance 2 is contained, the resin coating layer 1 becomes electroconductive. This is effective for preventing excessive charge of the toner. In case where the filler 3 is contained, the wearing of the resin coating layer 1 may be suppressed, and the toner charge can be suitably controlled by the charge-imparting ability of the filler. Further, in the case where the solid lubricant 5 is contained, the releasability between the toner and the sleeve can be improved, thereby preventing melt-sticking of the toner onto the sleeve.

In the case of incorporating an electroconductive substance in a resin coating layer, the resin coating layer may preferably exhibit a volume resistivity of at most $10^6$ ohm.cm, more preferably at most $10^3$ ohm.cm. In case where the volume resistivity of the resin coating layer exceeds $10^6$ ohm.cm, the toner is liable to be excessively charged, thus resulting in occurrence of blotches or inferior developing performance.

The resinous coating layer may preferably have a surface roughness Ra in the range of 0.2–3.5 $\mu$m in terms of JIS cennte-line-average roughness. If Ra is below 0.2 $\mu$m, the toner charge in proximity to the sleeve is liable to be excessive, so that the toner is rather firmly held by the sleeve due to an image force and accordingly a fresh toner portion cannot be charged by the sleeve, thereby lowering the developing performance. If Ra exceeds 3.5 $\mu$m, the toner coating amount on the sleeve is liable to be excessive, so that the toner cannot be sufficiently charged but is ununiformly charged, thereby causing a lowering and irregularity of image density.

The resinous coating layer 1 may comprise materials as follows.

Referring to FIG. 3, examples of the electroconductive substance 2 may include: powder of metals, such as aluminum, copper, nickel and silver; powder of metal oxides, such as antimony oxide, indium oxide and tin oxide; and carbon homologues, such as carbon fiber, carbon black and graphite powder. Among these, carbon black is particularly excellent in electroconductivity and is suitably used because it imparts an electroconductivity when incorporated in a polymeric material at a fairly arbitrarily controlled level by controlling the addition amount thereof. The carbon black may preferably have a number-average particle size of 0.001–1.0 $\mu$m, more preferably 0.01–0.8 $\mu$m. In excess of 1 $\mu$m, it becomes difficult to control the volume resistivity of the resinous coating layer.

The electroconductive substance may preferably be added in 0.1–300 wt. parts, more preferably 1–100 wt. parts, per 100 wt. parts of the binder resin constituting the resinous coating layer.

The filler 3 may comprise a negative or positive charge control agent for toners. Examples of other materials constituting the filler 3 may include: inorganic compounds, such as aluminum, asbestos, glass fiber, calcium carbonate, magnesium carbonate, barium carbonate, barium sulfate, silica and calcium silicate; phenolic resin, epoxy resin, melamine resin, silicone resin, polymethyl methacrylate, methacrylate copolymers such as styrene/n-butylmethacrylate/silane terpolymer, styrene-butadiene copolymer, polycaprolactone; nitrogen-containing compounds, such as polycaprolactam, polyvinylpyridine, and polyamide; halogen-containing polymer, such as polyvinylidene fluoride, polyvinyl chloride, polytetrafluoroethylene, polytetrachlorofluoroethylene, perfluoroalkoxylated ethylene, polytetrafluoroalkoxyethylene, fluorinated ethylene-propylene-tetrafluoroethylene copolymer, and trifluorochloroethylene-vinyl chloride copolymer; polycarbonate, and polyester. Among these, silica and alumina are preferred because of their hardness and toner chargeability controlling effect.

Such fillers may preferably be used in 0.1–500 wt. part, more preferably 1–200 wt. parts, per 100 wt. parts of the binder resin.

The solid lubricant 5 may comprise, e.g., molybdenum disulfide, boron nitride, graphite, fluorinated graphite, silver-niobium selenide, calcium chloride-graphite, or talc. Among these, graphite may preferably be used because it has electroconductivity in addition to lubricity and may exhibit a function of reducing a portion of toner having an excessive charge to provide a level of charge suitable for development.

The solid lubricant may preferably be added in 0.1–300 wt. parts, more preferably 1–150 wt. parts, per 100 wt. parts of the binder resin.

The binder resin 4 used for constituting the resinous coating layer 1 optionally together with such electroconductive substance 2, filler 3 or/and solid lubricant 5, added as desired, may comprise a resin, such as phenolic resin, epoxy resin, polyamide resin, polyester resin, polycarbonate resin, polyolefin resin, silicone resin, fluorine-containing resin, styrene resin or acrylic resin. It is particularly preferred to use a thermosetting or photocurable resin.

The developing sleeve may be provided with further preferable performances by surface treatment thereof as by abrasion or polishing for surface smoothing so as to expose the electroconductive substance 2, filler 3 or/and solid lubricant 5 to the sleeve surface at an appropriate level, or/and to smooth the surface for providing a surface with a uniform unevenness. This is particularly effective for suppressing longitudinal streaks appearing in solid black or halftone images or quickly providing a sufficient image density at the startup of image formation, particularly in a high temperature/high humidity environment. The abrasion or polishing treatment may be performed by using an abrasion or polishing stripe of felt or abrasive particle-attached strip for finishing the sleeve surface to a uniform unevenness, whereby the toner coating amount on the sleeve can be uniformized, thereby allowing only toner particles subjected to triboelectrification with the sleeve to be conveyed to the developing region. This is assumed to be the mechanism for the improved performances.

After the surface-smoothing treatment, the coating layer may preferably retain a surface roughness Ra (according to JIS B0601) in the range of 0.2–3.5 $\mu$m, more preferably 0.3–2.5 $\mu$m, for the same reason as described above.

The cylindrical substrate 6 may preferably comprise a cylinder of a non-magnetic metal or a resin. For example, a non-magnetic cylindrical tube, such as that of stainless steel, aluminum or copper. Such a cylindrical tube may be produced through drawing or extrusion, preferably followed by cutting or polishing for improving the size accuracy to a prescribed size accuracy. The cylindrical tube may preferably have a straight allowance of at most 30 $\mu$m, more preferably at most 20 $\mu$m. The tube may be subjected to sand blasting or abrasion for provide a rough surface with an appropriate degree of surface unevenness. The blasting may be performed by using abrasive particles which may be definitely shaped or indefinitely shaped.

Now, an example of image forming method to which the developing method according to the present invention is applicable, will be described with reference to FIG. 4, which illustrates an image forming apparatus including a contact charging means and a contact transfer means while the developing method according to the present invention is also applicable to an image forming method including a corona charging scheme or/and a corona transfer scheme.

Figure 4:
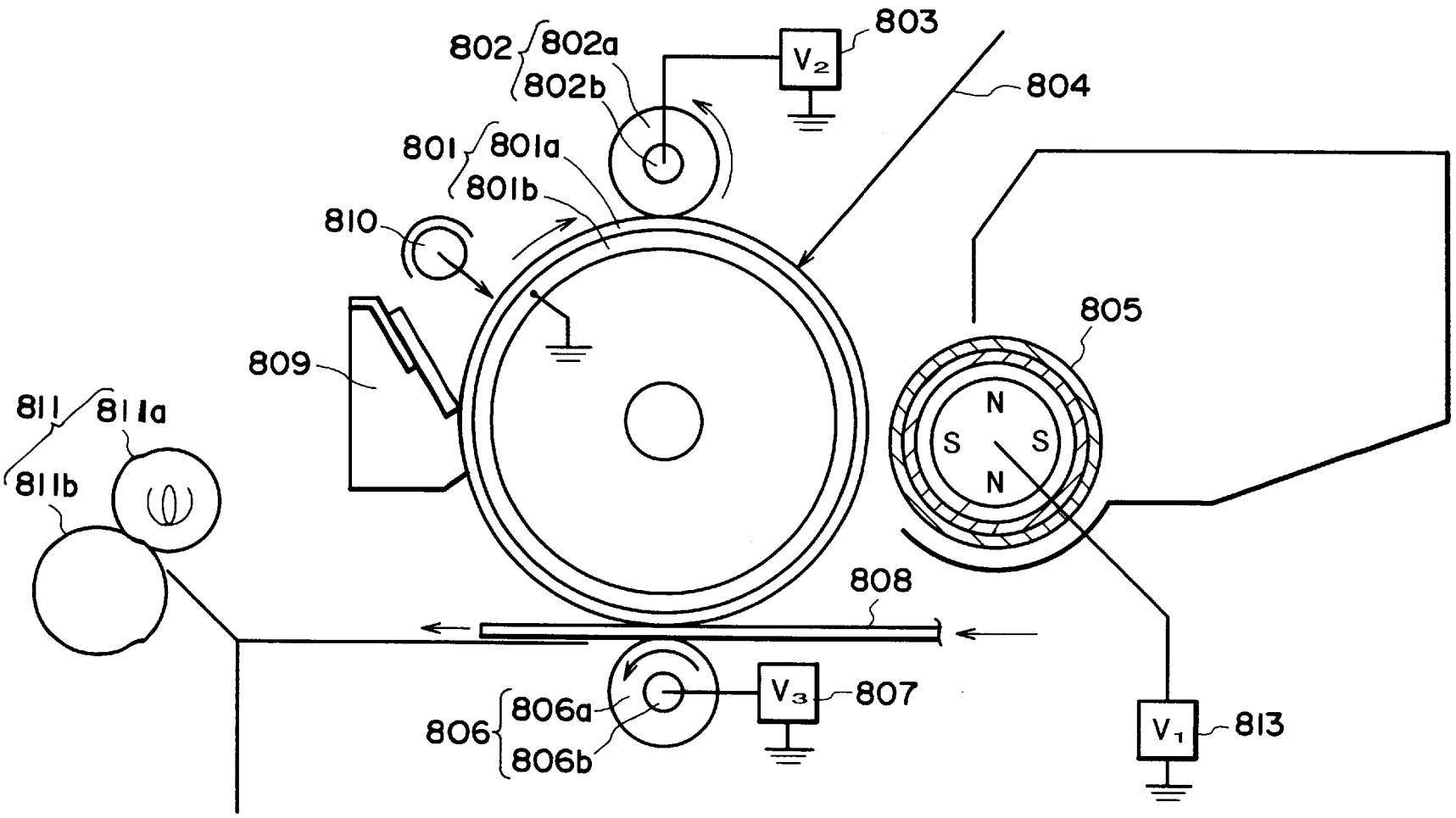
FIG. 4 is an illustration of an image forming apparatus to which the developing method according to the invention is applicable.

Referring to FIG. 4, a rotating drum-type photosensitive member 801 comprising a photoconductor layer 801*a* and an electroconductive substrate 801*b* is rotated at a prescribed peripheral speed (process speed) in a clockwise direction as shown on the drawing. A charging roller 802 comprising an electroconductive elastic layer 802*a* and a core metal 802*b* is supplied with a bias voltage V2 from a charging bias voltage supply 803. The charging roller 802 is pressed against the photosensitive member 801 and is rotated following the rotation of the photosensitive member 801.

Based on the bias voltage applied to the charging roller 802, the surface of the photosensitive member 801 is charged to a prescribed voltage of a prescribed polarity. Then, the charged photosensitive member 801 is exposed to image light 804 to form an electrostatic image thereon, which is then visualized as a toner image by a developing means 805. The developing means 805 includes a developing sleeve which is supplied with a bias voltage V1 from a developing bias voltage supply 813.

The toner image formed on the photosensitive member 801 is electrostatically transferred onto a transfer-receiving material 808 under the action of a transfer bias voltage supplied from a voltage supply 807 via a transfer roller 806 (as a contact transfer means for pressing the transfer-receiving material 808 onto the photosensitive member 801) comprising an electroconductive elastic layer 806*a* and a core metal 806*b*. The toner image transferred onto the transfer-receiving material 808 is then fixed onto the transfer-receiving material 808 under application of heat and pressure by a heat-pressure fixing means 811 comprising a heating roller 811*a* and a pressure roller 811*b*. The surface of the photosensitive member 801 is subjected to cleaning for removal of attached soiling substance, such as transfer residual toner by a cleaning device 809 having an elastic cleaning blade abutted against the photosensitive member 801 in a counter direction, and then charge-removed by a charge-removing exposure means 810, to be used for a subsequent cycle of image formation.

While the charging roller 802 has been described as a contact charging means in the above embodiment, the primary charging means can also comprise another contact charging means, such as a charging blade or a charging brush, or alternatively a non-contact corona charging means. However, the contact charging means is less liable to cause the generation of ozone.

Further, while the transfer roller 806 has been described, the transfer means can also comprise another contact transfer means, such as a transfer blade or a transfer belt, or alternatively a non-contact corona transfer means. The contact transfer means is less liable to cause the occurrence of ozone.

Hereinbelow, the present invention will be described more specifically with reference to Examples, to which the present invention should not be however construed to be limited.

Table 1 below shows some examples of resins, Table 2 shows some waxes and Table 3 shows magnetic materials, respectively used in Examples described hereinafter.

Regarding Table 1, styrene-based resins (Binder resins A–G) were prepared by solution polymerization, and polyester resin (Binder resin H) was prepared by dehydro-polycondensation.

Regarding Table 3, Magnetic materials (i)–(v) were prepared as magnetite particles by adding salts of prescribed elements to be internally copresent, followed by pH control, more specifically by adding a silicate salt for Magnetic material (i), a silicate salt and an aluminum salt for Magnetic material (ii), a phosphate salt for Magnetic material (iii), a magnesium salt for Magnetic material (iv), a zinc salt to form nuclei of magnetite particles followed by addition of a silicate salt and pH control for Magnetic material (v), a phosphate salt to form nuclei of magnetite particles followed by addition of a silicate salt and pH control for Magnetic material (vi); no particular salt for Magnetic material (viii), and, after forming magnetic material (viii) as nuclei, adding a zirconium salt followed by pH control to precipitate zirconia for Magnetic material (vii).

TABLE 1

| Binder resins | | | | | | | |
|---|---|---|---|---|---|---|---|
| | | | Properties | | | | |
| | Monomer composition | | | Molecular weight | | | THF-insoluble |
| Binder resin | Monomers | wt. parts* (mol. %) | Acid value | Mw | Main peak | Sub-peak | content (wt. %) |
| A | styrene | 79.5 | 0.1 | 229000 | 19200 | 278000 | 0 |
| | n-butyl acrylate | 20.0 | | | | | |
| | divinylbenzene | 0.5 | | | | | |
| B | styrene | 79.0 | 1.7 | 207000 | 16800 | 245000 | 0 |
| | n-butyl acrylate | 80.0 | | | | | |
| | mono-n-butylmaleate | 0.5 | | | | | |
| | divinylbenzene | 0.5 | | | | | |
| C | styrene | 78.5 | 3.8 | 186000 | 14700 | 267000 | 0 |
| | n-butyl acrylate | 20.0 | | | | | |
| | mono-n-butylmaleate | 1.0 | | | | | |
| | divinylbenzene | 0.5 | | | | | |
| D | styrene | 75.5 | 13.2 | 165000 | 13100 | 235000 | 0 |
| | n-butyl acrylate | 20.0 | | | | | |
| | mono-n-butylmaleate | 4.0 | | | | | |
| | divinylbenzene | 0.5 | | | | | |
| E | styrene | 69.5 | 31.8 | 144000 | 11000 | 286000 | 0 |
| | n-butyl acrylate | 20.0 | | | | | |
| | mono-n-butylmaleate | 10.0 | | | | | |
| | divinylbenzene | 0.5 | | | | | |
| F | styrene | 72.5 | 44.8 | 133000 | 9200 | 228000 | 0 |
| | n-butyl acrylate | 20.0 | | | | | |
| | methacrylic acid | 7.0 | | | | | |
| | divinylbenzene | 0.5 | | | | | |
| G | styrene | 77.5 | 62.5 | 129000 | 7100 | 254000 | 0 |
| | n-butyl acrylate | 20.0 | | | | | |
| | acrylic acid | 8.0 | | | | | |
| | divinylbenzene | 0.5 | | | | | |
| H | terephthalic anhydride | (30) | 12.8 | 576000 | 7500 | — | 0 |
| | trimellitic acid | (5) | | | | | |
| | dodecenylsuccinic acid | (15) | | | | | |
| | propoxy-bisphenol A | (50) | | | | | |

*1: Mol % indication in parentheses is used only for monomers for Binder resin H.

TABLE 2

| Waxes | | |
|---|---|---|
| Wax | Material | Melting point (° C.) |
| (a) | polyethylene wax | 90 |
| (b) | polyethylene wax | 130 |
| (c) | polypropylene wax | 135 |
| (d) | styrene-modified polypropylene wax | 115 |
| (e) | maleic anhydride-modified poly-propylene wax | 125 |
| (f) | paraffin wax | 75 |
| (g) | Fischer-Tropsche wax | 80 |
| (h) | Fischer-Tropsche wax | 105 |
| (i) | Higher alcohol wax | 95 |
| (j) | Carnauba wax | 85 |

TABLE 3

| Magnetic materials | | | |
|---|---|---|---|
| | Different element | | |
| Magnetic material | species: content (wt. %) | Superficial* percentage | D1*2 (μm) |
| (i) | Si 2.0 | Si 31% | 0.19 |
| (ii) | Si 0.5/Al 0.5 | Si 18%/Al 95% | 0.21 |

TABLE 3-continued

| Magnetic materials | | | |
|---|---|---|---|
| | Different element | | |
| Magnetic material | species: content (wt. %) | Superficial* percentage | D1*2 (μm) |
| (iii) | P 0.5 | P 22% | 0.18 |
| (iv) | Mg 1.5 | Mg 27% | 0.23 |
| (v) | Zn 1.0/Si 1.5 | Si 37%/Zn 56% | 0.20 |
| (vi) | P 0.2/Si 1.0 | Si 33%/P 17% | 0.19 |
| (vii) | Zr 1.0 | Zr 100% | 0.21 |
| (viii) | — | — | 0.22 |

*1: A proportion of different element detected up to 20% dissolution of iron.
*2: D1 = Number-average particle size.

EXAMPLE 1

| | |
|---|---|
| Binder resin D | 100 wt. parts |
| Colorant (Magnetic material (i)) | 90 wt. parts |
| Organic zirconium compound (38) | 2 wt. parts |
| Wax (a) (m.p. = 90° C.) | 2 wt. parts |
| Wax (b) (m.p. = 135° C.) | 4 wt. parts |

The above ingredients were preliminarily blended by a Henschel mixer and then melt-kneaded through a twin-screw kneading extruder set at 130° C. During the melt-kneading, the viscosity of the kneaded mixture was gradually increased, whereby the formation of fresh crosslinkage was confirmed.

The thus-kneaded product was cooled, coarsely crushed by a cutter mill and finely pulverized by a pulverizer using a jet air stream, followed by classification by a multi-division classifier utilizing the Coanda effect to form a magnetic toner having a weight-average particle size (D4) of 7.5 μm. To 100 wt. parts of the magnetic toner, 1.0 wt. part of hydrophobic silica fine powder hydrophobized with 20 wt. % based on starting silica fine powder of hexamethyldisilazane and having a methanol-wettability of 65% and a BET specific surface area of 260 $m^2/g$ and 3.0 wt. parts of strontium titanate fine powder were externally blended to prepare Magnetic toner No. 1. Magnetic toner No. 1 exhibited D4=7.5 μm. Other properties of Magnetic toner No. 1 are shown in Table 5.

Magnetic toner No. 1 was evaluated by using a commercially available electrophotographic copying machine having a corona charging means ("NP-6085", mfd. by Canon K.K.) after remodeling for equipping a developing sleeve prepared by coating a sleeve substrate with a resinous coating layer (phenolic resin:graphite=3:1 by weight) first for continuous copying on 50,000 sheets in an environment of temperature of 23° C. and humidity of 5% RH and then for continuous copying on 50,000 sheets in an environment of 30° C./80% RH, i.e., on totally 100,000 sheets. The test was performed while removing the cleaning web for the fixing roller. The toner on the developing sleeve was provided with a negative triboelectric charge.

As a result, it was possible to obtain high-definition images having a high image density and free from fog in both environments. The results are shown in Table 6 and 7.

Separately, a similar continuous copying test was performed on 25,000 sheets in a normal temperature/normal humidity environment. The results are shown in Table 8.

The image density was measured by using a Macbeth densitometer (available from Macbeth Co.) equipped with an SPI filter for measurement of a reflection density with respect to a circular image of 5 mm in diameter.

The fog was determined by measuring a worst (maximum) reflection density Ds of a white background region after image formation and an average reflection density Dr of a transfer-receiving material (white plain paper) to calculate Ds-Dr as a fog value. A smaller value represents a better fog suppression effect.

The image quality was evaluated by copying dot images of 20 gradation levels having image proportions of 5–100% at increments of 5% each to evaluate the number of reproducible gradation levels. A larger number of reproducible gradation levels represents a higher definition copying performance.

The soiling of the fixing member was evaluated according to the following standard:

A: No soiling on the fixing member.

B: Slight soiling on the fixing member.

C: Soiling on the fixing member was observed but no adverse effect was observed on the images.

D: The fixing member was soiled, and offset was observed in the resultant images.

After the 50,000 sheets of continuous image formation in the high temperature/high humidity (30° C./80% RH) environment, the copying apparatus was left standing in the environment for three days, and then some images were formed again to measure the image density.

In the continuous image formation in the normal temperature/low humidity (23° C./5% RH) environment, the resultant images were evaluated with respect to the presence or absence of image defects due to soiling of the wire according to the following standard.

A: No image defects.

B: Some defect observed in a halftone image.

C: Some defect observed in a solid image.

D: Defects were observed even in ordinary image.

EXAMPLES 2–14

Magnetic toners Nos. 2–14 were prepared according to prescriptions shown in Table 4 otherwise in a similar manner as in Example 1 and evaluated in the same manner as in Example 1. The properties of the respective magnetic toners are shown in Table 5, and the evaluation results are shown in Tables 6–8.

Comparative Examples 1–4

Magnetic toners Nos. 15–18 were prepared in the same manner as in Example 1 except for using the following Organic zinc compound (172), Organic iron compound (173), Organic aluminum compound (174) and Organic chromium compound (175), respectively, in place of Organic zirconium compound (38), and then evaluated in the same manner as in Example 1. The prescriptions and properties of the respective magnetic toners are shown in Tables 4 and 5, and the evaluation results are shown in Tables 6–8.

In the following formulae (172)–(175), coordinating water molecules are omitted from showing.

(172)

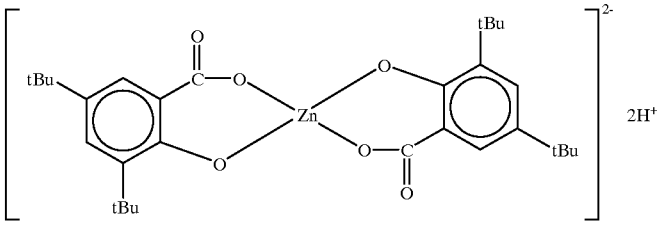

-continued (173)

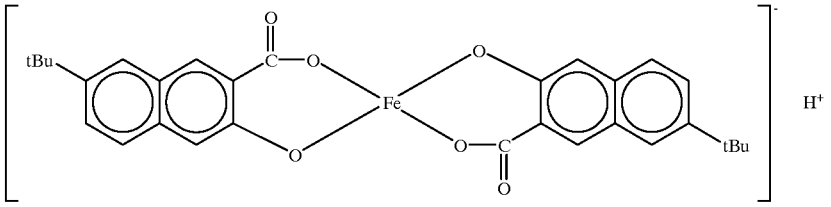

(174)

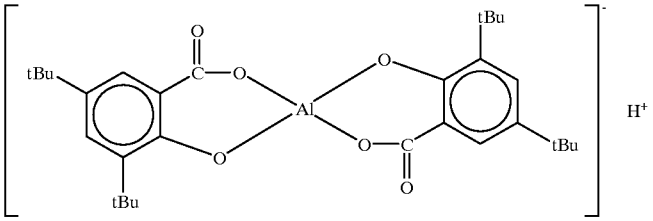

(175)

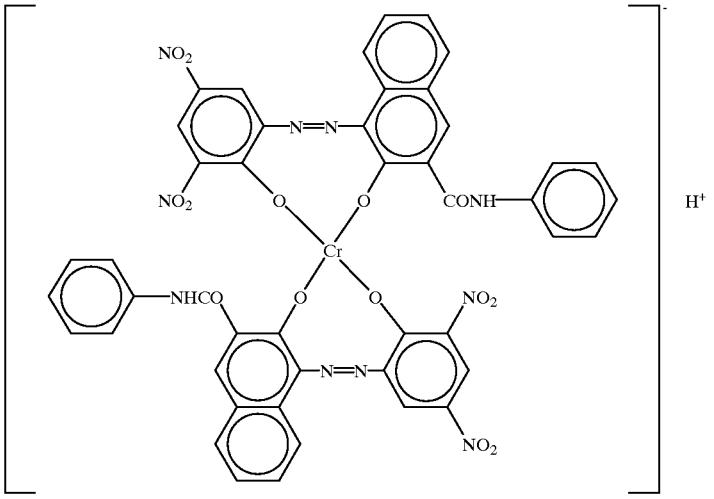

Comparative Examples 5–8

Magnetic toners Nos. 19–22 were prepared in the same manner as in Example 8 except for using the above Organic zinc compound (172), Organic iron compound (173), Organic aluminum compound (174) and Organic chromium compound (175), respectively, in place of Organic zirconium compound (88), and then evaluated in the same manner as in Example 1. The prescriptions and properties of the respective magnetic toners are shown in Tables 4 and 5, and the evaluation results are shown in Tables 6–8.

TABLE 4

| | Toner prescriptions | | | | |
|---|---|---|---|---|---|
| | Magnetic toner Nos. | Organic metal compound (wt. parts) | Binder resin (wt. parts) | Magnetic material (wt. parts) | Wax (wt. parts) |
| Ex. 1 | 1 | 38(2) | D(100) | i(90) | a(2)/c(4) |
| Ex. 2 | 2 | 63(2) | C(100) | ii(90) | a(3)/b(3) |
| Ex. 3 | 3 | 83(2) | B(100) | iii(90) | d(4)/h(2) |
| Ex. 4 | 4 | 116(2) | E(100) | iv(90) | e(3)/g(3) |
| Ex. 5 | 5 | 130(2) | F(100) | v(90) | f(4)/h(2) |
| Ex. 6 | 6 | 46(2) | G(100) | vi(90) | c(3)/j(3) |
| Ex. 7 | 7 | 77(2) | D(100) | vii(90) | h(2)/i(4) |

TABLE 4-continued

| | Toner prescriptions | | | | |
|---|---|---|---|---|---|
| | Magnetic toner Nos. | Organic metal compound (wt. parts) | Binder resin (wt. parts) | Magnetic material (wt. parts) | Wax (wt. parts) |
| Ex. 8 | 8 | 88(2) | A(100) | i(90) | b(3)/c(3) |
| Ex. 9 | 9 | 124(2) | D(100) | viii(90) | b(2)/f(4) |
| Ex. 10 | 10 | 154(2) | D(100) | ii(90) | c(6) |
| Ex. 11 | 11 | 162(2) | E(100) | v(90) | f(3)/h(5) |
| Ex. 12 | 12 | 144(2) | E(100) | v(90) | f(3)/h(5) |
| Ex. 13 | 13 | 167(2) | E(100) | v(90) | f(3)/h(5) |
| Ex. 14 | 14 | 133(2) | E(100) | v(90) | f(3)/h(5) |
| Comp. Ex. 1 | 15 | 172(2) | D(100) | i(90) | a(2)/c(4) |
| Comp. Ex. 2 | 16 | 173(2) | D(100) | i(90) | a(2)/c(4) |
| Comp. Ex. 3 | 17 | 174(2) | D(100) | i(90) | a(2)/c(4) |
| Comp. Ex. 4 | 18 | 175(2) | D(100) | i(90) | a(2)/c(4) |
| Comp. Ex. 5 | 19 | 172(2) | A(100) | i(90) | b(3)/c(3) |
| Comp. Ex. 6 | 20 | 173(2) | A(100) | i(90) | b(3)/c(3) |

TABLE 4-continued

| Toner prescriptions | | | | | |
|---|---|---|---|---|---|
| | Magnetic toner Nos. | Organic metal compound (wt. parts) | Binder resin (wt. parts) | Magnetic material (wt. parts) | Wax (wt. parts) |
| Comp. Ex. 7 | 21 | 174(2) | A(100) | i(90) | b(3)/c(3) |
| Comp. Ex. 8 | 22 | 175(2) | A(100) | i(90) | b(3)/c(3) |

TABLE 5

| Toner properties | | | | | | | | | |
|---|---|---|---|---|---|---|---|---|---|
| | Magnetic toner No. | D4 (μm) | Acid (mgKOH/g) | Molecular weight distribution Mw | Main peak | Sub-peak | $\leqq 10^5$ (%) | DSC (° C.) main peak | THF-insoluble content (wt. %) |
| Ex. 1 | 1 | 7.5 | 11.9 | 124000 | 12800 | 2170000 | 82 | 90 | 24 |
| Ex. 2 | 2 | 7.4 | 2.6 | 357000 | 14200 | 289000 | 79 | 91 | 14 |
| Ex. 3 | 3 | 7.6 | 1.5 | 189000 | 16500 | 249000 | 74 | 11.4 | 8 |
| Ex. 4 | 4 | 7.3 | 25.4 | 77600 | 10700 | 2580000 | 88 | 81 | 38 |
| Ex. 5 | 5 | 7.7 | 34.6 | 18000 | 8800 | — | 94 | 76 | 46 |
| Ex. 6 | 6 | 7.2 | 43.1 | 14800 | 6900 | — | 96 | 86 | 55 |
| Ex. 7 | 7 | 7.5 | 11.8 | 113000 | 12500 | 2280000 | 81 | 96 | 27 |
| Ex. 8 | 8 | 7.1 | 0.1 | 218000 | 18700 | 257000 | 68 | 130 | 0 |
| Ex. 9 | 9 | 7.3 | 11.2 | 125000 | 12600 | 2070000 | 83 | 74 | 23 |
| Ex. 10 | 10 | 7.6 | 11.7 | 123000 | 12700 | 2430000 | 82 | 135 | 21 |
| Ex. 11 | 11 | 7.8 | 25.5 | 85600 | 10600 | 2450000 | 89 | 78 | 39 |
| Ex. 12 | 12 | 7.4 | 25.7 | 82800 | 10500 | 2360000 | 88 | 79 | 37 |
| Ex. 13 | 13 | 7.9 | 26.3 | 79600 | 10700 | 2470000 | 89 | 78 | 33 |
| Ex. 14 | 14 | 7.2 | 26.8 | 91300 | 10800 | 2180000 | 89 | 79 | 30 |
| Comp. Ex. 1 | 15 | 7.4 | 12.8 | 195000 | 12700 | 289000 | 78 | 90 | 6 |
| Comp. Ex. 2 | 16 | 7.5 | 11.8 | 184000 | 12900 | 267000 | 77 | 91 | 9 |
| Comp. Ex. 3 | 17 | 7.3 | 11.5 | 118000 | 12800 | 3480000 | 84 | 91 | 26 |
| Comp. Ex. 4 | 18 | 7.6 | 13.0 | 169000 | 13000 | 241000 | 76 | 90 | 1 |
| Comp. Ex. 5 | 19 | 7.2 | 0.1 | 219000 | 18900 | 256000 | 67 | 130 | 0 |
| Comp. Ex. 6 | 20 | 7.1 | 0.1 | 223000 | 19000 | 248000 | 69 | 129 | 0 |
| Comp. Ex. 7 | 21 | 7.6 | 0.1 | 221000 | 18800 | 246000 | 68 | 129 | 0 |
| Comp. Ex. 8 | 22 | 7.4 | 0.1 | 224000 | 18800 | 251000 | 68 | 130 | 0 |

TABLE 6

| Evaluation results in NT/LH (23° C./5% RH) | | | | | | |
|---|---|---|---|---|---|---|
| | Magnetic toner No. | Image density | Fog | Image quality | Soiling* | Image defect |
| Ex. 1 | 1 | 1.41–1.44 | 0.4–0.6 | 17–19 | A | A |
| Ex. 2 | 2 | 1.42–1.45 | 0.3–0.7 | 17–19 | A | B |
| Ex. 3 | 3 | 1.40–1.46 | 0.4–0.6 | 17–19 | A | B |
| Ex. 4 | 4 | 1.38–1.41 | 0.5–0.8 | 17–18 | A | A |
| Ex. 5 | 5 | 1.37–1.42 | 0.5–0.7 | 17–18 | A | A |
| Ex. 6 | 6 | 1.35–1.39 | 0.6–0.8 | 17–19 | A | A |
| Ex. 7 | 7 | 1.40–1.45 | 0.4–0.8 | 17–19 | A | B |
| Ex. 8 | 8 | 1.33–1.34 | 0.6–0.9 | 16–18 | B | B |
| Ex. 9 | 9 | 1.36–1.39 | 0.4–0.8 | 16–18 | A | A |
| Ex. 10 | 10 | 1.36–1.38 | 0.5–0.8 | 17–18 | B | A |
| Ex. 11 | 11 | 1.42–1.45 | 0.3–0.5 | 17–19 | A | A |
| Ex. 12 | 12 | 1.42–1.44 | 0.4–0.5 | 17–19 | A | A |
| Ex. 13 | 13 | 1.38–1.41 | 0.5–0.7 | 17–18 | A | A |

TABLE 6-continued

| Evaluation results in NT/LH (23° C./5% RH) | | | | | | |
|---|---|---|---|---|---|---|
| | Magnetic toner No. | Image density | Fog | Image quality | Soiling* | Image defect |
| Ex. 14 | 14 | 1.37–1.40 | 0.5–0.6 | 17–18 | A | A |
| Comp. Ex. 1 | 15 | 1.32–1.34 | 0.5–1.0 | 15–17 | A | C |
| Comp. Ex. 2 | 16 | 1.30–1.33 | 0.4–1.1 | 15–17 | A | C |

TABLE 6-continued

| Evaluation results in NT/LH (23° C./5% RH) | | | | | | |
|---|---|---|---|---|---|---|
| | Magnetic toner No. | Image density | Fog | Image quality | Soiling* | Image defect |
| Comp. Ex. 3 | 17 | 1.33–1.35 | 0.5–1.2 | 16–17 | A | C |
| Comp. Ex. 4 | 18 | 1.34–1.35 | 0.4–1.0 | 16–17 | B | C |
| Comp. Ex. 5 | 19 | 1.30–1.32 | 0.7–1.2 | 15–17 | B | 0 |
| Comp. Ex. 6 | 20 | 1.31–1.33 | 0.8–1.5 | 15–17 | B | 0 |
| Comp. Ex. 7 | 21 | 1.30–1.34 | 0.6–1.3 | 15–18 | B | 0 |
| Comp. Ex. 8 | 22 | 1.31–1.33 | 0.8–1.2 | 15–18 | C | 0 |

*Soiling of fixing member

TABLE 7

| | Evaluation in HT/HH (30° C./80% RH) | | | | | |
|---|---|---|---|---|---|---|
| | Magnetic toner No. | Image density | Fog | Image standing | Soiling* | Image density after-defect |
| Ex. 1 | 1 | 1.40–1.41 | 0.2–0.4 | 17–18 | A | 1.35 |
| Ex. 2 | 2 | 1.40–1.42 | 0.3–0.5 | 17–18 | A | 1.36 |
| Ex. 3 | 3 | 1.40–1.41 | 0.2–0.6 | 17–18 | A | 1.35 |
| Ex. 4 | 4 | 1.36–1.40 | 0.4–0.7 | 17 | A | 1.30 |
| Ex. 5 | 5 | 1.37–1.40 | 0.3–0.6 | 17 | A | 1.31 |
| Ex. 6 | 6 | 1.34–1.38 | 0.6–0.8 | 17–18 | A | 1.28 |
| Ex. 7 | 7 | 1.40–1.42 | 0.3–0.7 | 17–18 | A | 1.35 |
| Ex. 8 | 8 | 1.32–1.34 | 0.7–0.9 | 16 | B | 1.24 |
| Ex. 9 | 9 | 1.35–1.38 | 0.5–0.7 | 16–17 | A | 1.28 |
| Ex. 10 | 10 | 1.36–1.39 | 0.3–0.5 | 17 | B | 1.27 |
| Ex. 11 | 11 | 1.41–1.42 | 0.2–0.3 | 17–18 | A | 1.36 |
| Ex. 12 | 12 | 1.40–1.42 | 0.3–0.4 | 17–18 | A | 1.34 |
| Ex. 13 | 13 | 1.38–1.39 | 0.4–0.6 | 17 | A | 1.28 |
| Ex. 14 | 14 | 1.37–1.39 | 0.5–0.6 | 17 | A | 1.28 |
| Comp. Ex. 1 | 15 | 1.28–1.38 | 0.2–1.2 | 15–16 | A | 1.14 |
| Comp. Ex. 2 | 16 | 1.29–1.32 | 0.3–1.4 | 15–16 | A | 1.12 |

TABLE 7-continued

| | Evaluation in HT/HH (30° C./80% RH) | | | | | |
|---|---|---|---|---|---|---|
| | Magnetic toner No. | Image density | Fog | Image standing | Soiling* | Image density after-defect |
| Comp. Ex. 3 | 17 | 1.27–1.34 | 0.5–1.6 | 15 | A | 1.15 |
| Comp. Ex. 4 | 18 | 1.29–1.33 | 0.4–1.4 | 15 | B | 1.ll |
| Comp. Ex. 5 | 29 | 1.28–1.33 | 0.5–1.5 | 15–16 | B | 1.06 |
| Comp. Ex. 6 | 20 | 1.27–1.32 | 0.6–1.6 | 15–16 | B | 1.03 |
| Comp. Ex. 7 | 21 | 1.28–1.33 | 0.5–1.7 | 15–16 | B | 1.07 |
| Comp. Ex. 8 | 22 | 1.29–1.32 | 0.6–1.5 | 15–16 | C | 1.05 |

*Soiling of fixing member

TABLE 8

| | Evaluation in NT/NH (23° C./60% RH) | | | | | | | | |
|---|---|---|---|---|---|---|---|---|---|
| | | Image density | | Fog | | Image quality | | Soiling | Fixable |
| | Magnetic toner No. | Initial | After 50000 sheets | Initial | After 50000 sheets | Initial | After 50000 sheets | after 50000 sheets | temp. range (° C.) |
| Ex. 1 | 1 | 1.41 | 1.42 | 0.5 | 0.5 | 20 | 19 | A | 160–235 |
| Ex. 2 | 2 | 1.42 | 1.42 | 0.4 | 0.5 | 19 | 20 | A | 160–230 |
| Ex. 3 | 3 | 1.43 | 1.42 | 0.5 | 0.4 | 19 | 19 | A | 165–225 |
| Ex. 4 | 4 | 1.38 | 1.40 | 0.5 | 0.6 | 18 | 19 | A | 160–240 |
| Ex. 5 | 5 | 1.39 | 1.40 | 0.7 | 0.5 | 19 | 18 | A | 165–240 |
| Ex. 6 | 6 | 1.34 | 1.37 | 0.5 | 0.8 | 19 | 18 | A | 165–240 |
| Ex. 7 | 7 | 1.40 | 1.40 | 0.7 | 0.4 | 18 | 18 | A | 160–235 |
| Ex. 8 | 8 | 1.31 | 1.34 | 0.8 | 0.7 | 18 | 17 | B | 170–210 |
| Ex. 9 | 9 | 1.34 | 1.38 | 0.7 | 0.6 | 17 | 18 | A | 160–235 |
| Ex. 10 | 10 | 1.36 | 1.35 | 0.7 | 0.8 | 18 | 17 | B | 160–235 |
| Ex. 11 | 11 | 1.43 | 1.44 | 0.3 | 0.4 | 20 | 19 | A | 160–240 |
| Ex. 12 | 12 | 1.42 | 1.41 | 0.3 | 0.5 | 20 | 19 | A | 160–240 |
| Ex. 13 | 13 | 1.43 | 1.42 | 0.4 | 0.3 | 19 | 20 | A | 160–240 |
| Ex. 14 | 14 | 1.42 | 1.44 | 0.5 | 0.3 | 20 | 19 | A | 160–240 |
| Comp. Ex. 1 | 15 | 1.27 | 1.32 | 0.9 | 0.8 | 17 | 16 | A | 160–225 |
| Comp. Ex. 2 | 16 | 1.27 | 1.33 | 1.0 | 0.9 | 18 | 16 | A | 160–225 |
| Comp. Ex. 3 | 17 | 1.28 | 1.34 | 1.0 | 0.7 | 17 | 16 | A | 165–230 |
| Comp. Ex. 4 | 18 | 1.29 | 1.33 | 0.9 | 1.0 | 17 | 16 | B | 160–215 |
| Comp. Ex. 5 | 19 | 1.27 | 1.30 | 1.1 | 1.0 | 18 | 15 | B | 170–210 |
| Comp. Ex. 6 | 20 | 1.26 | 1.29 | 1.0 | 1.0 | 16 | 15 | B | 170–210 |

TABLE 8-continued

| | | Evaluation in NT/NH (23° C./60% RH) | | | | | | | |
|---|---|---|---|---|---|---|---|---|---|
| | | Image density | | Fog | | Image quality | | Soiling | Fixable |
| | Magnetic toner No. | Initial | After 50000 sheets | Initial | After 50000 sheets | Initial | After 50000 sheets | after 50000 sheets | temp. range (° C.) |
| Comp. Ex. 7 | 21 | 1.28 | 1.32 | 1.2 | 1.0 | 17 | 15 | B | 170–210 |
| Comp. Ex. 8 | 22 | 1.27 | 1.29 | 1.3 | 1.1 | 15 | 17 | C | 170–210 |

The fixable temperature range (° C.) shown in Table 8 for Examples 1–14 and Comparative Examples 1–8 was measured in the following manner.

The fixing device of a commercially available copying machine ("NP-6085", mfd. by Canon K. K.) also used in the above Examples was taken out of the main body and remodeled so as to be able to arbitrarily set the fixing temperature and provide a process speed of 500 mm/sec, thereby providing an external fixing device. By using the external fixing device, yet-unfixed toner images on plain paper of 80 g/m$^2$ were subjected to evaluation of the fixability. By setting the fixing temperatures in the range of 150–200° C. at increments of 5° C. each, fixed images at the respective temperatures were rubbed for 5 reciprocations with a lens cleaning paper under a load of 4.9 kPa to determine the lowest fixing temperature giving an image density lowering after rubbing of at most 10% as a fixing initiation temperature. A lower fixing initiation temperature indicates a better fixability.

On the other hand, an external fixing device having a set process speed of 100 mm/sec was used to fix yet-unfixed images on plain paper of 60 g/m$^2$, thereby evaluating the anti-offset characteristic. For the evaluation, the fixing temperatures were set by increments of 5° C. each in a temperature range of 190–240° C., and the offset behavior was observed to determine a highest non-offset temperature as a measure of anti-offset characteristic. A higher highest non-offset temperature represents a better anti-offset characteristic.

The above evaluations were both performed in an environment of normal temperature/normal humidity (23° C./60% RH). A fixable temperature range was defined between the fixing initiation temperature and the highest non-offset temperature. A broader fixable temperature range represents a better fixing performance of a toner. In the evaluation test described above, the measurement conditions (i.e., paper species and process speeds) were made different between the measurement of the fixing initiation temperature and the highest non-offset temperature. This is a severer evaluation condition, so that a broader fixable temperature can be obtained under actual fixing conditions where the toner and higher limits of the fixable temperature range are measured under identical fixing conditions (paper and process speed).

EXAMPLE 15

| | |
|---|---|
| Binder resin C | 100 wt. parts |
| Colorant (Magnetic material (i)) | 100 wt. parts |

-continued

| | |
|---|---|
| Organic zirconium compound (39) | 2 wt. parts |
| Wax (b) (m.p. = 130° C.) | 2 wt. parts |
| Wax (d) (m.p. = 115° C.) | 4 wt. parts |

The above ingredients were preliminarily blended by a Henschel mixer and then melt-kneaded through a twin-screw kneading extruder set at 130° C. During the melt-kneading, the viscosity of the kneaded mixture was gradually increased, whereby the formation of fresh crosslinkage was confirmed.

The thus-kneaded product was cooled, coarsely crushed by a cutter mill and finely pulverized by a pulverizer using a jet air stream, followed by classification by a multi-division classifier utilizing the Coanda effect to form a magnetic toner having a weight-average particle size (D4) of 6.5 μm. To 100 wt. parts of the magnetic toner, 1.2 wt. parts of hydrophobic silica fine powder hydrophobized with 10 wt. % of hexamethyldisilazane and 10 wt. % of dimethylsilicone to have a methanol-wettability of 80% and a BET specific surface area of 120 m$^2$/g was externally blended to prepare Magnetic toner No. 23. Magnetic toner No. 23 exhibited D4=6.5 μm. Other properties of Magnetic toner No. 23 are shown in Table 10.

Magnetic toner No. 23 was evaluated by using a commercially available laser beam printer of a contact charging scheme using a charging roller ("LBP-430", mfd. by Canon K. K.) for continuous printing on 4,000 sheets, respectively, in an environment of 23° C./5% RH and in an environment of 30° C./80% RH. The toner on the developing sleeve was provided with a negative triboelectric charge. As a result, it was possible to obtain high-definition images having a high image density and free from fog in both environments. The evaluation results are shown in Tables 11 and 12. Further, a similar continuous printing test on 4000 sheets was performed in a normal temperature/normal humidity environment. The results are shown in Table 13.

The image quality was evaluated by printing 100 discrete dots each in a size of vertically ca. 80 μm and laterally ca. 70 μm arranged in 10 (rows)×10 (columns) with a spacing between adjacent dots of vertically ca. 80 μm and laterally ca. 70 μm and by counting the number of dots securely reproduced with an areal reproduction percentage of at least 60%. The 100 discrete dots were printed at three points on an A4-size sheet along a longitudinal center line, i.e., proximity to near end and far end and a mid point along the center line. The image quality was evaluated by number of reproduced dots per 100 dots on an average of the three points. A larger number indicates a higher image quality.

After the 4000 sheets of continuous image formation in the environment of 30° C./80% RH, the printer was left standing in the environment for 3 days, and then images were formed to measure the image density.

In the continuous printing test in the environment of 23° C./5% RH, the presence or absence of reverse side soiling (soiling on a side of paper opposite to the image forming side) due to toner scattering was evaluated according to the following standard:

A: No reverse side soiling.

B: Reverse side soiling was rare and slight but observed.

C: Slight reverse side soiling was observed on some sheets.

C: Remarkable reverse side soiling was observed on some sheets.

EXAMPLES 16–25

Magnetic toners Nos. 24–33 were prepared according to prescriptions shown in Table 9 otherwise in a similar manner as in Example 15 and evaluated in the same manner as in Example 15. The properties of the respective magnetic toners are shown in Table 10, and the evaluation results are shown in Tables 11–13.

Comparative Examples 9–12

Magnetic toners Nos. 34–37 were prepared in the same manner as in Example 15 except for using the above-described Organic zinc compound (172), Organic iron compound (173), Organic aluminum compound (174) and Organic chromium compound (175), respectively, in place of Organic zirconium compound (39), and then evaluated in the same manner as in Example 15. The prescriptions and properties of the respective magnetic toners are shown in Tables 9 and 10, and the evaluation results are shown in Tables 11–13.

Comparative Examples 13–16

Magnetic toners Nos. 38–41 were prepared in the same manner as in Example 22 except for using the above-described Organic zinc compound (172), Organic iron compound (173), Organic aluminum compound (174) and Organic chromium compound (175), respectively, in place of Organic zirconium compound (51), and then evaluated in the same manner as in Example 15. The prescriptions and properties of the respective magnetic toners are shown in Tables 9 and 10, and the evaluation results are shown in Tables 11–13.

Comparative Examples 17–20

Magnetic toners Nos. 42–45 were prepared in the same manner as in Example 23 except for using the above-described Organic zinc compound (172), Organic iron compound (173), Organic aluminum compound (174) and Organic chromium compound (175), respectively, in place of Organic zirconium compound (74), and then evaluated in the same manner as in Example 15. The prescriptions and properties of the respective magnetic toners are shown in Tables 9 and 10, and the evaluation results are shown in Tables 11–13.

TABLE 9

| | Toner prescriptions | | | | |
|---|---|---|---|---|---|
| | Magnetic toner Nos. | Organic metal compound (wt. parts) | Binder resin (wt. parts) | Magnetic material (wt. parts) | Wax (wt. parts) |
| Ex. 15 | 23 | 39(2) | C(100) | i(100) | b(2)/d(4) |
| Ex. 16 | 24 | 64(2) | B(100) | ii(100) | g(4)/h(2) |
| Ex. 17 | 25 | 89(2) | D(100) | iii(100) | h(2)/1(4) |
| Ex. 18 | 26 | 49(2) | E(100) | iv(100) | b(2)/i(4) |
| Ex. 19 | 27 | 98(2) | F(100) | v(100) | c(3)/f(3) |
| Ex. 20 | 28 | 121(2) | H(100) | vi(100) | a(3)/d(3) |
| Ex. 21 | 29 | 141(2) | C(100) | vii(100) | e(3)/f(3) |
| Ex. 22 | 30 | 51(2) | C(100) | viii(100) | c(6) |
| Ex. 23 | 31 | 74(2) | A(100) | i(100) | c(6) |
| Ex. 24 | 30 | 57(2) | A(100) | viii(100) | b(2)/d(4) |
| Ex. 25 | 33 | 100(2) | A(100) | viii(100) | b(6) |
| Comp. Ex. 9 | 34 | 172(2) | C(100) | i(100) | b(2)/d(4) |
| Comp. Ex. 10 | 35 | 173(2) | C(100) | i(100) | b(2)/d(4) |
| Comp. Ex. 11 | 36 | 174(2) | C(100) | i(100) | b(2)/d(4) |
| Comp. Ex. 12 | 37 | 175(2) | C(100) | i(100) | b(2)/d(4) |
| Comp. Ex. 13 | 38 | 172(2) | C(100) | viii(100) | c(6) |
| Comp. Ex. 14 | 39 | 173(2) | C(100) | viii(100) | c(6) |
| Comp. Ex. 15 | 40 | 174(2) | C(100) | viii(100) | c(6) |
| Comp. Ex. 16 | 41 | 175(2) | C(100) | viii(100) | c(6) |
| Comp. Ex. 17 | 42 | 172(2) | A(100) | i(100) | c(6) |
| Comp. Ex. 18 | 43 | 173(2) | A(100) | i(100) | c(6) |
| Comp. Ex. 19 | 44 | 174(2) | A(100) | i(100) | c(6) |
| Comp. Ex. 20 | 45 | 175(2) | A(100) | i(100) | c(6) |

TABLE 10

| | Toner properties | | | | | | | | |
|---|---|---|---|---|---|---|---|---|---|
| | Magnetic | | | Molecular weight distribution | | | | DSC (° C.) | THF-insoluble |
| | toner No. | D4 (μm) | Acid (mgKOH/g) | Mw | Main peak | Sub-peak | ≦$10^5$ (%) | main peak | content (wt. %) |
| Ex. 15 | 23 | 6.5 | 2.7 | 349000 | 14500 | 257000 | 83 | 116 | 9 |
| Ex. 16 | 24 | 6.4 | 1.6 | 175000 | 16300 | 244000 | 75 | 81 | 5 |
| Ex. 17 | 25 | 6.4 | 11.5 | 119000 | 12600 | 1640000 | 80 | 84 | 18 |
| Ex. 18 | 26 | 6.6 | 27.1 | 81300 | 10100 | 2763000 | 90 | 95 | 26 |
| Ex. 19 | 27 | 6.3 | 35.2 | 17900 | 8900 | — | 95 | 75 | 41 |
| Ex. 20 | 28 | 6.7 | 11.4 | 116000 | 7400 | — | 85 | 91 | 8 |

TABLE 10-continued

| | Toner properties | | | | | | | | |
|---|---|---|---|---|---|---|---|---|---|
| | Magnetic | | | Molecular weight distribution | | | | DSC (° C.) | THF-insoluble |
| | toner No. | D4 (μm) | Acid (mgKOH/g) | Mw | Main peak | Sub-peak | ≦$10^5$ (%) | main peak | content (wt. %) |
| Ex. 21 | 29 | 6.5 | 2.4 | 358000 | 14400 | 264000 | 84 | 76 | 12 |
| Ex. 22 | 30 | 6.8 | 2.6 | 361000 | 14500 | 258000 | 86 | 135 | 14 |
| Ex. 23 | 31 | 6.9 | 0.1 | 209000 | 18800 | 248000 | 69 | 134 | 0 |
| Ex. 24 | 32 | 6.1 | 0.1 | 213000 | 18700 | 245000 | 68 | 116 | 0 |
| Ex. 25 | 33 | 6.2 | 0.1 | 221000 | 18900 | 239000 | 69 | 135 | 0 |
| Comp. Ex. 9 | 34 | 6.4 | 2.9 | 164000 | 14600 | 258000 | 72 | 115 | 4 |
| Comp. Ex. 10 | 35 | 6.3 | 2.8 | 167000 | 14400 | 261000 | 73 | 114 | 3 |
| Comp. Ex. 11 | 36 | 6.4 | 2.9 | 325000 | 14200 | 287000 | 79 | 115 | 11 |
| Comp. Ex. 12 | 37 | 6.5 | 3.0 | 167000 | 14300 | 263000 | 72 | 115 | 0 |
| Comp. Ex. 13 | 38 | 6.6 | 2.8 | 169000 | 14500 | 28000 | 71 | 135 | 4 |
| Comp. Ex. 14 | 39 | 6.5 | 2.9 | 171000 | 14500 | 257000 | 73 | 134 | 5 |
| Comp. Ex. 15 | 40 | 6.4 | 2.8 | 318000 | 14400 | 274000 | 80 | 135 | 12 |
| Comp. Ex. 16 | 41 | 6.3 | 3.1 | 185000 | 14600 | 259000 | 73 | 135 | 0 |
| Comp. Ex. 17 | 42 | 6.7 | 0.1 | 220000 | 18800 | 249000 | 69 | 134 | 0 |
| Comp. Ex. 18 | 43 | 6.8 | 0.1 | 209000 | 19000 | 251000 | 68 | 135 | 0 |
| Comp. Ex. 19 | 44 | 6.1 | 0.1 | 218000 | 18900 | 248000 | 69 | 136 | 0 |
| Comp. Ex. 20 | 45 | 6.2 | 0.1 | 213000 | 19100 | 247000 | 69 | 135 | 0 |

TABLE 11

| | Evaluation results in NT/LH (23° C./5% RH) | | | | | |
|---|---|---|---|---|---|---|
| | Magnetic toner No. | Image density | Fog | Image quality | Soiling* | Image defect |
| Ex. 15 | 23 | 1.42–1.45 | 0.5–0.9 | 96–100 | A | A |
| Ex. 16 | 24 | 1.41–1.44 | 0.6–0.8 | 96–100 | A | B |
| Ex. 17 | 25 | 1.40–1.43 | 0.5–0.8 | 97–100 | A | B |
| Ex. 18 | 26 | 1.41–1.44 | 0.6–0.9 | 96–100 | A | A |
| Ex. 19 | 27 | 1.42–1.45 | 0.6–0.8 | 97–100 | A | B |
| Ex. 20 | 28 | 1.39–1.42 | 0.7–1.2 | 93–98 | A | A |
| Ex. 21 | 29 | 1.38–1.41 | 0.8–1.1 | 92–98 | A | A |
| Ex. 22 | 30 | 1.37–1.39 | 1.0–1.2 | 92–94 | B | A |
| Ex. 23 | 31 | 1.35–1.37 | 1.2–1.4 | 91–94 | C | B |
| Ex. 24 | 32 | 1.35–1.36 | 1.3–1.4 | 89–93 | B | A |
| Ex. 25 | 33 | 1.33–1.34 | 1.5–1.7 | 88–94 | C | B |
| Comp. Ex. 10 | 35 | 1.29–1.34 | 1.5–1.9 | 87–91 | B | C |
| Comp Ex. 11 | 36 | 1.29–1.33 | 1.6–1.9 | 86–92 | B | C |
| Comp. Ex. 12 | 37 | 1.30–1.34 | 1.8–2.0 | 89–93 | C | C |
| Comp. Ex. 13 | 38 | 1.25–1.32 | 1.4–2.4 | 84–89 | C | C |
| Comp. Ex. 14 | 39 | 1.26–I.33 | 1.5–2.5 | 85–88 | C | C |
| Comp. Ex. 15 | 40 | 1.27–1.34 | 1.3–2.5 | 85–87 | C | C |
| Comp. Ex. 16 | 41 | 1.28–1.32 | 1.5–2.4 | 84–89 | C | C |
| Comp. Ex. 17 | 42 | 1.28–1.31 | 1.4–2.0 | 86–89 | D | D |
| Comp. Ex. 18 | 43 | 1.29–1.32 | 1.7–2.1 | 87–90 | D | D |

TABLE 11-continued

| | Evaluation results in NT/LH (23° C./5% RH) | | | | | |
|---|---|---|---|---|---|---|
| | Magnetic toner No. | Image density | Fog | Image quality | Soiling* | Image defect |
| Comp. Ex. 19 | 44 | 1.29–1.33 | 1.6–2.0 | 88–91 | D | D |
| Comp. Ex. 20 | 45 | 1.31–1.32 | 1.6–2.0 | 86–90 | D | D |

*Soiling of fixing member

TABLE 12

| | Evaluation results in NT/LH (23° C./5% RH) | | | | | |
|---|---|---|---|---|---|---|
| | Magnetic toner No. | Image density | Fog | Image standing | Soiling* | Image density after-defect |
| Ex. 15 | 23 | 1.40–1.44 | 0.4–0.8 | 94–100 | A | A |
| Ex. 16 | 24 | 1.41–1.43 | 0.4–0.8 | 94–100 | A | 1.38 |
| Ex. 17 | 25 | 1.40–1.42 | 0.5–0.7 | 93–100 | A | 1.37 |
| Ex. 18 | 26 | 1.40–1.42 | 0.6–0.7 | 94–100 | A | 1.38 |
| Ex. 19 | 27 | 1.41–1.43 | 0.4–0.8 | 95–100 | A | 1.38 |
| Ex. 20 | 28 | 1.37–1.40 | 0.7–1.0 | 91–98 | A | 1.34 |
| Ex. 21 | 29 | 1.36–1.40 | 0.8–0.9 | 90–98 | A | 1.32 |
| Ex. 22 | 30 | 1.34–1.37 | 1.0–1.1 | 91–94 | B | 1.30 |
| Ex. 23 | 31 | 1.33–1.35 | 1.2–1.2 | 90–94 | C | 1.27 |
| Ex. 24 | 32 | 1.32–1.35 | 1.0–1.4 | 89–92 | B | 1.25 |
| Ex. 25 | 33 | 1.30–1.32 | 1.5–1.6 | 88–92 | C | 1.23 |
| Comp. Ex. 9 | 34 | 1.28–1.31 | 1.8–2.0 | 87–90 | B | 1.18 |

TABLE 12-continued

| | Evaluation results in NT/LH (23° C./5% RH) | | | | | |
|---|---|---|---|---|---|---|
| | Magnetic toner No. | Image density | Fog | Image standing | Soiling* | Image density after-defect |
| Comp. Ex. 10 | 35 | 1.29–1.32 | 1.5–2.2 | 86–91 | B | 1.19 |
| Comp. Ex. 11 | 36 | 1.28–1.33 | 1.6–2.1 | 87–90 | B | 1.17 |
| Comp. Ex. 12 | 37 | 1.27–1.31 | 1.7–2.1 | 87–90 | C | 1.16 |
| Comp. Ex. 13 | 38 | 1.26–1.29 | 1.5–2.2 | 86–89 | C | 1.14 |
| Comp. Ex. 14 | 39 | 1.28–1.28 | 1.6–2.3 | 87–89 | C | 1.10 |
| Comp. Ex. 15 | 40 | 1.27–1.29 | 1.7–2.3 | 85–88 | C | 1.13 |

TABLE 12-continued

| | Evaluation results in NT/LH (23° C./5% RH) | | | | | |
|---|---|---|---|---|---|---|
| | Magnetic toner No. | Image density | Fog | Image standing | Soiling* | Image density after-defect |
| Comp. Ex. 16 | 41 | 1.28–1.30 | 1.5–2.2 | 86–89 | C | 1.11 |
| Comp. Ex. 17 | 42 | 1.26–1.29 | 1.7–2.0 | 85–89 | D | 1.09 |
| Comp. Ex. 18 | 43 | 1.27–1.29 | 1.8–2.1 | 86–90 | D | 1.05 |
| Comp. Ex. 19 | 44 | 1.27–1.30 | 1.9–2.0 | 87–90 | D | 1.08 |
| Comp. Ex. 20 | 45 | 1.29–1.30 | 1.8–2.1 | 87–90 | D | 1.07 |

*Soiling of fixing member

TABLE 13

| | Evaluation in NT/NH (23° C./60% RH) | | | | | | | | |
|---|---|---|---|---|---|---|---|---|---|
| | | Image density | | Fog | | Image quality | | Soiling | Fixable |
| | Magnetic toner No. | Initial | After 50000 sheets | Initial | After 50000 sheets | Initial | After 50000 sheets | after 50000 sheets | temp. range (° C.) |
| Ex. 15 | 23 | 1.40 | 1.40 | 0.4 | 0.6 | 99 | 98 | A | 140–195 |
| Ex. 16 | 24 | 1.42 | 1.41 | 0.5 | 0.7 | 100 | 98 | A | 140–190 |
| Ex. 17 | 25 | 1.42 | 1.42 | 0.6 | 0.7 | 100 | 99 | A | 140–200 |
| Ex. 18 | 26 | 1.40 | 1.41 | 0.7 | 0.6 | 98 | 100 | A | 140–200 |
| Ex. 19 | 27 | 1.41 | 1.42 | 0.7 | 0.8 | 98 | 99 | A | 145–200 |
| Ex. 20 | 28 | 1.38 | 1.39 | 1.0 | 0.8 | 97 | 96 | A | 135–190 |
| Ex. 21 | 29 | 1.39 | 1.38 | 0.9 | 0.9 | 97 | 95 | A | 140–195 |
| Ex. 22 | 30 | 1.35 | 1.36 | 1.0 | 1.1 | 95 | 95 | B | 140–195 |
| Ex. 23 | 31 | 1.36 | 1.35 | 1.1 | 1.2 | 94 | 92 | C | 145–180 |
| Ex. 24 | 32 | 1.33 | 1.34 | 1.2 | 1.0 | 91 | 92 | B | 145–180 |
| Ex. 25 | 33 | 1.31 | 1.33 | 1.4 | 1.1 | 90 | 91 | C | 145–180 |
| Comp. Ex. 9 | 34 | 1.27 | 1.30 | 1.8 | 1.2 | 92 | 88 | B | 140–185 |
| Comp. Ex. 10 | 35 | 1.28 | 1.29 | 1.5 | 1.6 | 90 | 89 | B | 140–185 |
| Comp. Ex. 11 | 36 | 1.27 | 1.30 | 1.6 | 1.8 | 92 | 87 | B | 145–190 |
| Comp. Ex. 12 | 37 | 1.28 | 1..31 | 1.7 | 1.5 | 94 | 89 | C | 140–180 |
| Comp. Ex. 13 | 38 | 1.23 | 1.26 | 2.0 | 1.5 | 90 | 86 | C | 145–185 |
| Comp. Ex. 14 | 39 | 1.22 | 1.25 | 1.4 | 2.1 | 89 | 88 | C | 145–185 |
| Comp. Ex. 15 | 40 | 1.25 | 1.25 | 2.2 | 1.8 | 88 | 85 | C | 145–190 |
| Comp. Ex. 16 | 41 | 1.24 | 1.26 | Z.4 | 2.0 | 87 | 85 | C | 145–180 |
| Comp. Ex. 17 | 42 | 1.24 | 1.25 | 1.8 | 1.5 | 91 | 87 | D | 145–180 |
| Comp. Ex. 18 | 43 | 1.26 | 1.27 | 1.9 | 1.8 | 90 | 88 | D | 145–180 |

TABLE 13-continued

| | | Evaluation in NT/NH (23° C./60% RH) | | | | | | | |
|---|---|---|---|---|---|---|---|---|---|
| | | Image density | | Fog | | Image quality | | Soiling | Fixable |
| | Magnetic toner No. | Initial | After 50000 sheets | Initial | After 50000 sheets | Initial | After 50000 sheets | after 50000 sheets | temp. range (° C.) |
| Comp. Ex. 19 | 44 | 1.24 | 1.25 | 1.7 | 1.8 | 91 | 89 | D | 145–180 |
| Comp. Ex. 20 | 45 | 1.26 | 1.24 | 1.8 | 1.6 | 92 | 88 | D | 145–180 |

The fixable temperature range (° C.) shown in Table 13 for Examples 15–25 and Comparative Examples 9–20 was measured in the following manner.

The fixing device of a commercially available laser beam printer ("LBP-430", mfd. by Canon K. K.) also used in the above Examples was taken out of the main body and remodeled so as to be able to arbitrarily set the fixing temperature and provide a process speed of 50 mm/sec, thereby providing an external fixing device. By using the external fixing device, yet-unfixed toner images on plain paper of 80 g/m$^2$ were subjected to evaluation of the fixability. By setting the fixing temperatures in the range of 120–200° C. at increments of 5° C. each, fixed images at the respective temperatures were rubbed for 5 reciprocations with a lens cleaning paper under a load of 4.9 kPa to determine the lowest fixing temperature giving a image density lowering after rubbing of at most 10% as a fixing initiation temperature. A lower fixing initiation temperature indicates a better fixability.

On the other hand, the offset behavior was observed to determine a highest non-offset temperature as a measure of anti-offset characteristic. A higher highest non-offset temperature represents a better anti-offset characteristic.

The above evaluations were both performed in an environment of normal temperature/normal humidity (23° C./60% RH). A fixable temperature range was defined between the fixing initiation temperature and the highest non-offset temperature. A broader fixable temperature range represents a better fixing performance of a toner.

EXAMPLE 26

| | |
|---|---|
| Binder resin H | 100 wt. parts |
| Colorant (copper phthalocyanine) | 4 wt. parts |
| Organic zirconium compound (40) | 2 wt. parts |

The above ingredients were preliminarily blended by a Henschel mixer and then melt-kneaded through a twin-screw kneading extruder set at 100° C. During the melt-kneading, the viscosity of the kneaded mixture was gradually increased, whereby the formation of fresh crosslinkage was confirmed.

The thus-kneaded product was cooled, coarsely crushed by a cutter mill and finely pulverized by a pulverizer using a jet air stream, followed by classification by a multi-division classifier utilizing the Coanda effect to form a non-magnetic cyan toner having a weight-average particle size (D4) of 8.5 μm. To 100 wt. parts of the cyan toner, 1.5 wt. parts of hydrophobic titania fine powder formed by hydrophobizing 100 wt. parts of anatase-form titania fine powder prepared by the suffuric acid process with 10 wt. parts of isobutyltrimethoxysilane and 10 wt. parts of dimethylsilicone and having a methanol-wettability of 65% and a BET specific surface area of 75 m$^2$/g was externally blended to prepare Cyan toner No. 1. Cyan toner No. 1 exhibited D4=8.5 μm. Other properties of Cyan toner No. 1 are shown in Table 14.

Cyan toner No. 1 was evaluated according to the following test.

<Image Evaluation Tests>

A commercially available color printer of a contact charging scheme using a charging roller ("LBP-2030", mfd. by Canon K. K.) was remodelled in the following manner and subjected to continuous printing on 3000 sheets in an environment of 15° C./10% RH and an environment of 30° C./80% RH, respectively, to evaluate the resultant images with; respect to image density and fog. The toner on the developing sleeve was provided with a negative triboelectric charge. The toner was subjected to a continuous printing test on 3000 sheets also in a normal temperature/normal humidity environment.

A developing sleeve was prepared by polishing an aluminum cylinder of 16 mm in outer diameter and 0.8 mm in thickness to a deviation from straightness of at most 10 μm and a surface roughness (Rz) of at most 4 μm. The sleeve was set vertically and the upper and lower ends thereof were masked in a width of 3 mm each. While the vertically set sleeve was rotated at a constant speed, a paint (comprising 125 wt. parts of phenolic resin precursor, 5 wt. parts of carbon black, 45 wt. parts of crystalline graphite, 41 wt. parts of methanol and 284 wt. parts of isopropyl alcohol) was applied onto the outer surface of the sleeve through a spray gun moved downwardly at a constant speed. The coated sleeve was heated at 160° C. for 20 min. in a drying oven for drying and curing to form an electroconductive resin coating on the sleeve. The coating was then rubbed with a flat strip for polishing under a load of 4 kgf to form a coated sleeve with a uniform thickness of electroconductive resin layer.

The electroconductive layer had a thickness of 10 μm and a surface roughness (Ra) of 0.87 μm as an average at 6 points and exhibited a pencil hardness of 2H. The sleeve was provided with a flange at each end to form a developing sleeve.

The image density was measured by using a Macbeth reflection densitometer (available from Macbeth Co.). The fog was measured as a difference in reflection density on an average between a white background portion of a transfer paper after printing and the transfer paper before printing as measured by a reflection densitometer ("Reflectometer Model TC-6DS", available from Tokyo Denshoku K. K.). A smaller value represents a better fog-suppression effect.

The image quality was evaluated in terms of dot reproducibility in a similar manner as in Example 15.

After the 3000 sheets of continuous image formation in the environment of 30° C./80% RH, the printer was left standing in the environment for 3 days, and then some images were formed to measure the image density.

The reverse side soiling (back soiling) was observed as a measure of toner scattering similarly as in Example 15 according to the following standard:

A: No reverse side soiling.

B: Reverse side soiling was rare and slight but observed.

C: Slight reverse side soiling was observed on some sheets.

C: Remarkable reverse side soiling was observed on some sheets.

During the continuous image formation in the environment of 23° C./5% RH, whether or not the halftone image portion was accompanied with image density irregularities was evaluated according to the following standard.

A: No irregularity.

B: Image density irregularity was rare and slight but observed.

C: Slight image density irregularity in halftone images was observed on some sheets.

D: Image density irregularity was observed over a wide area when occurred.

The evaluation results are shown in Tables 15–17.

Comparative Examples 21–23

Cyan toners Nos. 2–4 were prepared in the same manner as in Example 26 except for using the above-described Organic zinc compound (172) and Organic iron compound (173), Organic aluminum compound (174), respectively, in place of Organic zirconium compound (40), and then evaluated in the same manner as in Example 26. The properties of the respective cyan toners are shown in Table 14, and the evaluation results are shown in Tables 15–17.

Incidentally, Organic chromium compound (175) showed a dense violet color and was not suitable as a charge control agent for a cyan toner.

TABLE 14

Cyan toner properties

| | Cyan toner No. | D4 (μm) | Acid (mgKOH/g) | Molecular weight distribution Mw | Main peak | Sub-peak | ≦$10^5$ (%) | THF-insoluble content (wt. %) |
|---|---|---|---|---|---|---|---|---|
| Ex. 26 | 1 | 8.5 | 11.7 | 86400 | 7600 | — | 95 | 4 |
| Comp. Ex. 21 | 2 | 8.4 | 12.1 | 58200 | 7400 | — | 96 | 0 |
| Comp. Ex. 22 | 3 | 8.6 | 12.0 | 57900 | 7500 | — | 96 | 0 |
| Comp. Ex. 23 | 4 | 8.5 | 11.6 | 98500 | 7600 | — | 95 | 6 |

TABLE 15

Evaluation results in 15° C./10% RH

| | Cyan toner No. | Image density | Fog | Image quality | Halftone irregularity |
|---|---|---|---|---|---|
| Ex. 26 | 1 | 1.62–1.66 | 0.7–1.4 | 95–100 | A |
| Comp. Ex. 21 | 2 | 1.60–1.61 | 0.9–1.8 | 90–98 | D |
| Comp. Ex. 22 | 3 | 1.58–1.62 | 0.9–1.7 | 91–97 | C |
| Comp. Ex. 23 | 4 | 1.60–1.64 | 0.8–1.6 | 94–99 | B |

TABLE 16

Evaluation results in 30° C./80% RH

| | Cyan toner No. | Image density | Fog | Image quality | Back soiling | Image density after standing |
|---|---|---|---|---|---|---|
| Ex. 26 | 1 | 1.57–1.62 | 0.5–1.5 | 91–100 | A | 1.52 |
| Comp. Ex. 21 | 2 | 1.55–1.59 | 0.7–2.1 | 88–98 | C | 1.41 |
| Comp. Ex. 22 | 3 | 1.54–1.58 | 0.6–2.2 | 87–98 | D | 1.40 |
| Comp. Ex. 23 | 4 | 1.56–1.60 | 0.8–1.7 | 89–99 | B | 1.46 |

TABLE 17

| | | Evaluation in NT/NH (23° C./60% RH) | | | | | | |
|---|---|---|---|---|---|---|---|---|
| | | Image density | | Fog | | Image quality | | Fixable |
| | Cyan toner No. | Initial | After 3000 sheets | Initial | After 3000 sheets | Initial | After 3000 sheets | temp. range (° C.) |
| Ex. 26 | 1 | 1.60 | 1.61 | 1.2 | 1.0 | 100 | 97 | 140–200 |
| Comp. Ex. 21 | 2 | 1.58 | 1.57 | 1.6 | 1.4 | 98 | 95 | 140–190 |
| Comp. Ex. 22 | 3 | 1.56 | 1.55 | 1.5 | 1.2 | 97 | 94 | 140–190 |
| Comp. Ex. 23 | 4 | 1.58 | 1.59 | 1.3 | 1.5 | 98 | 96 | 140–195 |

The fixable temperature range (° C.) shown in Table 17 for Example 26 and Comparative Examples 21–23 and Tables 21, 25 and 29 for Examples 27–29 and Comparative Examples 24–34 was measured in the following manner.

The fixing device of a commercially available copying machine ("CLC-800", mfd. by Canon K. K.) also used in the above Examples was taken out of the main body and remodeled so as to be able to arbitrarily set the fixing temperature and provide a process speed of 100 mm/sec, thereby providing an external fixing device. By using the external fixing device, yet-unfixed toner images on plain paper of 80 g/m$^2$ were subjected to evaluation of the fixability. By setting the fixing temperatures in the range of 120–200° C. at increments of 5° C. each, fixed images at the respective temperatures were rubbed for 5 reciprocations with a lens cleaning paper under a load of 4.9 kPa to determine the lowest fixing temperature giving a image density lowering after rubbing of at most 10% as a fixing initiation temperature. A lower fixing initiation temperature indicates a better fixability.

On the other hand, the offset behavior was observed to determine a highest non-offset temperature as a measure of anti-offset characteristic. A higher highest non-offset temperature represents a better anti-offset characteristic.

The above evaluations were both performed in an environment of normal temperature/normal humidity (23° C./60% RH). A fixable temperature range was defined between the fixing initiation temperature and the highest non-offset temperature. A broader fixable temperature range represents a better fixing performance of a toner.

EXAMPLE 27

| | |
|---|---|
| Binder resin H | 100 wt. parts |
| Colorant (dimethylquinacridone) | 5 wt. parts |
| Organic zirconium compound (65) | 2 wt. parts |

The above ingredients were preliminarily blended by a Henschel mixer and then melt-kneaded through a twin-screw kneading extruder set at 100° C. During the melt-kneading, the viscosity of the kneaded mixture was gradually increased, whereby the formation of fresh crosslinkage was confirmed.

The thus-kneaded product was cooled, coarsely crushed by a cutter mill and finely pulverized by a pulverizer using a jet air stream, followed by classification by a multi-division classifier utilizing the Coanda effect to form a non-magnetic magenta toner having a weight-average particle size (D4) of 8.5 μm. To 100 wt. parts of the magenta toner, 1.5 wt. parts of hydrophobic alumina fine powder formed by hydrophobizing 100 wt. parts of γ-form alumina fine powder prepared by the thermal decomposition process with 10 wt. parts of n-butyltrimethoxysilane and 5 wt. parts of dimethylsilicone and having a methanol-wettability of 70% and a BET specific surface area of 82 m$^2$/g was externally blended to prepare Magenta toner No. 1. Magenta toner No. 1 exhibited D4=8.5 μm. Other properties of Magenta toner No. 1 are shown in Table 18.

Magenta toner No. 1 exhibited a negative triboelectric chargeability and was evaluated in a similar manner as in Example 26. The results are shown in Tables 19–21.

Comparative Examples 24–26

Magenta toners Nos. 2–4 were prepared in the same manner as in Example 27 except for using the above-described Organic zinc compound (172), Organic iron compound (173) and Organic aluminum compound (174), respectively, in place of Organic zirconium compound (65), and then evaluated in the same manner as in Example 27. The properties of the respective magenta toners are shown in Table 18, and the evaluation results are shown in Tables 19–21.

Organic chromium compound (175) showed a dense violet color and was not suitable as a charge control agent for a magenta toner.

TABLE 18

| | Magenta toner No. | D4 (μm) | Acid (mgKOH/g) | Molecular weight distribution Mw | Main peak | Sub-peak | ≦$10^5$ (%) | THF-insoluble content (wt. %) |
|---|---|---|---|---|---|---|---|---|
| Ex. 27 | 1 | 8.5 | 11.6 | 84400 | 7700 | — | 95 | 3 |
| Comp. Ex. 24 | 2 | 8.4 | 12.0 | 57800 | 7500 | — | 96 | 0 |
| Comp. Ex. 25 | 3 | 8.5 | 12.1 | 56500 | 7400 | — | 95 | 0 |
| Comp. Ex. 26 | 4 | 8.6 | 11.8 | 89606 | 7500 | — | 96 | 5 |

TABLE 19

Evaluation results in 15° C./10% RH

| | Magenta toner No. | Image density | Fog | Image quality | Halftone irregularity |
|---|---|---|---|---|---|
| Ex. 27 | 1 | 1.65–1.69 | 0.8–1.3 | 96–100 | A |
| Comp. Ex. 24 | 2 | 1.58–1.62 | 0.7–2.3 | 92–96 | D |
| Comp. Ex. 25 | 3 | 1.56–1.60 | 0.9–2.2 | 91–97 | D |
| Comp. Ex. 26 | 4 | 1.60–1.64 | 0.9–1.9 | 94–99 | C |

TABLE 20

Evaluation results in 30° C./80% RH

| | Magenta toner No. | Image density | Fog | Image quality | Back soiling | Image density after standing |
|---|---|---|---|---|---|---|
| Ex. 27 | 1 | 1.59–1.61 | 0.4–1.6 | 92–100 | A | 1.55 |
| Comp. Ex. 24 | 2 | 1.50–1.57 | 0.5–2.1 | 87–98 | B | 1.38 |
| Comp. Ex. 25 | 3 | 1.51–1.55 | 0.6–2.4 | 88–97 | C | 1.39 |
| Comp. Ex. 26 | 4 | 1.54–1.57 | 0.5–I.9 | 89–99 | B | 1.42 |

TABLE 21

Evaluation in NT/NH (23° C./60% RH)

| | Magnetic toner No. | Image density Initial | Image density After 3000 sheets | Fog Initial | Fog After 3000 sheets | Image quality Initial | Image quality After 3000 sheets | Fixable temp. range (° C.) |
|---|---|---|---|---|---|---|---|---|
| Ex. 27 | 1 | 1.65 | 1.64 | 1.1 | 0.8 | 100 | 98 | 140–200 |
| Comp. Ex. 24 | 2 | 1.55 | 1.54 | 1.8 | 1.2 | 97 | 94 | 140–190 |
| Comp. Ex. 25 | 3 | 1.57 | 1.56 | 2.1 | 1.1 | 98 | 93 | 140–190 |
| Comp. Ex. 26 | 4 | 1.58 | 1.61 | 1.6 | 1.2 | 98 | 95 | 145–195 |

EXAMPLE 28

| | |
|---|---|
| Binder resin H | 100 wt. parts |
| Colorant (disazo pigment (C.I. Pigment Yellow 17)) | 3 wt. parts |
| Organic zirconium compound (93) | 2 wt. parts |

The above ingredients were preliminarily blended by a Henschel mixer and then melt-kneaded through a twin-screw kneading extruder set at 100° C. During the melt-kneading, the viscosity of the kneaded mixture was gradually increased, whereby the formation of fresh crosslinkage was confirmed.

The thus-kneaded product was cooled, coarsely crushed by a cutter mill and finely pulverized by a pulverizer using a jet air stream, followed by classification by a multi-division classifier utilizing the Coanda effect to form a non-magnetic yellow toner having a weight-average particle size (D4) of 8.5 μm. To 100 wt. parts of the yellow toner, 1.0 wt. part of hydrophobic alumina fine powder formed by hydrophobizing 100 wt. parts of δ-form alumina fine powder prepared by the flame decomposition process with 10 wt. parts of n-butyltrimethoxysilane and 5 wt. parts of dimethylsilicone and having a methanol-wettability of 75% and a BET specific surface area of 75 $m^2/g$ was externally blended to prepare Yellow toner No. 1. Yellow toner No. 1 exhibited D4=8.5 μm. Other properties of Yellow toner No. 1 are shown in Table 22.

Yellow toner No. 1 exhibited a negative triboelectric chargeability and was evaluated in a similar manner as in Example 26. The results are shown in Tables 23–25.

Comparative Examples 27–29

Yellow toners Nos. 2–4 were prepared in the same manner as in Example 28 except for using the above-described Organic zinc compound (172), Organic iron compound (173) and Organic aluminum compound (174), respectively, in place of Organic zirconium compound (93), and then evaluated in the same manner as in Example 28. The properties of the respective yellow toners are shown in Table 22, and the evaluation results are shown in Tables 23–25.

Organic chromium compound (175) showed a dense violet color and was not suitable as a charge control agent for a yellow toner.

TABLE 22

Yellow toner properties

| | Yellow toner No. | D4 (μm) | Acid (mgKOH/g) | Molecular weight distribution Mw | Main peak | Sub-peak | ≦$10^5$ (%) | THF-insoluble content (wt. %) |
|---|---|---|---|---|---|---|---|---|
| Ex. 28 | 1 | 8.5 | 11.7 | 76200 | 7600 | — | 95 | 4 |
| Comp. Ex. 27 | 2 | 8.5 | 11.9 | 54600 | 7700 | — | 96 | 0 |
| Comp. Ex. 28 | 3 | 8.6 | 12.2 | 56700 | 7700 | — | 95 | 0 |
| Comp. Ex. 29 | 4 | 8.5 | 11.6 | 72600 | 7600 | — | 95 | 7 |

TABLE 23

Evaluation results in 15° C./10% RH

| | Yellow toner No. | Image density | Fog | Image quality | Halftone irregularity |
|---|---|---|---|---|---|
| Ex. 28 | 1 | 1.64–1.68 | 0.9–1.2 | 95–100 | A |
| Comp. Ex. 27 | 2 | 1.58–1.62 | 1.1–2.1 | 93–98 | D |
| Comp. Ex. 28 | 3 | 1.55–1.60 | 1.2–2.2 | 92–97 | D |
| Comp. Ex. 29 | 4 | 1.59–1.66 | 1.0–1.8 | 92–99 | C |

TABLE 24

Evaluation results in 30° C./80% RH

| | Yellow toner No. | Image density | Fog | Image quality | Back soiling | Image density after standing |
|---|---|---|---|---|---|---|
| Ex. 29 | 1 | 1.58–1.64 | 0.9–1.2 | 95–100 | A | 1.51 |
| Comp. Ex. 27 | 2 | 1.54–1.58 | 0.5–2.3 | 87–98 | B | 1.37 |
| Comp. Ex. 28 | 3 | 1.52–1.59 | 0.7–2.1 | 88–97 | B | 1.36 |
| Comp. Ex. 29 | 4 | 1.55–1.59 | 1.9–2.0 | 88–99 | B | 1.41 |

TABLE 25

Evaluation in NT/NH (23° C./60% RH)

| | Yellow toner No. | Image density Initial | Image density After 3000 sheets | Fog Initial | Fog After 3000 sheets | Image quality Initial | Image quality After 3000 sheets | Fixable temp. range (° C.) |
|---|---|---|---|---|---|---|---|---|
| Ex. 28 | 1 | 1.61 | 1.62 | 1.0 | 1.0 | 100 | 98 | 140–200 |
| Comp. Ex. 27 | 2 | 1.52 | 1.51 | 2.2 | 1.1 | 97 | 95 | 140–190 |
| Comp. Ex. 28 | 3 | 1.51 | 1.51 | 1.8 | 1.7 | 96 | 94 | 140–190 |
| Comp. Ex. 29 | 4 | 1.57 | 1.60 | 1.5 | 1.6 | 97 | 96 | 145–195 |

EXAMPLE 29

| | |
|---|---|
| Binder resin H | 100 wt. parts |
| Colorant (carbon black) | 4 wt. parts |
| Organic zirconium compound (57) | 2 wt. parts |

The above ingredients were preliminarily blended by a Henschel mixer and then melt-kneaded through a twin-screw kneading extruder set at 100° C. During the melt-kneading, the viscosity of the kneaded mixture was gradually increased, whereby the formation of fresh crosslinkage was confirmed.

The thus-kneaded product was cooled, coarsely crushed by a cutter mill and finely pulverized by a pulverizer using a jet air stream, followed by classification by a multi-division classifier utilizing the Coanda effect to form a non-magnetic black toner having a weight-average particle size (D4) of 8.5 μm. To 100 wt. parts of the black toner, 1.5 wt. parts of hydrophobic titania fine powder formed by hydrophobizing 100 wt. parts of rutile-form titania fine powder prepared through the sulfuric acid process with 10 wt. parts of isobutyltrimethoxysilane and 10 wt. parts of dimethylsilicone and having a methanol-wettability of 70% and a BET specific surface area of 59 $m^2/g$ was externally blended to prepare Black toner No. 1. Black toner No. 1 exhibited D4=8.5 μm. Other properties of Black toner No. 1 are shown in Table 26.

Black toner No. 1 exhibited a negative triboelectric chargeability and was evaluated in a similar manner as in Example 26. The results are shown in Tables 27–28.

Comparative Examples 30–34

Black toners Nos. 2–6 were prepared in the same manner as in Example 29 except for using the above-described Organic zinc compound (172), Organic iron compound (173), Organic aluminum compound (174), Organic chromium compound (175) and an organic silicon compound (176) show below, respectively, in place of Organic zirconium compound (57), and then evaluated in the same manner as in Example 29. The properties of the respective black toners are shown in Table 26, and the evaluation results are shown in Tables 27–29.

(176)

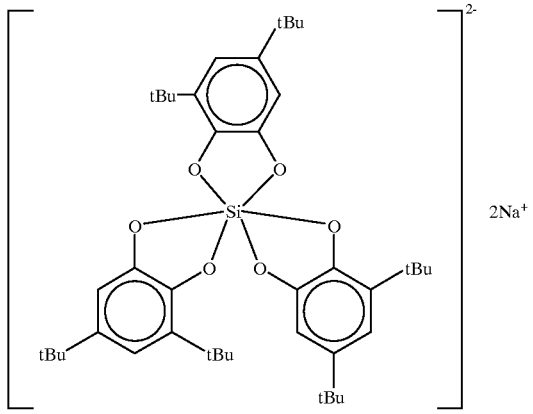

TABLE 26

Black toner properties

| | Black toner No. | D4 (μm) | Acid (mgKOH/g) | Molecular weight distribution Mw | Main peak | Sub-peak | ≦$10^5$ (%) | THF-insoluble content (wt. %) |
|---|---|---|---|---|---|---|---|---|
| Ex. 29 | 1 | 8.5 | 11.8 | 68400 | 7500 | — | 95 | 4 |
| Comp. Ex. 30 | 2 | 8.5 | 12.0 | 57400 | 7400 | — | 95 | 0 |
| Comp. Ex. 31 | 3 | 8.4 | 12.0 | 59800 | 7400 | — | 96 | 0 |
| Comp. Ex. 32 | 4 | 8.6 | 11.6 | 71300 | 7500 | — | 96 | 7 |
| Comp. Ex. 33 | 3 | 8.4 | 12.1 | 57400 | 7600 | — | 95 | 0 |
| Comp. Ex. 34 | 4 | 8.5 | 12.2 | 58500 | 7600 | — | 95 | 0 |

TABLE 27

Evaluation results in 15° C./10% RH

| | Black toner No. | Image density | Fog | Image quality | Halftone irregularity |
|---|---|---|---|---|---|
| Ex. 29 | 1 | 1.62–1.68 | 0.7–1.4 | 96–100 | A |
| Comp. Ex. 30 | 2 | 1.59–1.62 | 0.8–2.3 | 93–98 | C |
| Comp. Ex. 31 | 3 | 1.58–1.60 | 0.9–2.4 | 92–97 | C |
| Comp. Ex. 32 | 4 | 1.60–1.62 | 0.8–1.9 | 94–99 | B |
| Comp. Ex. 33 | 5 | 1.59–1.63 | 1.1–1.8 | 93–99 | B |
| Comp. Ex. 34 | 6 | 1.57–1.59 | 1.0–1.6 | 91–97 | D |

TABLE 28

Evaluation results in 30° C./80% RH

| | Black toner No. | Image density | Fog | Image quality | Back soiling | Image density after standing |
|---|---|---|---|---|---|---|
| Ex. 29 | 1 | 1.59–1.63 | 0.6–1.7 | 91–100 | A | 1.51 |
| Comp. Ex. 30 | 2 | 1.55–1.59 | 0.7–2.1 | 86–98 | D | 1.28 |
| Comp. Ex. 31 | 3 | 1.54–1.58 | 0.8–2.2 | 87–87 | D | 1.27 |
| Comp. Ex. 32 | 4 | 1.55–1.60 | 0.7–1.9 | 88–99 | C | 1.32 |
| Comp. Ex. 33 | 5 | 1.56–1.61 | 0.8–2.0 | 90–97 | B | 1.33 |
| Comp. Ex. 34 | 6 | 1.45–1.46 | 1.2–2.2 | 88–95 | D | 1.25 |

TABLE 29

Evaluation in NT/NH (23° C./60% RH)

| | Black toner No. | Image density | | Fog | | Image quality | | Fixable |
|---|---|---|---|---|---|---|---|---|
| | | Initial | After 3000 sheets | Initial | After 3000 sheets | Initial | After 3000 sheets | temp. range (° C.) |
| Ex. 29 | 1 | 1.63 | 1.62 | 1.2 | 1.0 | 100 | 99 | 140–200 |
| Comp. Ex. 30 | 2 | 1.55 | 1.54 | 2.1 | 1.2 | 97 | 95 | 140–190 |
| Comp. Ex. 31 | 3 | 1.54 | 1.56 | 2.2 | 1.5 | 96 | 94 | 140–190 |
| Comp. Ex. 32 | 4 | 1.56 | 1.54 | 2.1 | 1.8 | 95 | 93 | 140–195 |
| Comp. Ex. 33 | 5 | 1.58 | 1.60 | 1.7 | 1.4 | 98 | 95 | 140–185 |
| Comp. Ex. 34 | 6 | 1.52 | 1.50 | 2.2 | 1.6 | 97 | 92 | 140–185 |

What is claimed is:

1. A toner having a negative triboelectric chargeability, comprising at least a binder resin, a colorant and an organic metal compound, wherein the organic metal compound is an organic zirconium compound having a structure represented by any one of the following formulae (1), (2), (32) and (33):

(1)

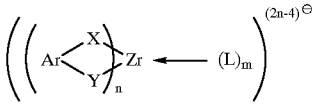

(2n - 4)Cl or $(n - 2)C2^{2\oplus}$ wherein Ar denotes a benzene ring, naphthalene ring, anthracene ring or phenanthrene ring capable of having a substituent of alkyl, hydroxyl or carboxyl; X and Y independently denote O or —CO—O—; L denotes a neutral ligand of water, alcohol, ammonia, alkylamine or pyridine; C1 denotes a monovalent cation of hydrogen ion, monovalent metal ion, ammonium ion or alkylammonium ion; C2 denotes a divalent cation of a metal ion; n is 2, 3 or 4; m is 0, 2 or 4; a number (n) of ligands can be identical to or different from each other, and a number (m>0) of neutral ligands can be identical to or different from each other in each complex or complex salt of a formula; with the proviso that each complex or complex salt of a formula can also be a mixture of complex compounds having mutually different n or/and m, or a mixture of complex salts having mutually different counter ions C1 or/and C2, (2)

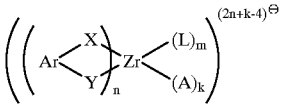

-continued $(2n + k-4)Cl^{\oplus}$ or $(n + K/2-2)C2^{2\oplus}$ wherein Ar denotes a benzene ring, naphthalene ring, anthracene ring or phenanthrene ring capable of having a substituent of alkyl, hydroxyl or carboxyl; X and Y independently denote O or —CO—O—; L denotes a neutral ligand of water, alcohol, ammonia, alkylamine or pyridine; A denotes an anion of halogen, hydroxyl, carboxylate, carbonate, nitrate, sulfate, cyano or thiocyano, a plurality of A can be identical or different when k≧2; C1 denotes a monovalent cation of hydrogen ion, monovalent metal ion, ammonium ion or alkylammonium ion; C2 denotes a divalent cation of a metal ion; n is 1, 2, 3 or 4; m is 0, 1, 2, 3 or 4; k is 1, 2, 3, 4, 5 or 6; a number (when n≧2) of ligands can be identical to or different from each other, and a number (m≧2) of neutral ligands can be identical to or different from each other in each complex or complex salt of a formula; with the proviso that each complex or complex salt of a formula can also be a mixture of complex compounds having mutually different n or/and m, or a mixture of complex salts having mutually different counter ions $C_1$ or/and C2;

$$(Ar—COO^-)_nAr^4\oplus(4-n)A_1\ominus \text{ or } (2-n/2)A_2^{2\ominus} \quad (32)$$

$$(Ar—COO^-)_nAr^4\oplus(O)(2-n)A_1^{\oplus}, \quad (33),$$

wherein Ar denotes a benzene ring, naphthalene ring, anthracene ring or phenanthrene ring capable of having a substituent of alkyl, hydroxyl, acyloxy or carboxyl; $A_1$ denotes a monovalent anion of halogen, hydroxyl, nitrate or carboxylate; $A_2$ denotes a divalent anion, and n is 1, 2, 3 or 4 with the proviso that in case of n≧2 for each metal salt, a plurality (n) of aromatic carboxylates and aromatic hydroxycarboxylates as acid ions may be identical or different, and that each metal salt of a formula can be a mixture of different salts having different numbers of n.

2. The toner according to claim 1, wherein said organic zirconium compound comprises a structure represented by the following formula (3), (4) or (5):

(3)

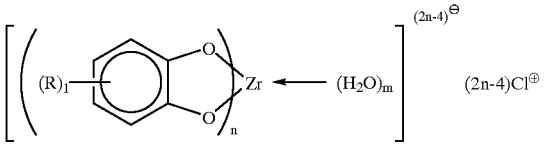

(4)

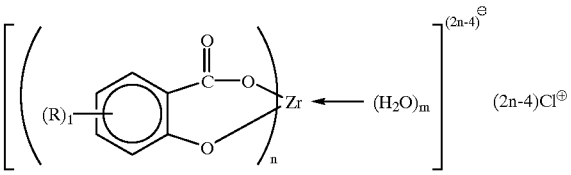

(5)

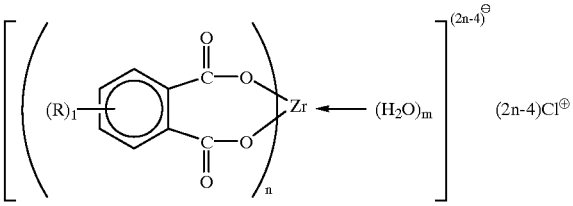

wherein R denotes a substituent of hydrogen, alkyl, aryl, hydroxyl, or carboxyl, a plurality (when 1≧2) of R can be mutually linked to form an alicyclic, aromatic or heterocyclic ring capable of having 1–8 similar R substituent(s); a plurality of R can be identical or different; C1 denotes a monovalent cation of hydrogen, alkaline metal, ammonium or alkylammonium; 1 is an integer of 1–8; n is 2, 3 or 4; m is 0, 2 or 4; a number (n) of ligands can be identical or different in each complex or complex salt of a formula; with the proviso that each complex or complex salt of a formula can be a mixture of complex compounds having mutually different n or/and m, or a mixture of complex salts having mutually different counter ions C1.

3. The toner according to claim 1, wherein the organic zirconium compound comprises a structure represented by the following formula (6), (7) or (8):

(6)

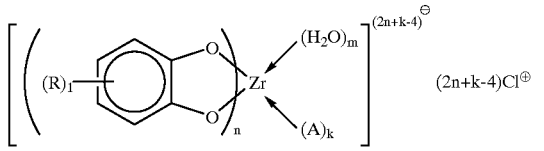

(7)

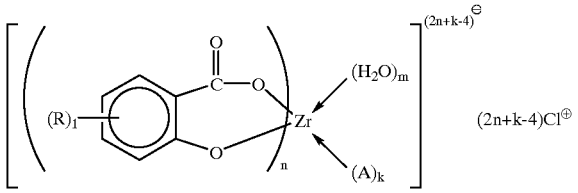

(8)

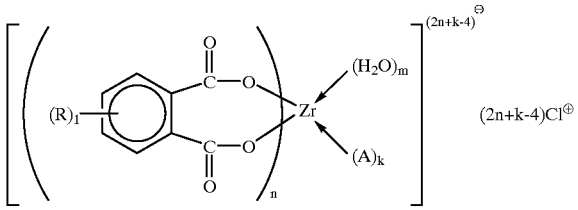

wherein R denotes a substituent of hydrogen, alkyl, hydroxyl, or carboxyl, a plurality (when 1≧2) of R can be mutually linked to form an alicyclic, aromatic or heterocyclic ring capable of having 1–8 similar R substituent(s); a plurality of R can be identical or different; A denotes an anion of halogen, hydroxyl, carboxylate, carbonate, nitrate, sulfate, cyano or thiocyano, a plurality of A can be identical or different; C1 denotes a monovalent cation of hydrogen, alkaline metal, ammonium or alkylammonium; 1 is an integer of 1–8; n is 1, 2, 3 or 4; m is 0, 2, or 4; k is 1, 2, 3, 4, 5 or 6; a number (when n≧2) of ligands can be identical or different in each complex or complex salt of a formula; with the proviso that each complex or complex salt of a formula can be a mixture of complex compounds having mutually different n or/and m, or a mixture of complex salts having mutually different counter ions C1 or/and anions A.

4. The toner according to claim 1, wherein the organic zirconium compound comprises a structure represented by the following formula (34) or (35):

(34)

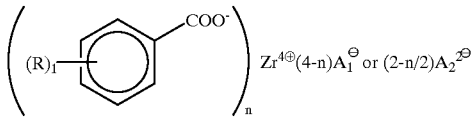

(35)

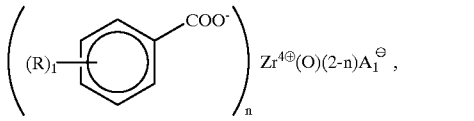

wherein R denotes a substituent of hydrogen, alkyl, hydroxyl, acyloxy or carboxyl a plurality (when 1≧2) of R can be mutually linked to form an alicyclic, aromatic or heterocyclic ring capable of having 1–8 similar R substituent(s); a plurality of R can be identical or different; $A_1$ denotes a monovalent anion of halogen, hydroxyl, nitrate or carboxylate; $A_2$ denotes a divalent anion of sulfate, hydrogen phosphate or carbonate; 1 is an integer of 1–8; and n is 1, 2, 3 or 4 with the proviso that in case of n≧2 for each metal salt, a plurality (n) of acid ions, may be identical to or different; and that each metal salt of a formula can be a mixture of different salts having different numbers of n.

5. The toner according to claim 1, wherein the organic zirconium compound comprises a structure represented by the following formula (36) or (37):

(36)

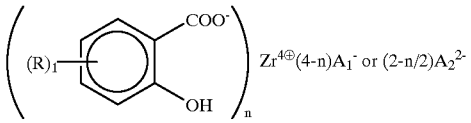

(37)

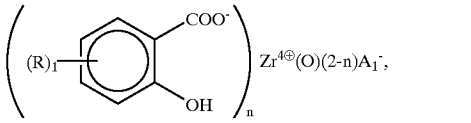

wherein R denotes a substituent of hydrogen, alkyl, hydroxyl, acyloxy or carboxyl a plurality (when 1≧2) of R can be mutually linked to form an alicyclic, aromatic or heterocyclic ring capable of having 1–8 similar R substituent(s); a plurality of R can be identical or different; $A_1$ denotes a monovalent anion of halogen, hydroxyl, nitrate or carboxylate; $A_2$ denotes a divalent anion of sulfate, hydrogen phosphate or carbonate; 1 is an integer of 1–7; and n is 1, 2, 3 or 4 with the proviso that in case of n≧2 for each metal salt, a plurality (n) of aromatic carboxylates and aromatic hydroxycarboxylate as acid ions, may be a mixture of different, and that each metal salt of a formula can be a mixture salts having different numbers of n.

6. The toner according to claim 1, comprising toner particles containing therein the binder resin, the colorant and the organic zirconium compound in an amount of 0.1–10 wt. parts per 100 wt. parts of the binder resin.

7. The toner according to claim 6, wherein the organic zirconium compound is contained in 0.5–5 wt. parts per 100 wt. parts of the binder resin.

8. The toner according to claim 1, comprising toner particles comprising at least the binder resin and the colorant, and the organic zirconium compound externally added to the toner particles in an amount of 0.01–5 wt. parts per 100 wt. parts of the binder resin.

9. The toner according to claim 1, wherein the binder resin has an acid value of 1–100 mgKOH/g.

10. The toner according to claim 1, wherein the binder resin has a carboxyl group or an acid anhydride group.

11. The toner according to claim 1, wherein the colorant comprises a magnetic iron oxide.

12. The toner according to claim 11, wherein said magnetic iron oxide comprises magnetic iron oxide particles containing 0.05–10 wt. % based on iron element of a different element other than iron.

13. The toner according to claim 1, further containing a wax.

14. The toner according to claim 13, wherein the wax comprises wax A and wax B having mutually different melting points.

15. The toner according to claim 14, wherein the wax A and the wax B have a melting point difference of 10–100° C. from each other.

16. The toner according to claim 13, wherein the wax comprises wax C and wax D comprising mutually different compositions.

17. The toner according to claim 16, wherein the wax C and the wax D also have mutually different melting points.

18. The toner according to claim 17, wherein the wax C and the wax D have a melting point difference of 10–100° C. from each other.

19. The toner according to claim 1, wherein the toner has a weight-average particle size of 2.5–10 μm.

20. The toner according to claim 1, wherein the toner has a weight-average particle size of 2.5–6 μm.

21. The toner according to claim 12, wherein the different element is an element selected from the group consisting of lithium, boron, magnesium, aluminum, silicon, phosphorus, sulfur, germanium, titanium, zirconium, tin, lead, zinc, calcium, barium, scandium, vanadium, chromium, manganese, cobalt, copper, nickel, gallium, indium, silver, palladium, gold, platinum, tungsten, molybdenum, niobium, osmium, strontium, yttrium, technetium, ruthenium, rhodium, and bismuth.

22. The toner according to claim 12, wherein the different element i an element selected from the group consisting of: lithium, beryllium, boron, magnesium, aluminum, silicon, phosphorus, germanium, zirconium, tin, sulfur, calcium, scandium, titanium, vanadium, chromium, manganese, cobalt, nickel, copper, zinc and gallium.

23. The toner according to claim 12, wherein the different element is an element selected from the group consisting of: magnesium, aluminum, silicon, phosphorus and zirconium.

24. The toner according to claim 1, wherein the binder resin contains a tetrahydrofuran (THF)-insoluble content.

25. The toner according to claim 24, wherein the THF-insoluble is contained in 1–70 wt. % of the binder resin.

26. The toner according to claim 24, wherein the THF-insoluble content is contained in 5–60 wt. % of the binder resin.

27. The toner according to claim 25, wherein the binder resin has an acid value of 1–100 mgKOH/g.

28. The toner according to claim 25, wherein the binder resin has an acid value of 1–70 mgKOH/g.

29. The toner according to claim 25, wherein the binder resin has an acid value of 1–50 mgKOH/g.

30. The toner according to claim 25, wherein the binder resin has an acid value of 2–40 mgKOH/g.

31. The toner according to claim 1, wherein the binder resin comprises a styrene-acryl copolymer resin and contains a THF-soluble content having a molecular weight distribution on gel permeation chromatography (GPC) chromatogram showing at least one peak in a molecular weight region of 3000–50,000 and at least one peak in a molecular weight region of at least $10^5$.

32. The toner according to claim 31, wherein the binder resin has a main peak in a molecular weight region of 5000–30,000.

33. The toner according to claim 31, wherein the binder resin has a main peak in a molecular weight region of 5000–20,000.

34. The toner according to claim 25, wherein the binder resin comprises a styrene-acryl copolymer resin and contains a THF-soluble content having a molecular weight distribution on gel permeation chromatography (GPC) chromatogram showing at least one peak in a molecular weight region of 3000–50,000 and at least one peak in a molecular weight region of at least $10^5$.

35. The toner according to claim 34, wherein the binder resin has a main peak in a molecular weight region of 5000–30,000.

36. The toner according to claim 34, wherein the binder resin has a main peak in a molecular weight region of 5000–20,000.

37. The toner according to claim 1, wherein the binder resin comprises a polyester resin and contains a THF-soluble content having a molecular weight distribution on gel permeation chromatography (GPC) chromatogram showing at least one peak in a molecular weight region of 3000–50,000.

38. The toner according to claim 1, wherein the binder resin has a glass transition point (Tg) of 45–75° C.

39. The toner according to claim 1, wherein the binder resin h a s a glass transition point (Tg) of 50– 70° C.

40. The toner according to claim 13, wherein the wax has a melting point of 70–140° C.

41. The toner according to claim 13, wherein the wax has a melting point of 70–120° C.

42. The toner according to claim 13, wherein the wax is contained in 0.2–20 wt. parts per 100 wt. parts of the binder resin.

43. The toner according to claim 13, wherein the wax is contained in 0.5–10 wt. parts per 100 wt. parts of the binder resin.

44. The toner according to claim 15, wherein at least one of the waxes A and B has a melting point of 70–120° C.

45. The toner according to claim 15, wherein at least one of the waxes A and B has a melting point of 70–100° C.

46. The toner according to claim 13, wherein the toner exhibits a maximum heat-absorption peak in a temperature region of 70–120° C. on its DSC heat-absorption curve.

47. The toner according to claim 13, wherein the toner exhibits a maximum heat-absorption peak in a temperature region of 70–110° C. on its DSC heat-absorption curve.

48. The toner according to claim 11, wherein the magnetic iron oxide is contained in 20–200 wt. parts per 100 wt. parts of the binder resin.

49. The toner according to claim 1, wherein the colorant is a non-magnetic colorant and is contained in 0.1–20 wt. parts per 100 wt. parts of the binder resin.

50. A method for developing an electrostatic image, comprising the steps of:

forming a layer of a mono-component developer comprising a toner having a negative triboelectric charge in a regulated thickness on a developer-carrying member by a developer thickness-regulation means, and developing an electrostatic image on an electrostatic image-bearing member disposed opposite to the developer-carrying member with the mono-component developer carried on the developer-carrying member;

wherein the toner comprises at least a binder resin, a colorant and an organic metal compound, and the organic metal compound is an organic zirconium compound having a structure represented by any one of the following formulae (1), (2), (32) and (33):

(1)

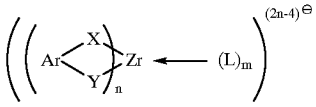

-continued (2n - 4)Cl or $(n - 2)C2^{2\oplus}$ wherein Ar denotes a benzene ring, naphthalene ring, anthracene ring or phenanthrene ring capable of having a substituent of alkyl, hydroxyl or carboxyl; X and Y independently denote O or —CO—O—; L denotes a neutral ligand of water, alcohol, ammonia, alkylamine or pyridine; C1 denotes a monovalent cation of hydrogen ion, monovalent metal ion, ammonium ion or alkylammonium ion; C2 denotes a divalent cation of a metal ion; n is 2, 3 or 4; m is 0, 2 or 4; a number (n) of ligands can be identical to or different from each other, and a number (m>0) of neutral ligands can be identical to or different from each other in each complex or complex salt of a formula; with the proviso that each complex or complex salt of a formula can also be a mixture of complex compounds having mutually different n or/and m, or a mixture of complex salts having mutually different counter ions C1 or/and C2, (2)

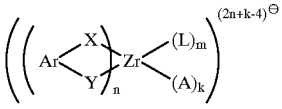

(2n + k-4)Cl$^{\oplus}$ or $(n + K/2-2)C2^{2\oplus}$ wherein Ar denotes a benzene ring, naphthalene ring, anthracene ring or phenanthrene ring capable of having a substituent of alkyl, hydroxyl or carboxyl; X and Y independently denote O or —CO—O—; L denotes a neutral ligand of water, alcohol, ammonia, alkylamine or pyridine; A denotes an anion of halogen, hydroxyl, carboxylate, carbonate, nitrate, sulfate, cyano or thiocyano, a plurality of A can be identical or different when k≧2; C1 denotes a monovalent cation of hydrogen ion, monovalent metal ion, ammonium ion or alkylammonium ion; C2 denotes a divalent cation of a metal ion; n is 1, 2, 3 or 4; m is 0, 1, 2, 3 or 4; k is 1, 2, 3, 4, 5 or 6; a number (when n≧2) of ligands can be identical to or different from each other, and a number (m≧2) of neutral ligands can be identical to or different from each other in each complex or complex salt of a formula; with the proviso that each complex or complex salt of a formula can also be a mixture of complex compounds having mutually different n or/and m, or a mixture of complex salts having mutually different counter ions C1 or/and C2;

$$(Ar—COO^-)_n Ar^4 \oplus (4-n)A_1 \ominus \text{ or } (2-n/2)A_2^{2\ominus} \quad (32)$$

$$(Ar—COO^-)_n Ar^4 \oplus (O)(2-n)A_{,1}^{\oplus} \quad (33),$$

wherein Ar denotes a benzene ring, naphthalene ring, anthracene ring or phenanthrene ring capable of having a substituent of alkyl, hydroxyl, acyloxy or carboxyl; $A_1$ denotes a monovalent anion of halogen, hydroxyl, nitrate or carboxylate; $A_2$ denotes a divalent anion, and n is 1, 2, 3 or 4 with the proviso that in case of n≧2 for each metal salt, a plurality (n) of aromatic carboxylates and aromatic hydroxycarboxylates as acid ions may be identical or different, and that each metal salt of a formula can be a mixture of different salts having different numbers of n.

51. The method according to claim 50, wherein the developer-carrying member comprises a substrate, and a resin layer containing an electroconductive substance formed on the substrate.

52. The method according to claim 50, wherein the mono-component developer comprises a magnetic toner having a negative triboelectric charge.

53. The method according to claim 50, wherein the mono-component developer comprises a non-magnetic toner having a negative triboelectric charge.

54. A method for developing an electrostatic image comprising the steps of:

(a) forming a layer of a mono-component developer comprising a toner having a negative triboelectric charge in a regulated thickness on a developer-carrying member by a developer thickness-regulation means, and (b) developing an electrostatic image on an electrostatic image-bearing member disposed opposite to the developer-carrying member with a mono-component developer carried on the developer-carrying member;

wherein the toner is according to any one of claims 1–49.

* * * * *

UNITED STATES PATENT AND TRADEMARK OFFICE

CERTIFICATE OF CORRECTION

PATENT NO. : 6,218,065 B1
DATED : April 17, 2001
INVENTOR(S) : Hirohide Tanikawa et al.

It is certified that error appears in the above-identified patent and that said Letters Patent is hereby corrected as shown below:

Title page,
Item [56] References Cited, FOREIGN PATENT DOCUMENTS,
"104940" should read -- 57-104940 --
"111541" should read -- 57-11541 --
"124357" should read -- 57-124357 --.

Column 5,
Line 42, "(2n-4)C1" should read -- (2n-4(C1$^{\oplus}$ --.

Column 35,
After Formula (164), insert --

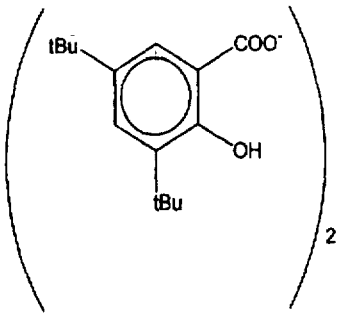

ZrO (165)

--

Column 37,
Line 48, "pats" should read -- parts --.

Column 57,
Line 61, "802" should be in boldface.

Column 65,
Table 5, "11.4" should read -- 114 --.

Column 66,
Table 6, "O -- D
O should read D
O D
O" D --.

UNITED STATES PATENT AND TRADEMARK OFFICE

CERTIFICATE OF CORRECTION

PATENT NO. : 6,218,065 B1
DATED : April 17, 2001
INVENTOR(S) : Hirohide Tanikawa et al.

It is certified that error appears in the above-identified patent and that said Letters Patent is hereby corrected as shown below:

Columns 67 and 68,
Table 7, "Image standing" should read -- Image quality --; and "Image density after-defect" should read -- Image density after standing --.

Column 72,
Table 9, "h(2)/l(4)" should read -- h(2)/j(4) --.

Columns 73 and 74,
Table 11, "Image defect" should read -- Back soiling --.

Column 74,
Table 12, "Image standing" should read -- Image quality; and

"Image density after-defect" . should read -- Image density after-standing --.

Column 74,
Table 12, "A" (second occurrence) should read -- 1.37 --.

Columns 75 and 76,
Table 12, "Image standing" should read -- Image quality --; and "Image density after-defect" should read -- Image density after-standing --.

UNITED STATES PATENT AND TRADEMARK OFFICE

CERTIFICATE OF CORRECTION

PATENT NO. : 6,218,065 B1
DATED : April 17, 2001
INVENTOR(S) : Hirohide Tanikawa et al.

It is certified that error appears in the above-identified patent and that said Letters Patent is hereby corrected as shown below:

Column 76,
Table 13, "Z.4" should read -- 2.4 --.

Column 78,
Line 37, "with;" should read -- with --.

Column 86,
Table 24, "Ex. 29" (first occurrence) should read -- Exh. 28 --; "0.9-12" should read -- 0.6-17 --; and "1.51" should read -- 1.52 --.

Column 89,
Line 53, "(2n-4)C1" should read -- $(2n-4)C1^{\oplus}$ --.

Column 90,
Line 67, "$C_1$ and /or C2;" should read -- C1 and/or C2; --.

Column 93,
Line 39, "a mixture of" should read -- identical or --;
Line 40, "mixture" should read -- mixture of different --.

Column 95,
Line 15, "h a s a" should read -- has a --.

Column 96,
Line 2, "(2n-4)C1" should read -- $(2n-4(C1^{\oplus}$ --.

Signed and Sealed this

Twenty-eighth Day of May, 2002

*Attest:*

*Attesting Officer*

JAMES E. ROGAN
*Director of the United States Patent and Trademark Office*